US008082105B2

(12) United States Patent
Ryu et al.

(10) Patent No.: US 8,082,105 B2
(45) Date of Patent: Dec. 20, 2011

(54) METHOD AND APPARATUS FOR MEASURING IN-SITU STRESS OF ROCK USING THERMAL CRACK

(75) Inventors: Chang-Ha Ryu, Daejeon (KR); Dong-Woo Ryu, Daejeon (KR); Byung-Hee Choi, Daejeon (KR); Loui Porathur John, Dhanbad (IN); Jung-Ho Synn, Seoul (KR)

(73) Assignee: Korea Institute of Geoscience and Mineral Resources (KIGAM), Daejeon (KR)

( * ) Notice: Subject to any disclaimer, the term of this patent is extended or adjusted under 35 U.S.C. 154(b) by 648 days.

(21) Appl. No.: 12/293,292

(22) PCT Filed: Oct. 30, 2007

(86) PCT No.: PCT/KR2007/005396
§ 371 (c)(1),
(2), (4) Date: Sep. 17, 2008

(87) PCT Pub. No.: WO2008/054118
PCT Pub. Date: May 8, 2008

(65) Prior Publication Data

US 2009/0070043 A1 Mar. 12, 2009

(30) Foreign Application Priority Data

Oct. 31, 2006 (KR) ..... 10-2006-0106208
Oct. 9, 2007 (KR) ..... 10-2007-0101406
Oct. 9, 2007 (KR) ..... 10-2007-0101418

(51) Int. Cl.

| | |
|---|---|
| ***G01V 7/00*** | (2006.01) |
| ***G01V 7/02*** | (2006.01) |
| ***G01V 3/18*** | (2006.01) |
| ***G01V 3/00*** | (2006.01) |
| ***G01L 1/00*** | (2006.01) |
| ***G01K 11/00*** | (2006.01) |
| ***E21C 37/12*** | (2006.01) |
| ***E21B 7/00*** | (2006.01) |
| ***E21B 47/06*** | (2006.01) |
| ***E21B 47/00*** | (2006.01) |
| ***E21B 43/26*** | (2006.01) |

(52) U.S. Cl. ..... 702/11; 702/6; 702/42; 702/130; 175/11; 175/17; 175/50; 324/324; 324/347; 166/250.01; 166/259

(58) Field of Classification Search ..... 702/6–11, 702/42, 130, 138, 179; 340/853.1–854.1; 175/11, 17, 18, 48, 50, 40; 324/324, 332, 324/333, 347; 166/250.01–252.1, 256–259; 73/152.01, 152.02, 152.12, 152.13, 152.39; 703/2, 9, 10
See application file for complete search history.

(56) References Cited

U.S. PATENT DOCUMENTS 4,491,022 A 1/1985 De la Cruz
(Continued)

FOREIGN PATENT DOCUMENTS

KR 1020060055727 A 5/2006

OTHER PUBLICATIONS

Yong-Bok Jung, et al; "Measurement of Mode I Fracture Toughness of Rocks with Temperature and Moisture Conditions at Low Temperature", (Abstract Only), Tunnel & Underground, vol. 11, No. 4, pp. 352-361, 2001 (Exact date cannot be found).
(Continued)

*Primary Examiner* — Michael Nghiem
*Assistant Examiner* — Ricky Ngon
(74) *Attorney, Agent, or Firm* — Ladas & Parry LLP

(57) ABSTRACT

Disclosed is a method and apparatus for measuring in-situ stress in rock using a thermal crack. The method involves forming a borehole, cooling a wall of the borehole, applying tensile thermal stress, forming a crack in the borehole wall, and measuring temperature and cracking point. Afterwards, the borehole wall is heated to close the formed crack, the borehole wall is cooled again to re-open the crack, and temperature is measured when the crack is re-opened. The in-situ stress of the rock is calculated using a first cracking temperature at which the crack is formed and a second cracking temperature at which the crack is re-opened. Further, the apparatus cools, heats and re-cools the borehole wall, thereby measuring the first cracking temperature, the second cracking temperature, and the cracking point.

19 Claims, 44 Drawing Sheets

U.S. PATENT DOCUMENTS

| | | | | |
|---|---|---|---|---|
| 6,722,437 | B2 * | 4/2004 | Vercaemer et al. | 166/308.1 |
| 2004/0146288 | A1 * | 7/2004 | Vinegar et al. | 392/301 |
| 2007/0215345 | A1 * | 9/2007 | Lafferty et al. | 166/250.1 |
| 2010/0004906 | A1 * | 1/2010 | Searles et al. | 703/2 |
| 2010/0089585 | A1 * | 4/2010 | Kaminsky | 166/302 |

OTHER PUBLICATIONS

Hyeong-Won Lee, et al; "A Study on Thermal Shock, Thermal Expansion and Thermal Cracking of Rocks under High Temperature", (Abstract Only), Tunnel & Underground, vol. 5, pp. 22-40, 1995 (Exact date cannot be found).

Yilmaz Mahmutoglu; "The effects of strain rate and saturation on a micro-cracked marble", (Abstract Only), Engineering Geology, vol. 82, No. 3, pp. 137-186, 2006 (Exact date cannot be found) available online Dec. 1, 2005.

Teng-Fong Wong, et al; "Thermal Expansion of Rocks: Some Measurements at High Pressure", Tectonophysics, vol. 57, Issues 2-4, pp. 95-117, Aug. 1979 (Exact date cannot be found).

Jeremy D. Acord, et al; "In-situ Stress Measurements during MOCVD Growth of AlGaN on SiC", (Abstract Only) Journal of Crystal Growth, vol. 272, pp. 65-71, 2004 (Exact date cannot be found).

C. Fairhurst; "Measurement of In Situ Rock Stresses, with Particular Reference to Hydraulic Fracturing", Felsmechanik, vol. 11/3-4, 1964 (Exact date cannot be found).

Robert H Merrill; "Three-Component Borehole Deformation Gage For Determining The Stress in Rock", United States Department of the Interior, report of investigations 7015, 1967 (Exact date cannot be found).

E.R. Leeman, et al; "A Technique for Determining the Complete State of Stress in Rock using a Single Borehole", 1966 (Exact date cannot be found).

T. Ito, et al; "Laboratory and field verification of a new approach to stress measurements using a dilatometer tool", International Journal of Rock Mechanics & Mining Sciences, 38, pp. 1173-1184 2001 (Exact date cannot be found).

International Search Report: PCT/KR2007/005396.

* cited by examiner

【Figure 1】
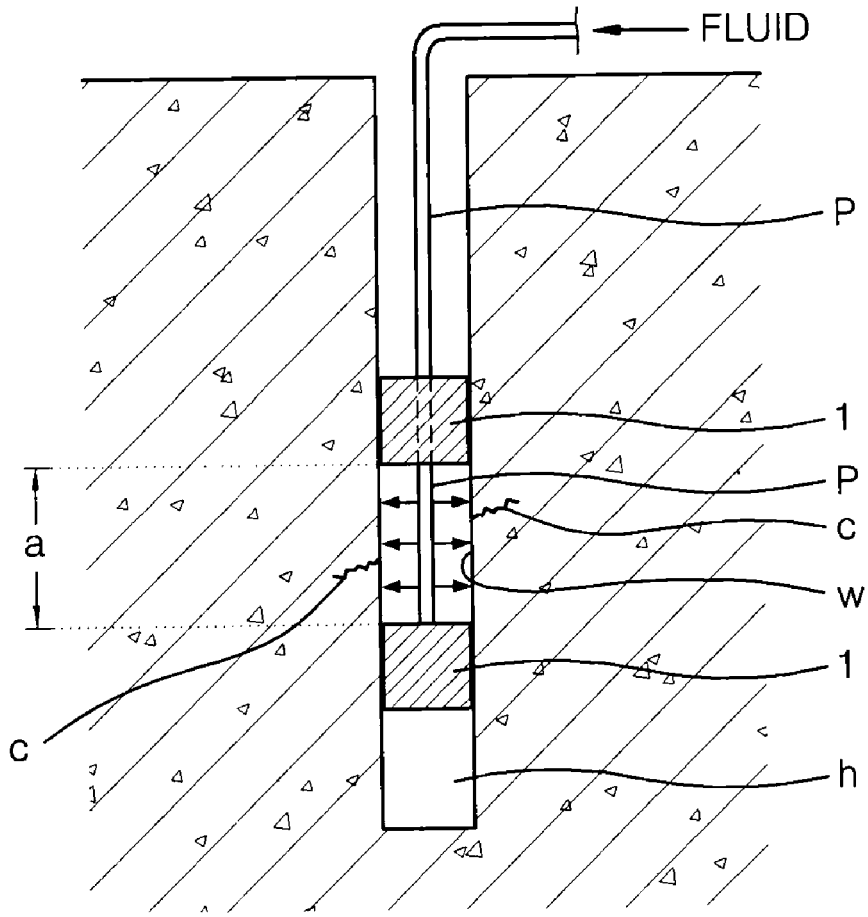

【Figure 2】
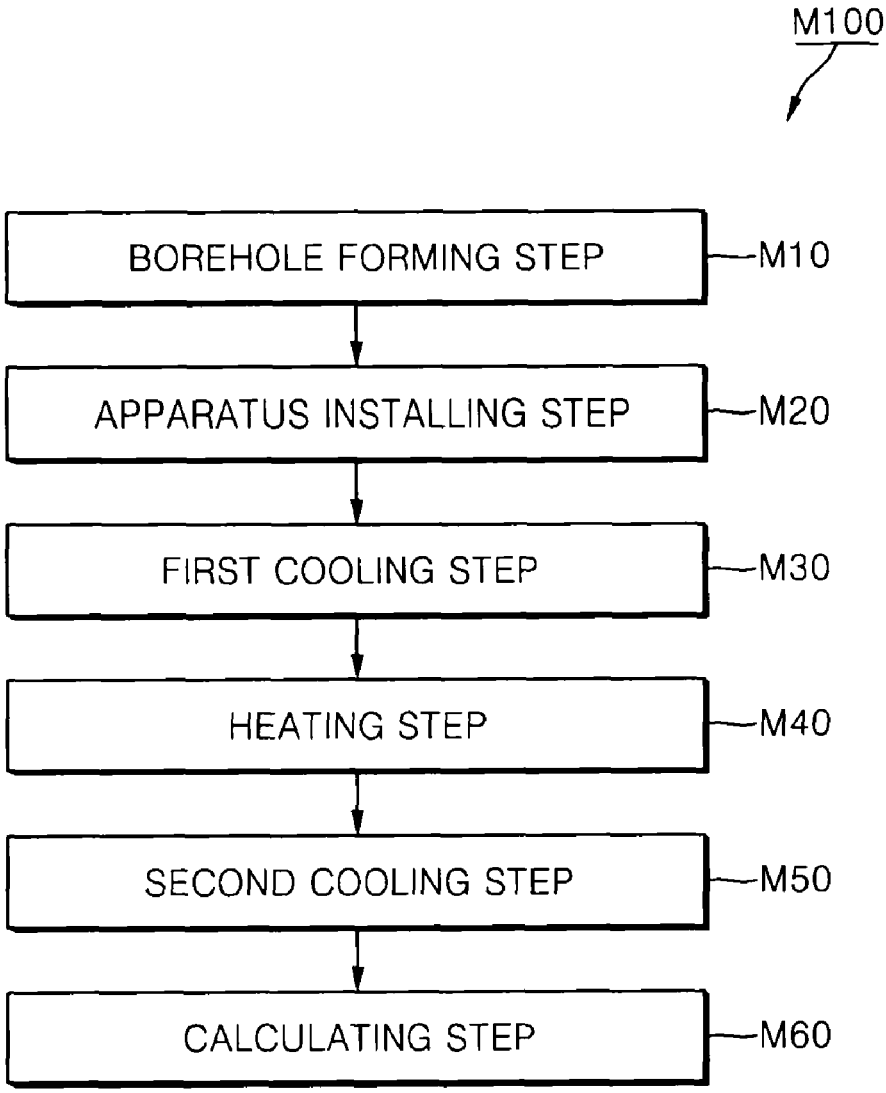

【Figure 3】
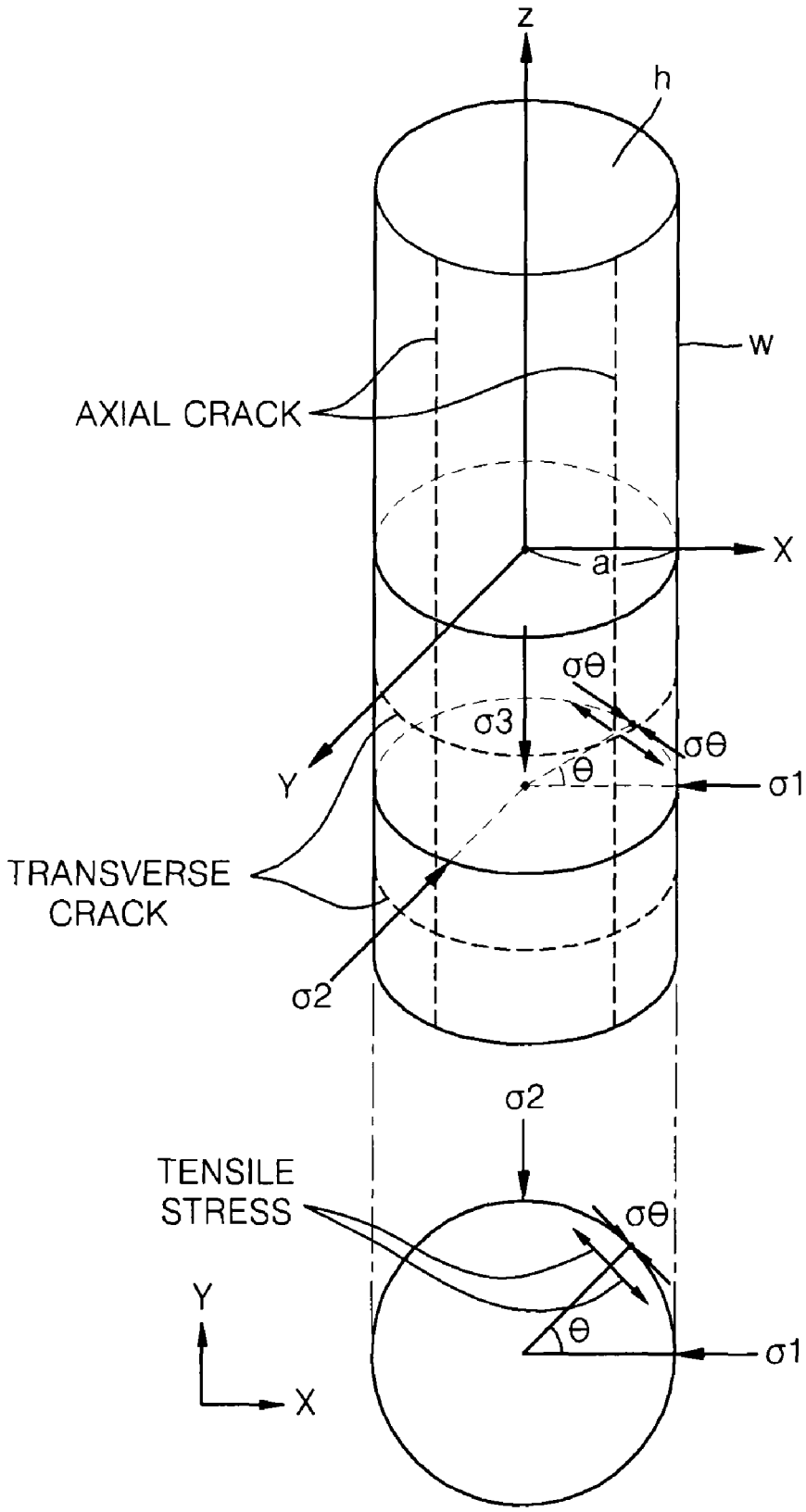

【Figure 4A】
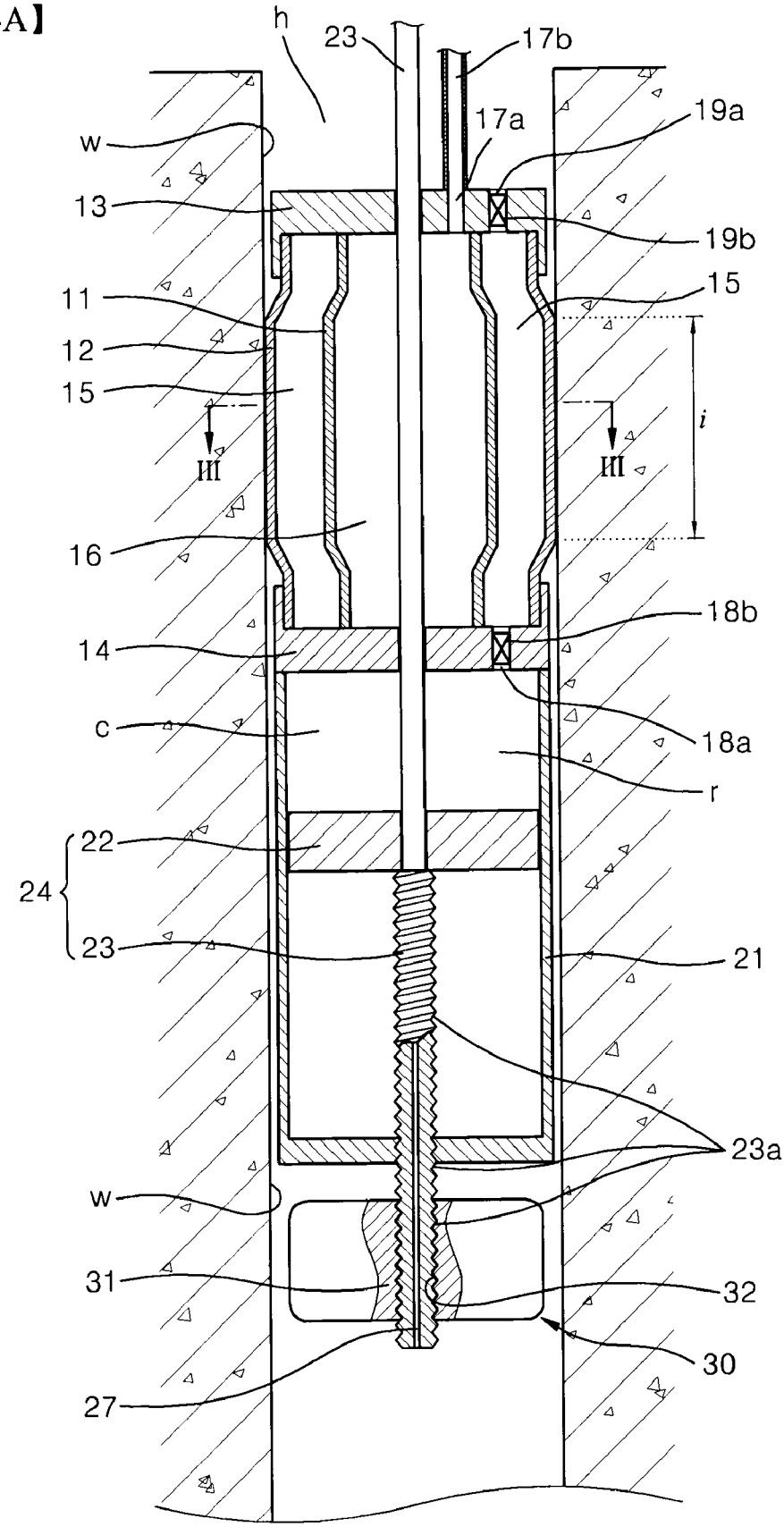

【Figure 4B】
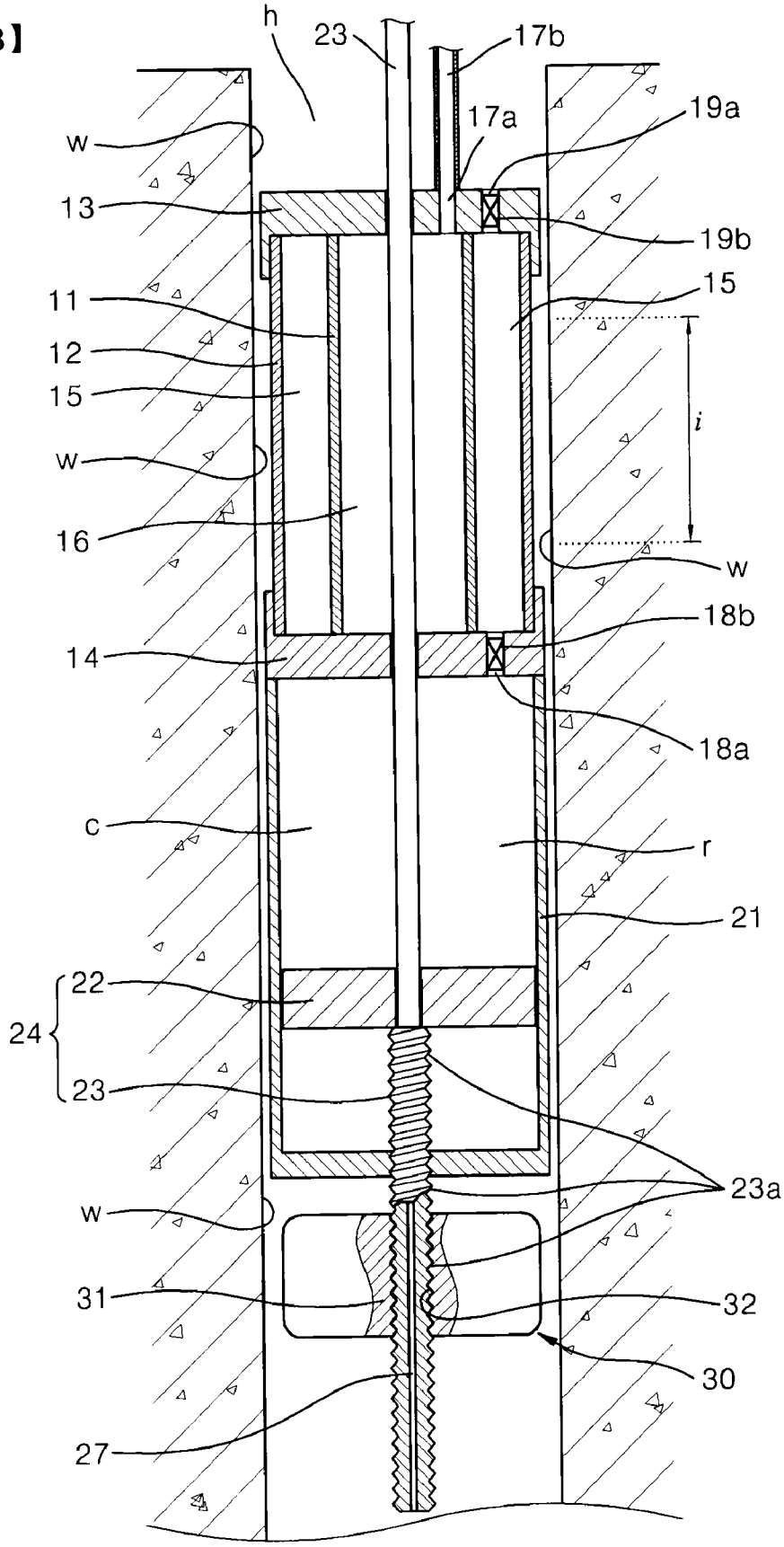

【Figure 5】
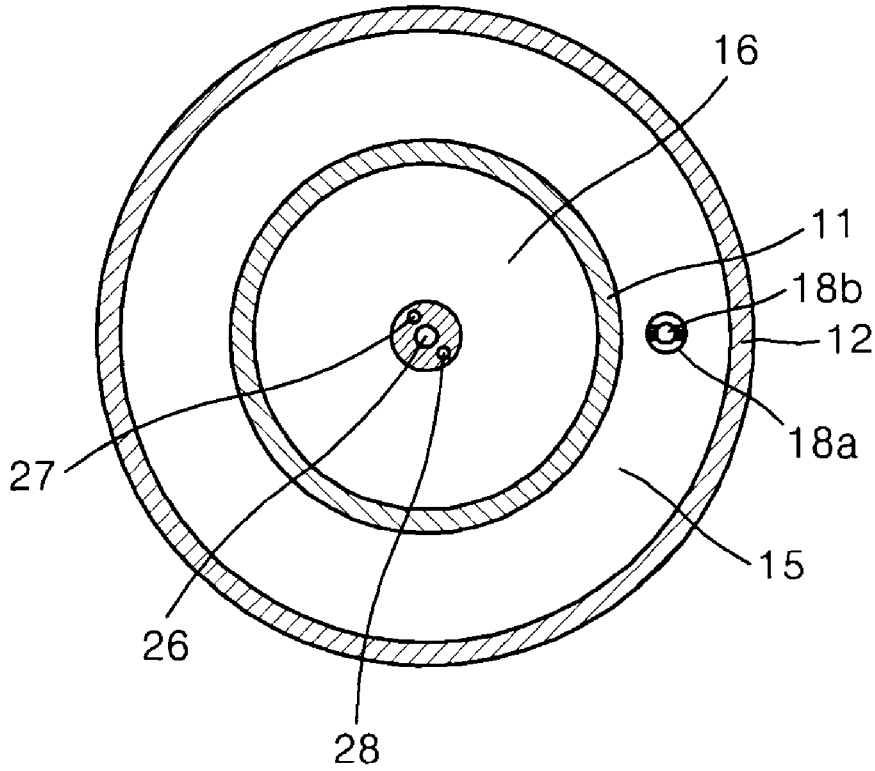

【Figure 6】
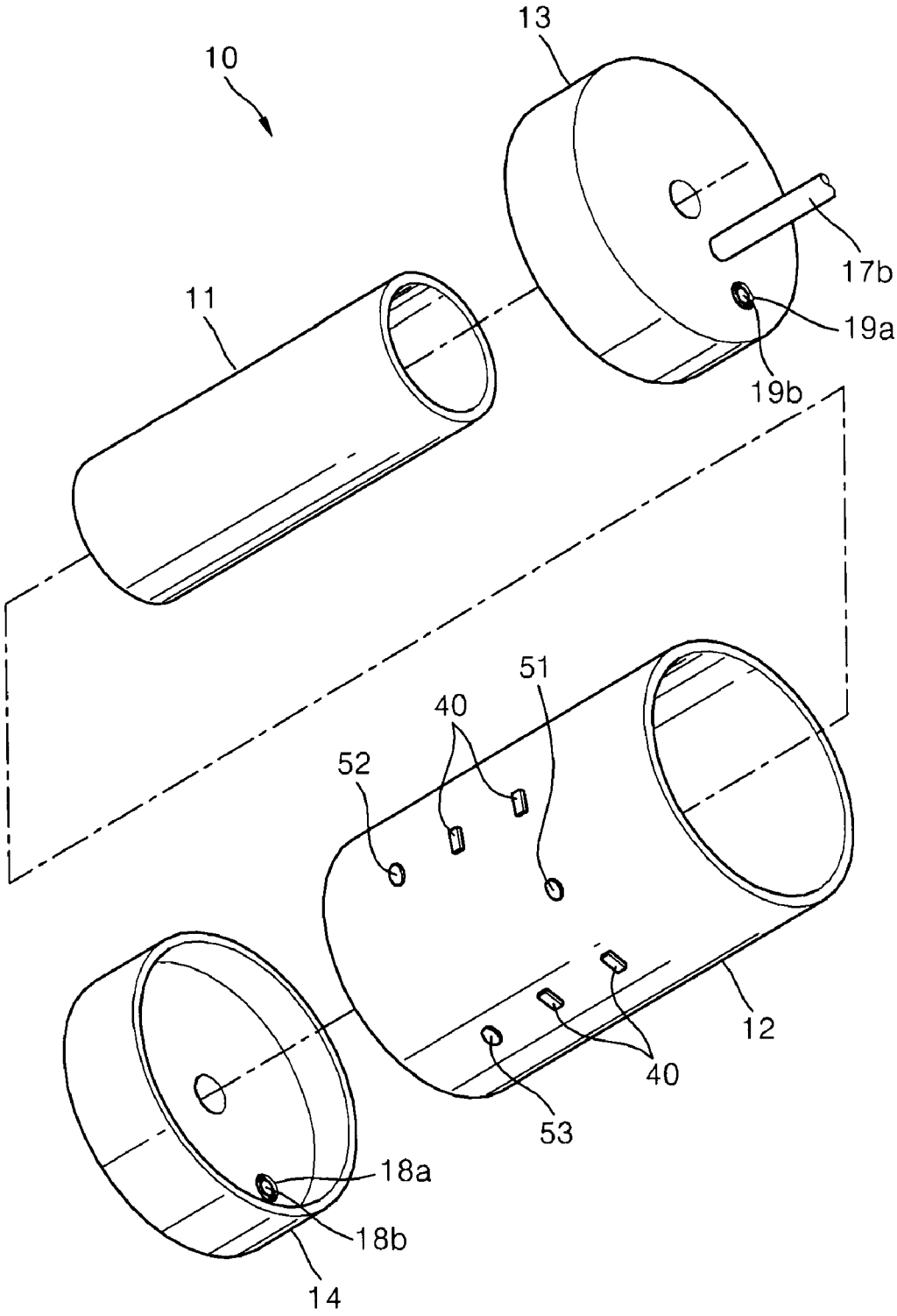

【Figure 7】
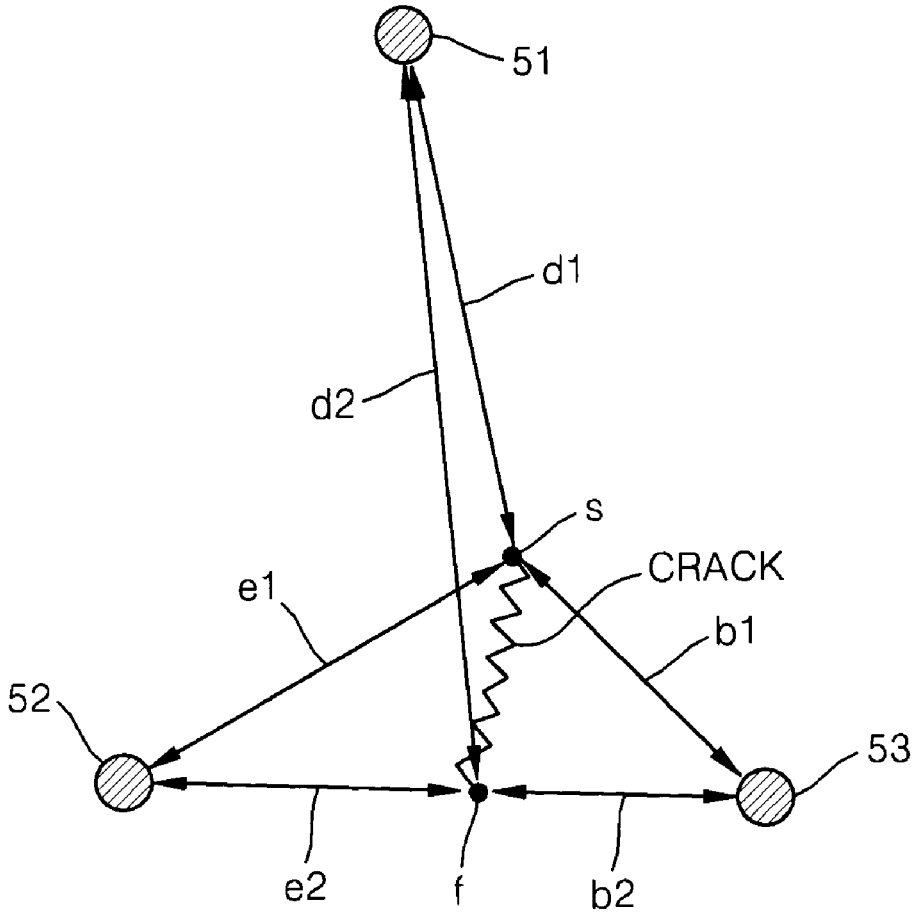

【Figure 8A】
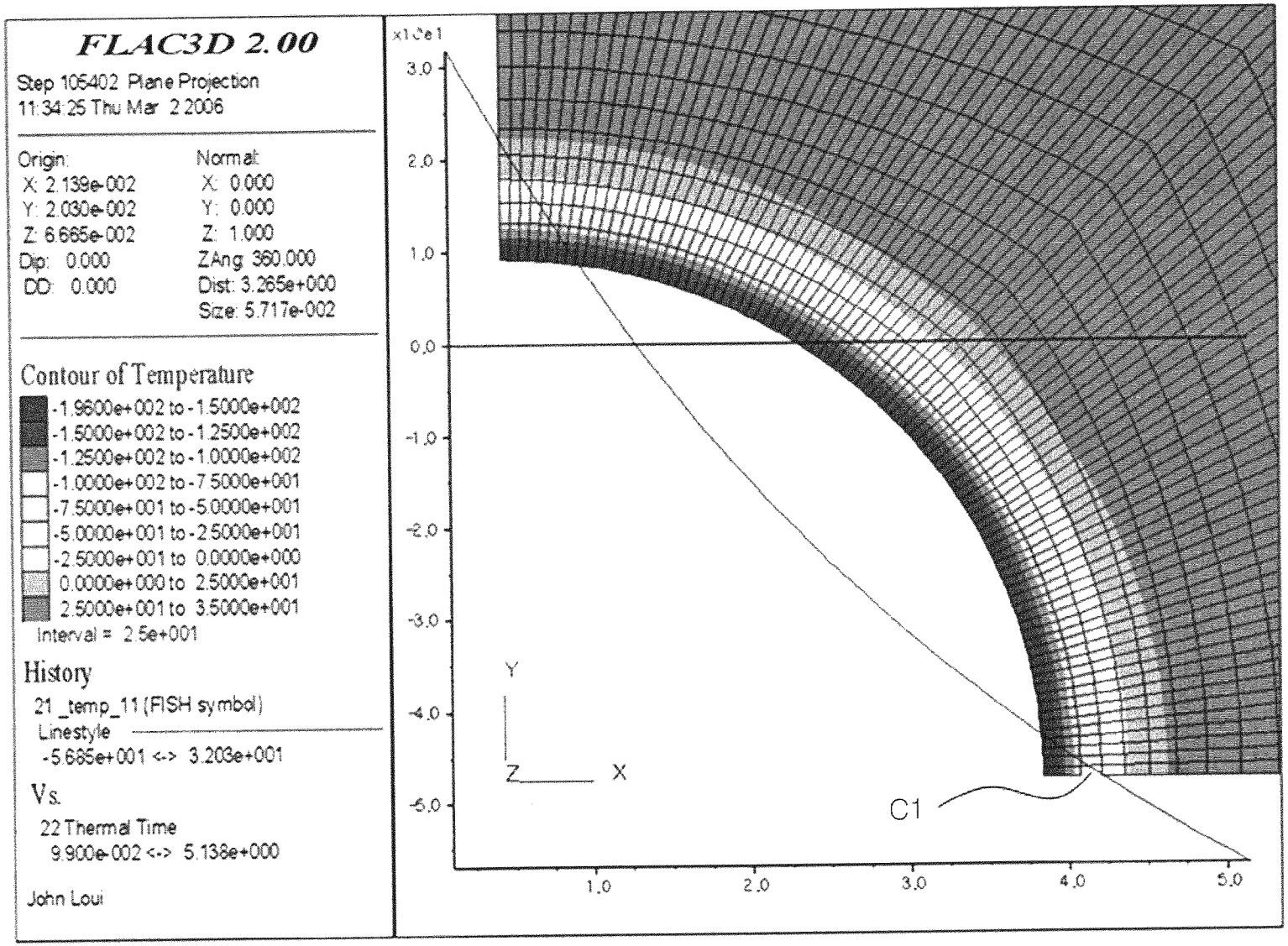

【Figure 8B】
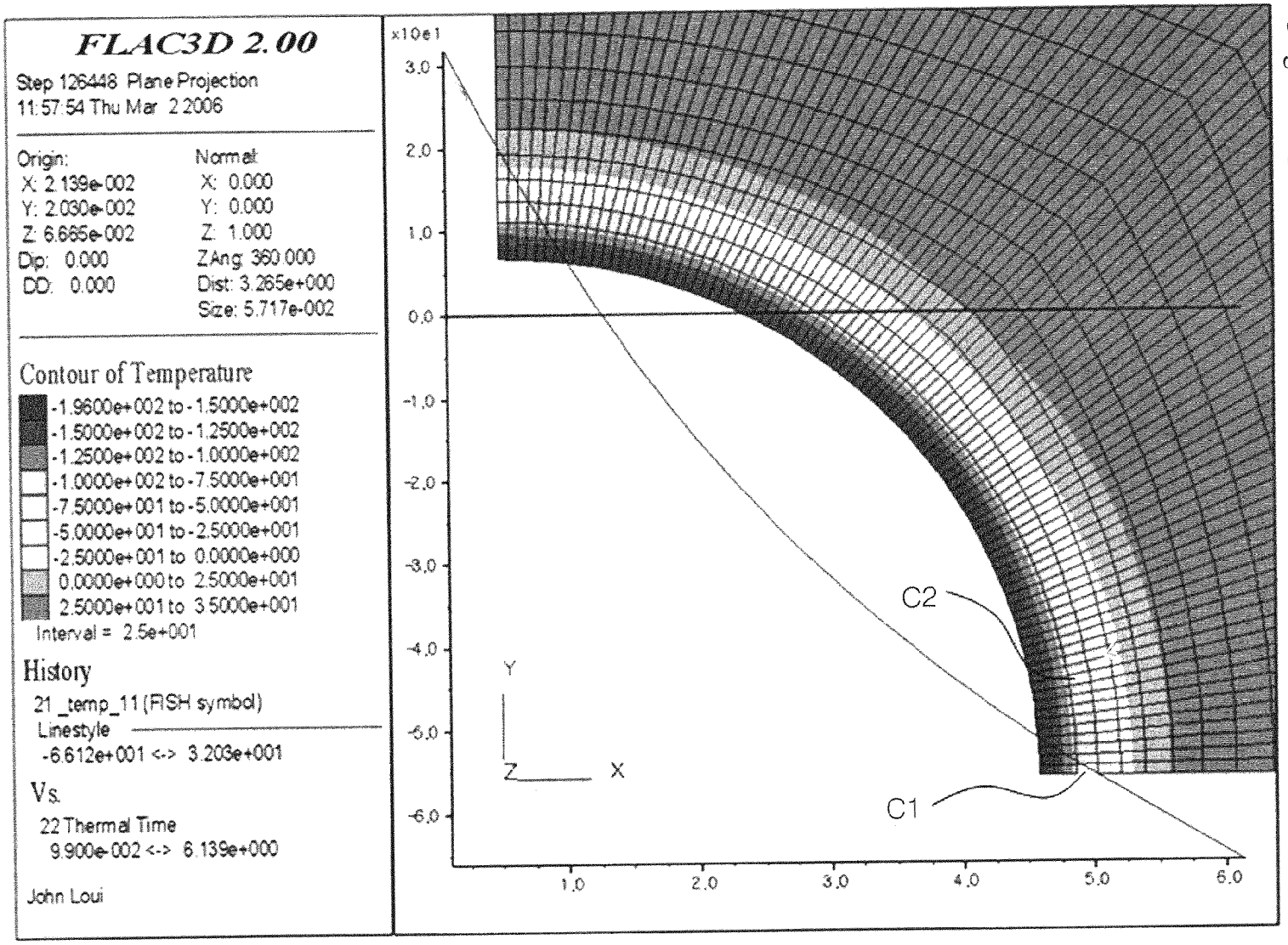

【Figure 8C】
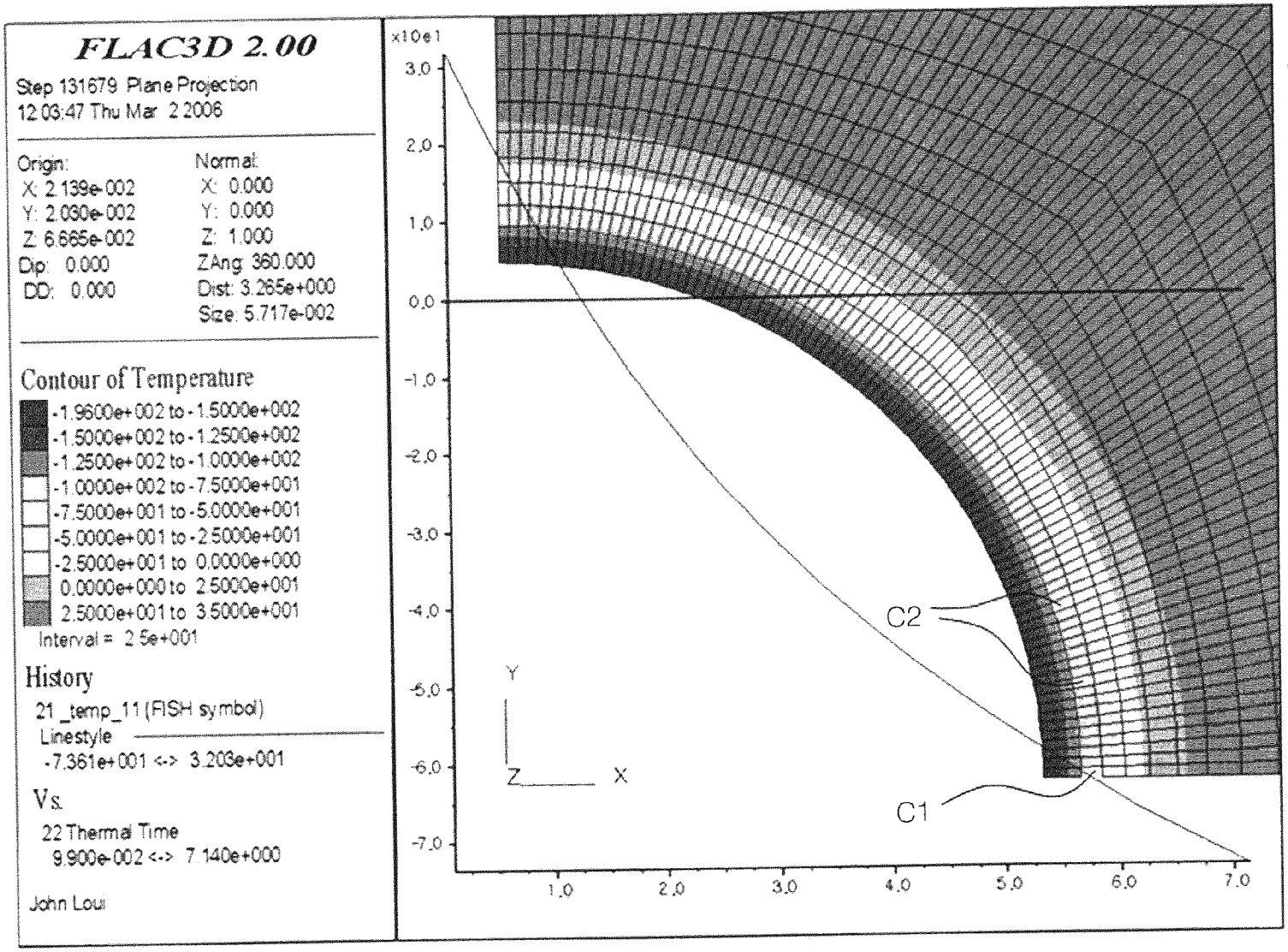

【Figure 8D】
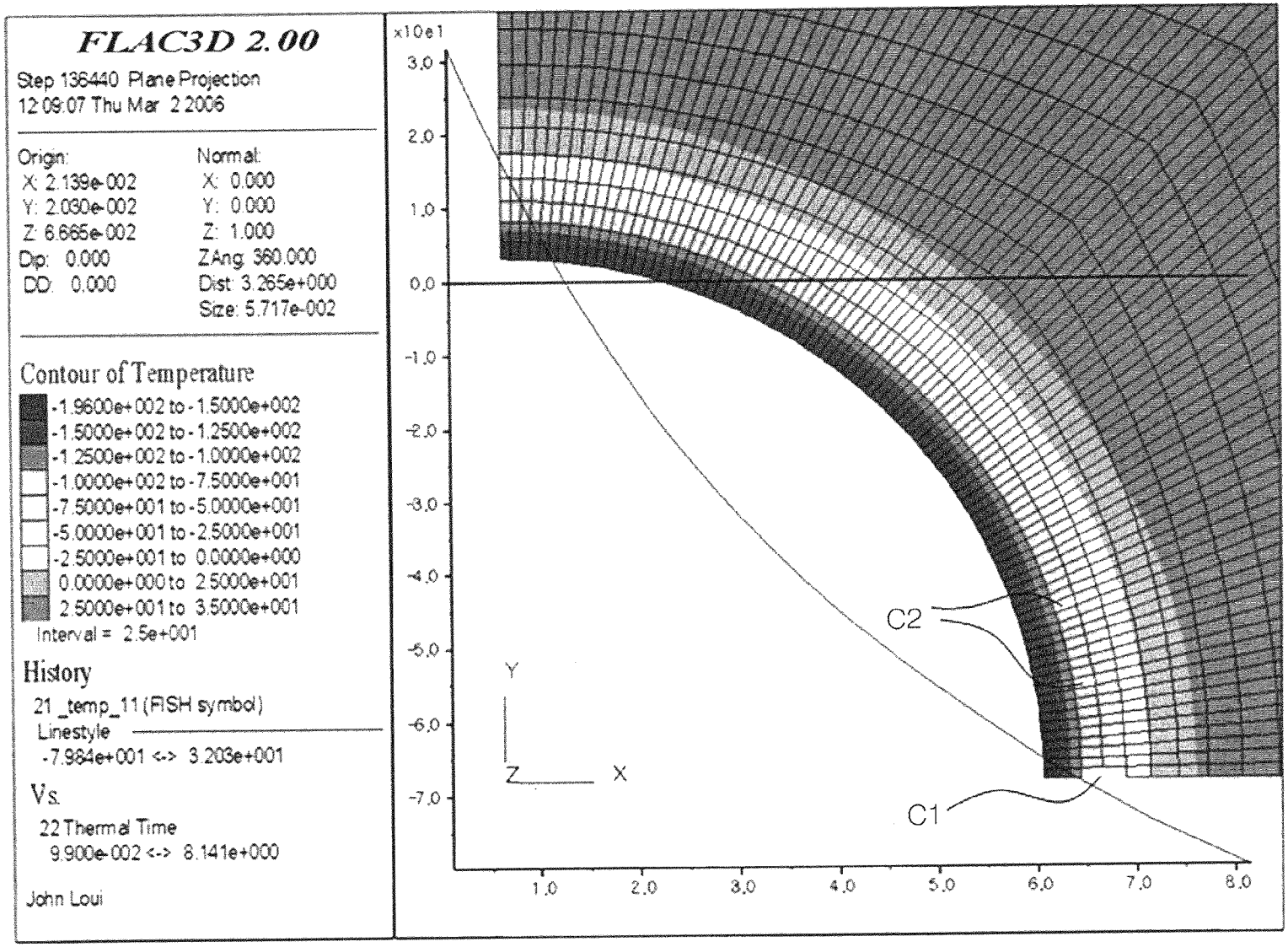

【Figure 8E】
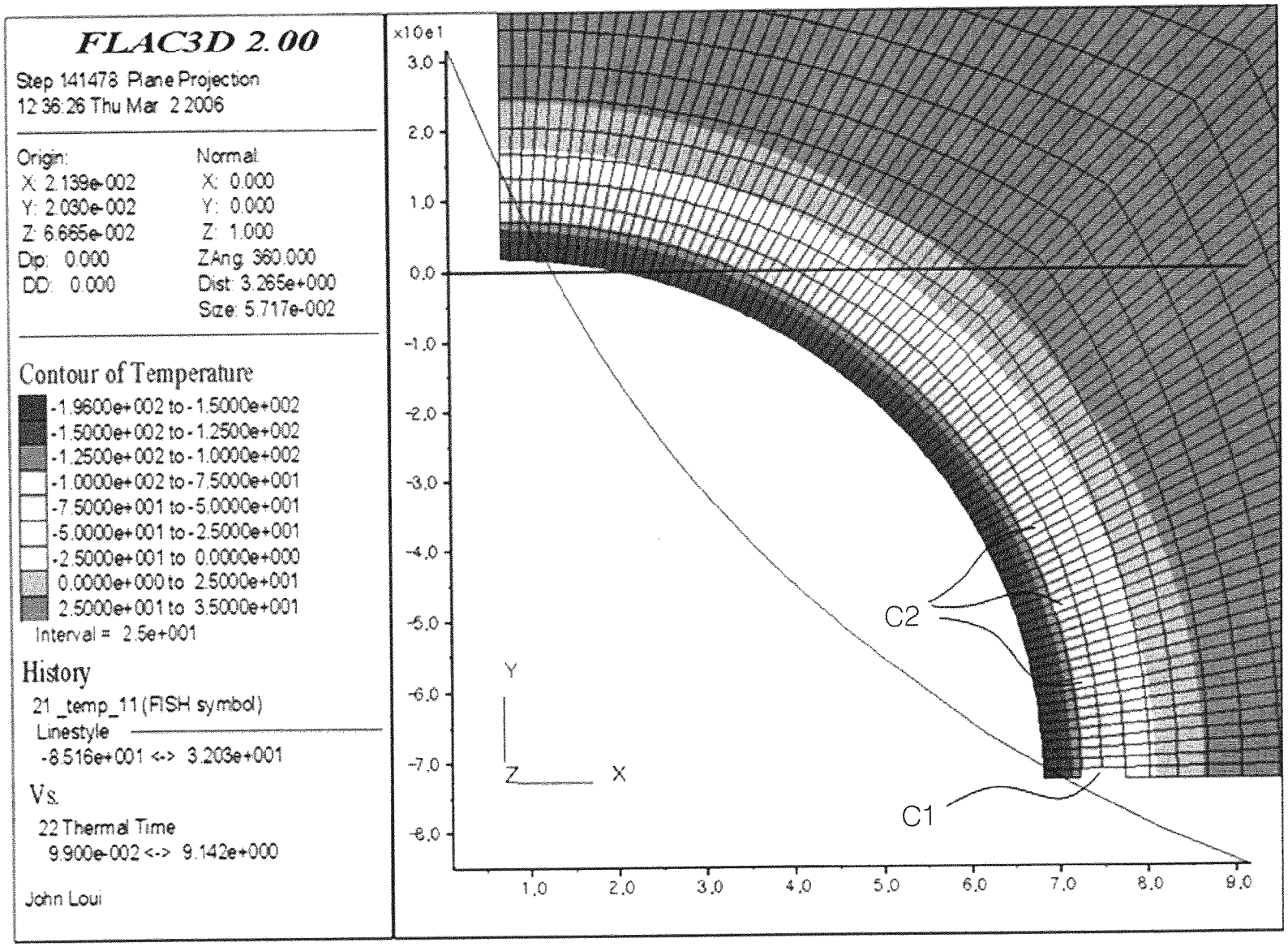

【Figure 8F】
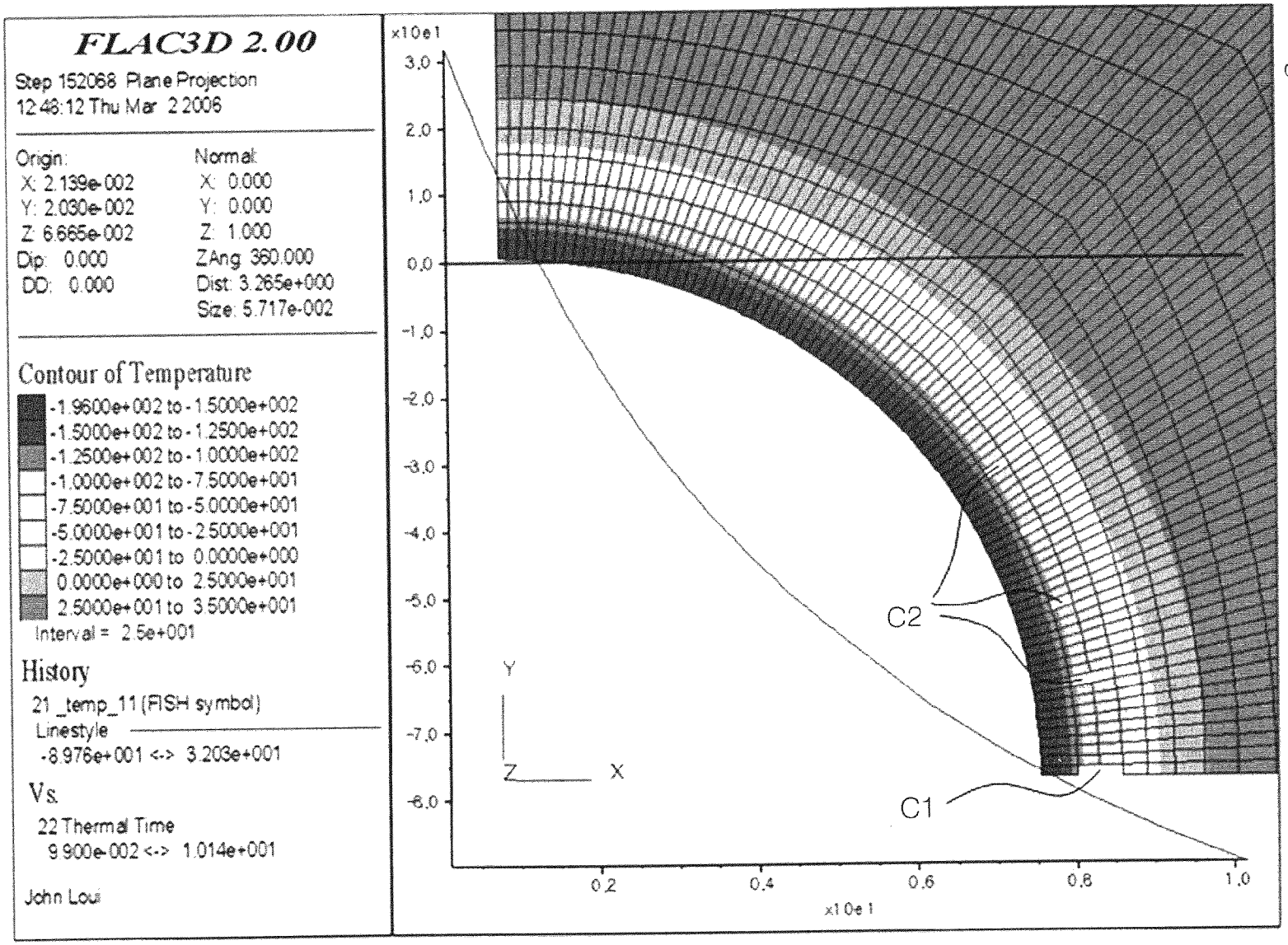

【Figure 8G】
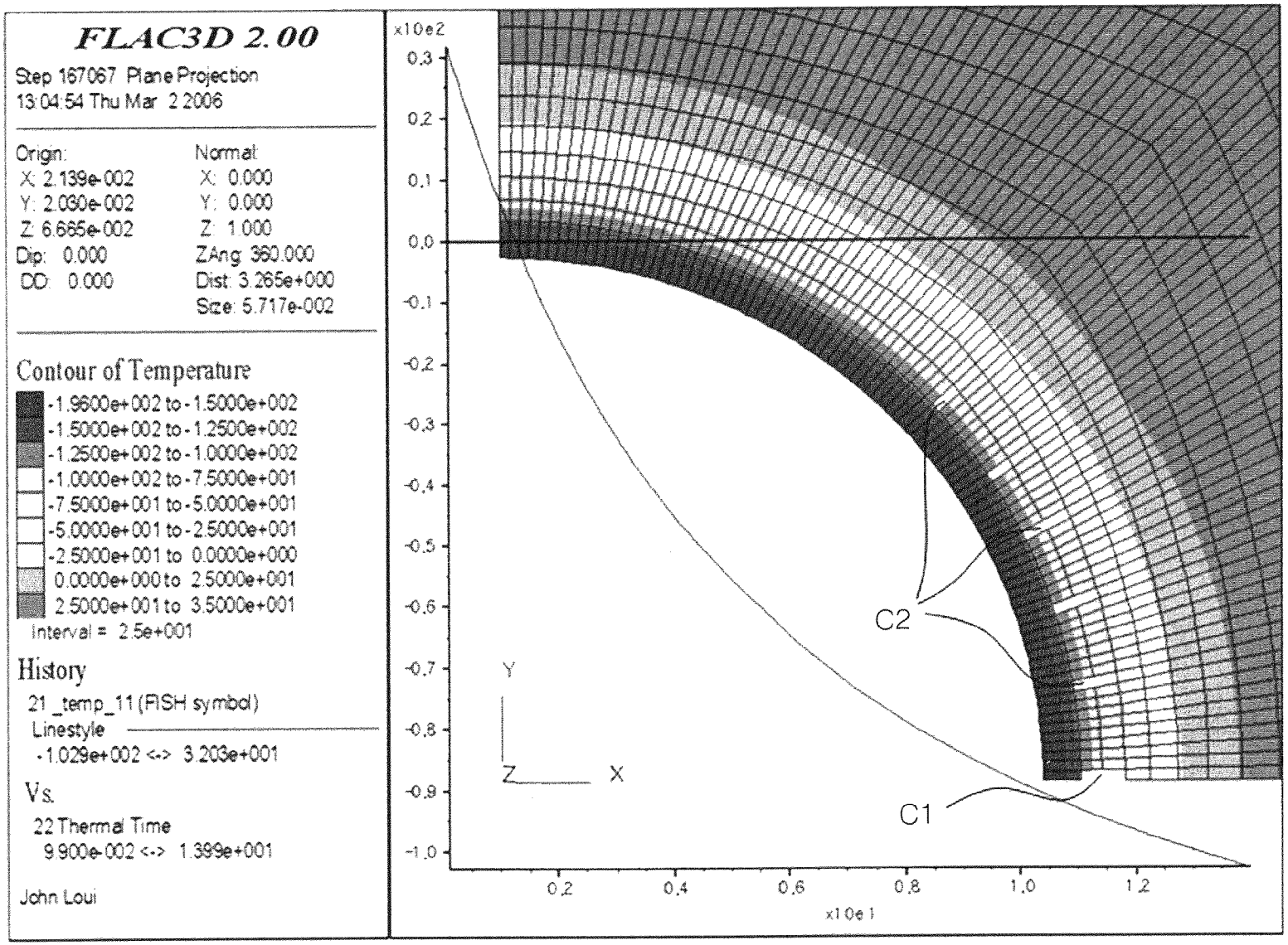

【Figure 8H】
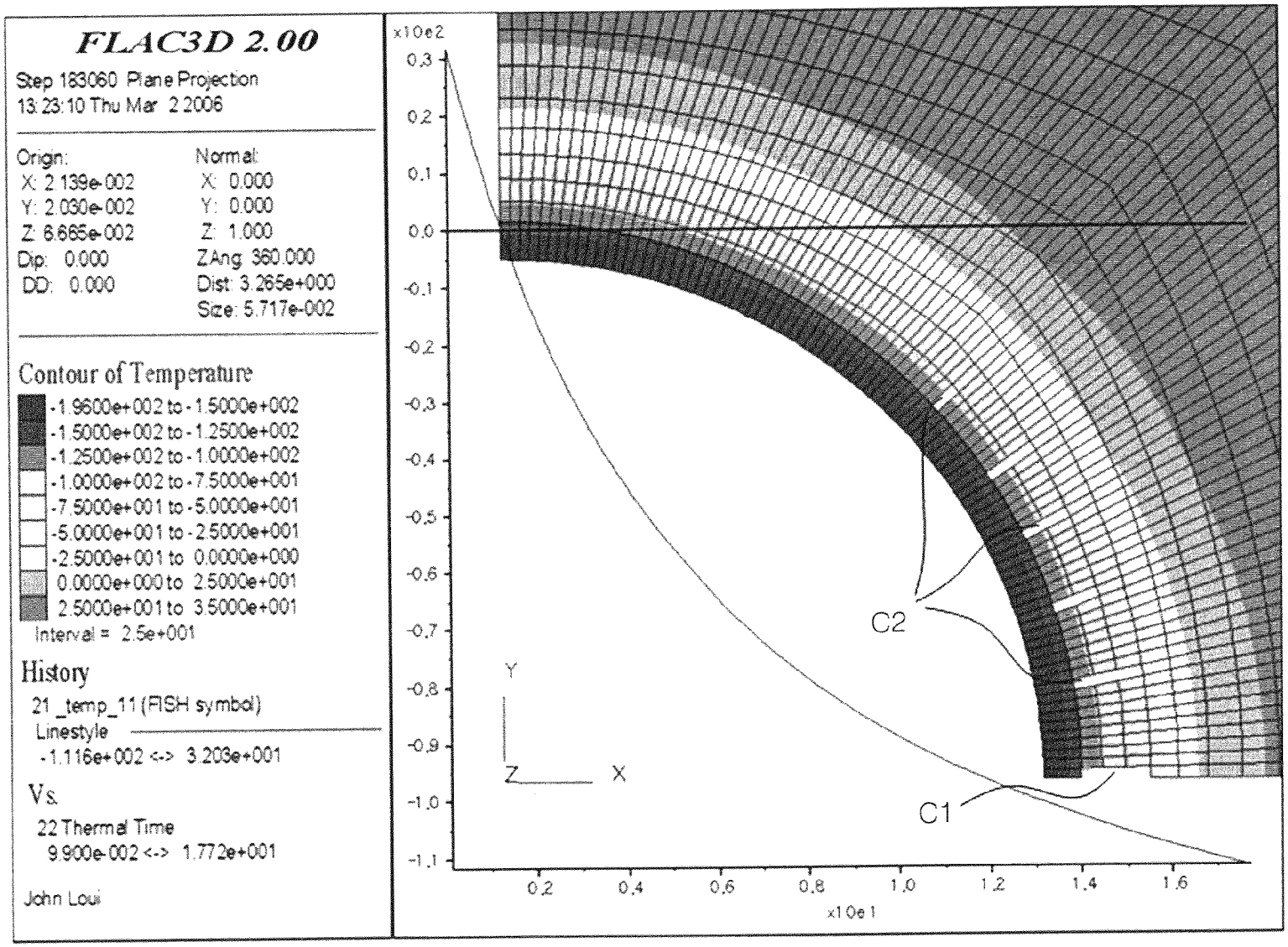

【Figure 8I】
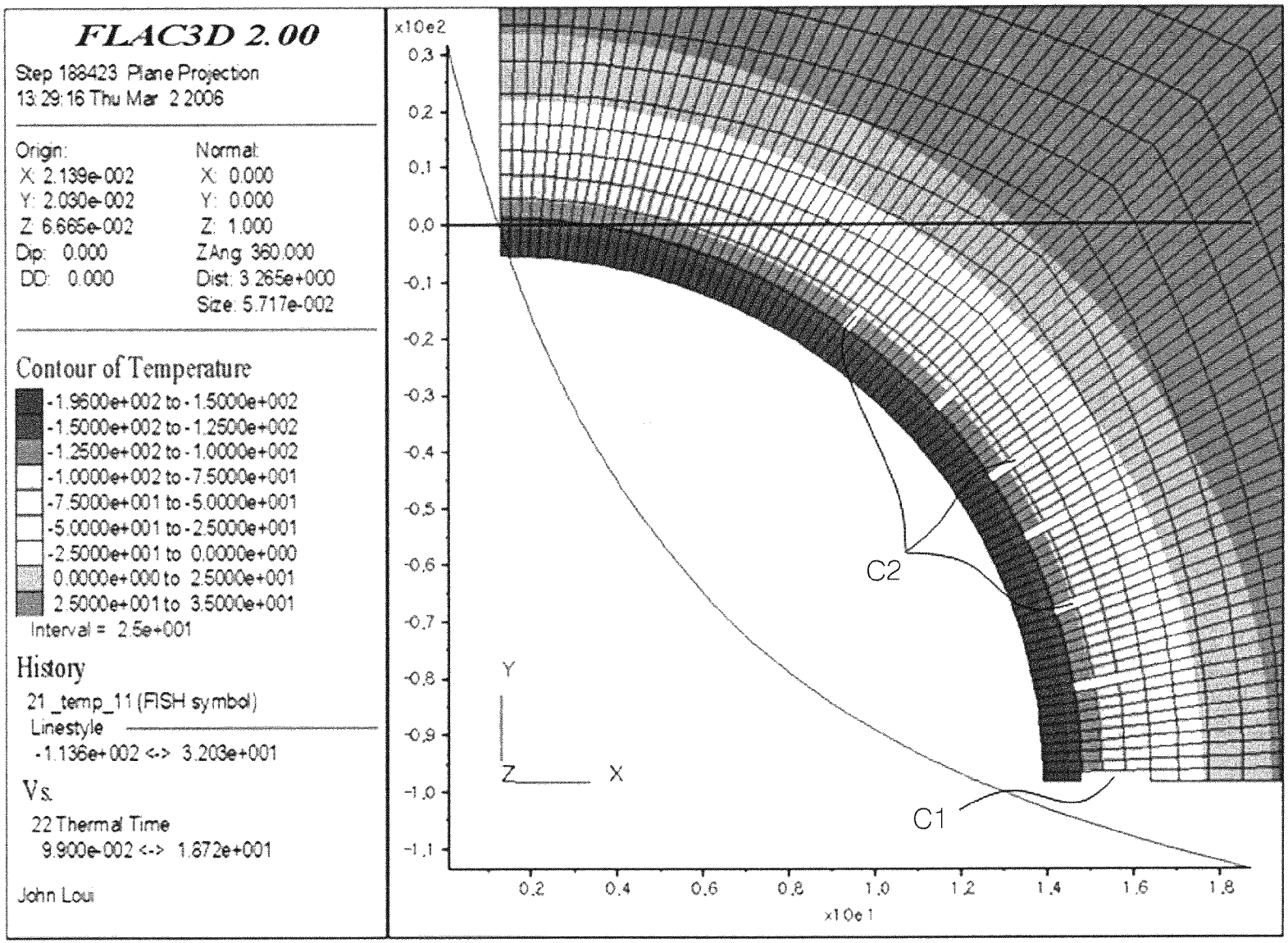

【Figure 8J】
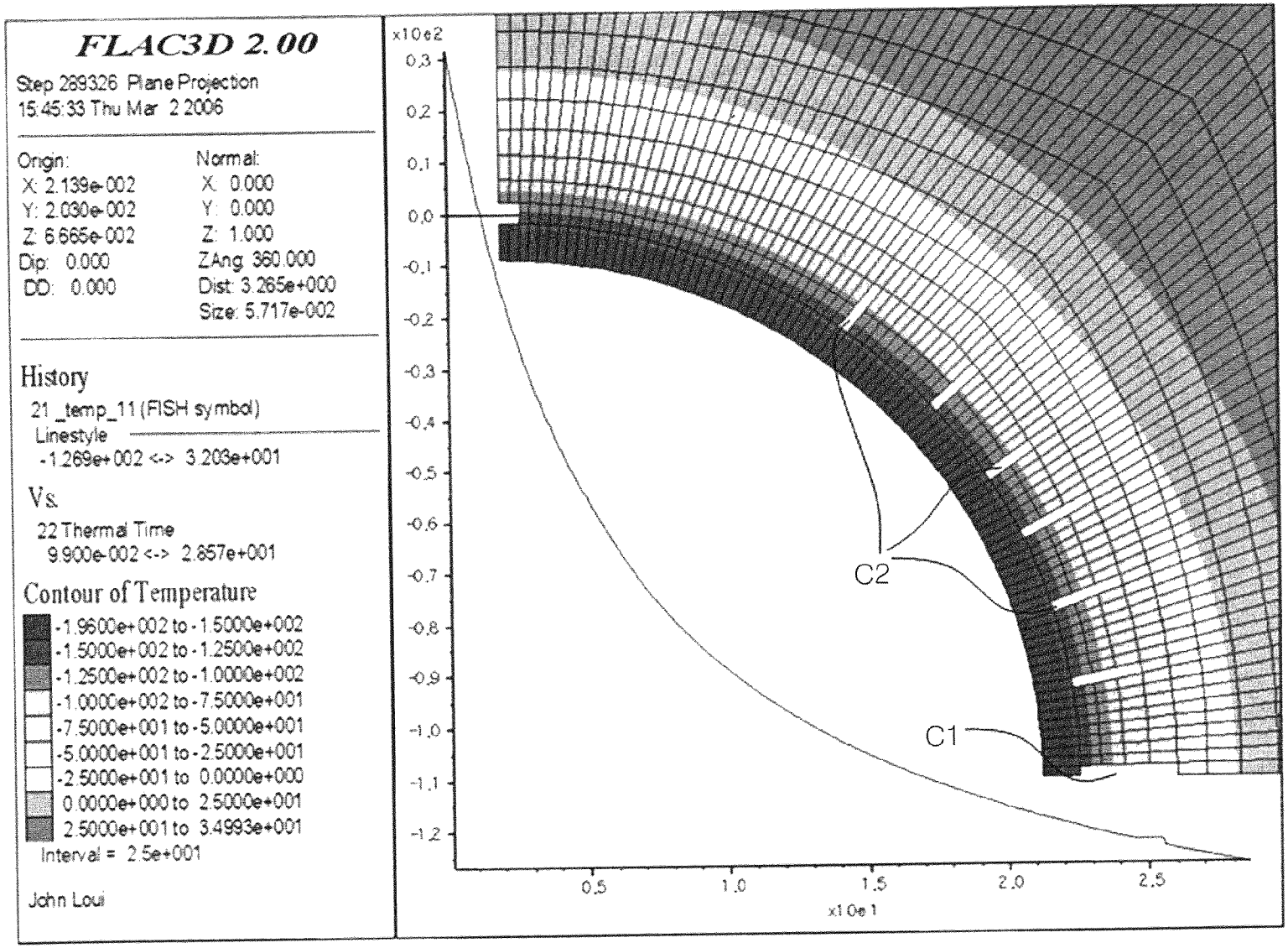

【Figure 9】
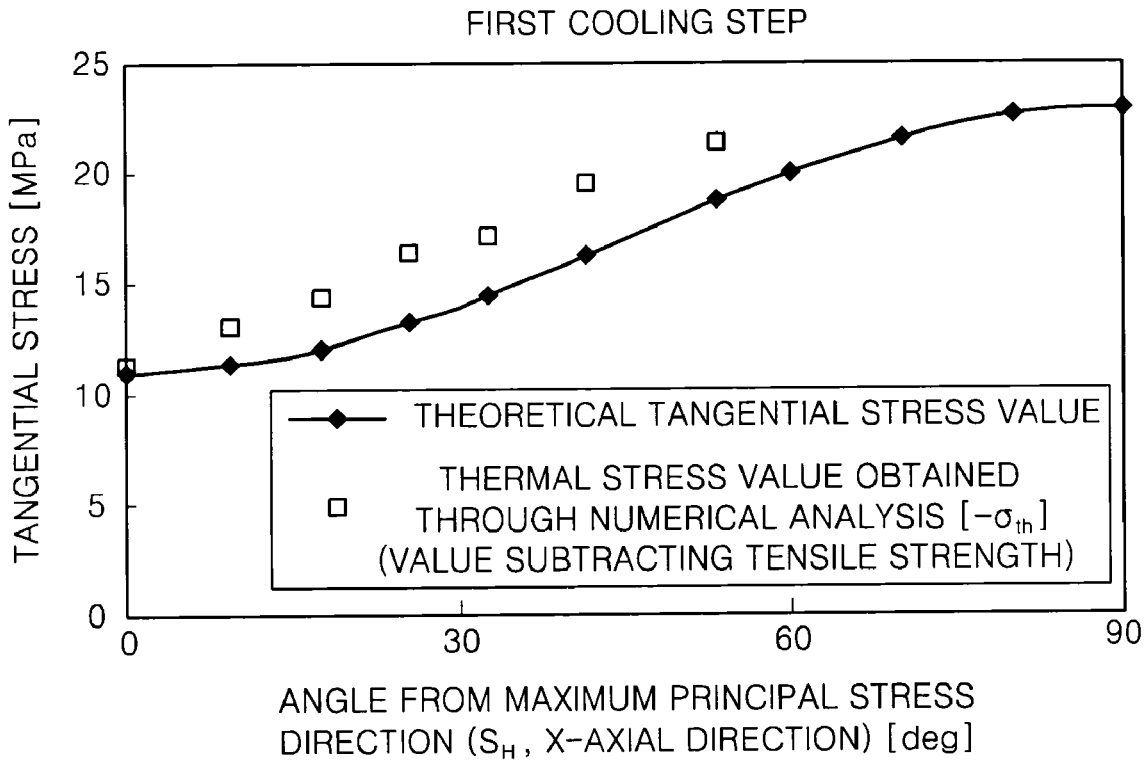

【Figure 10A】
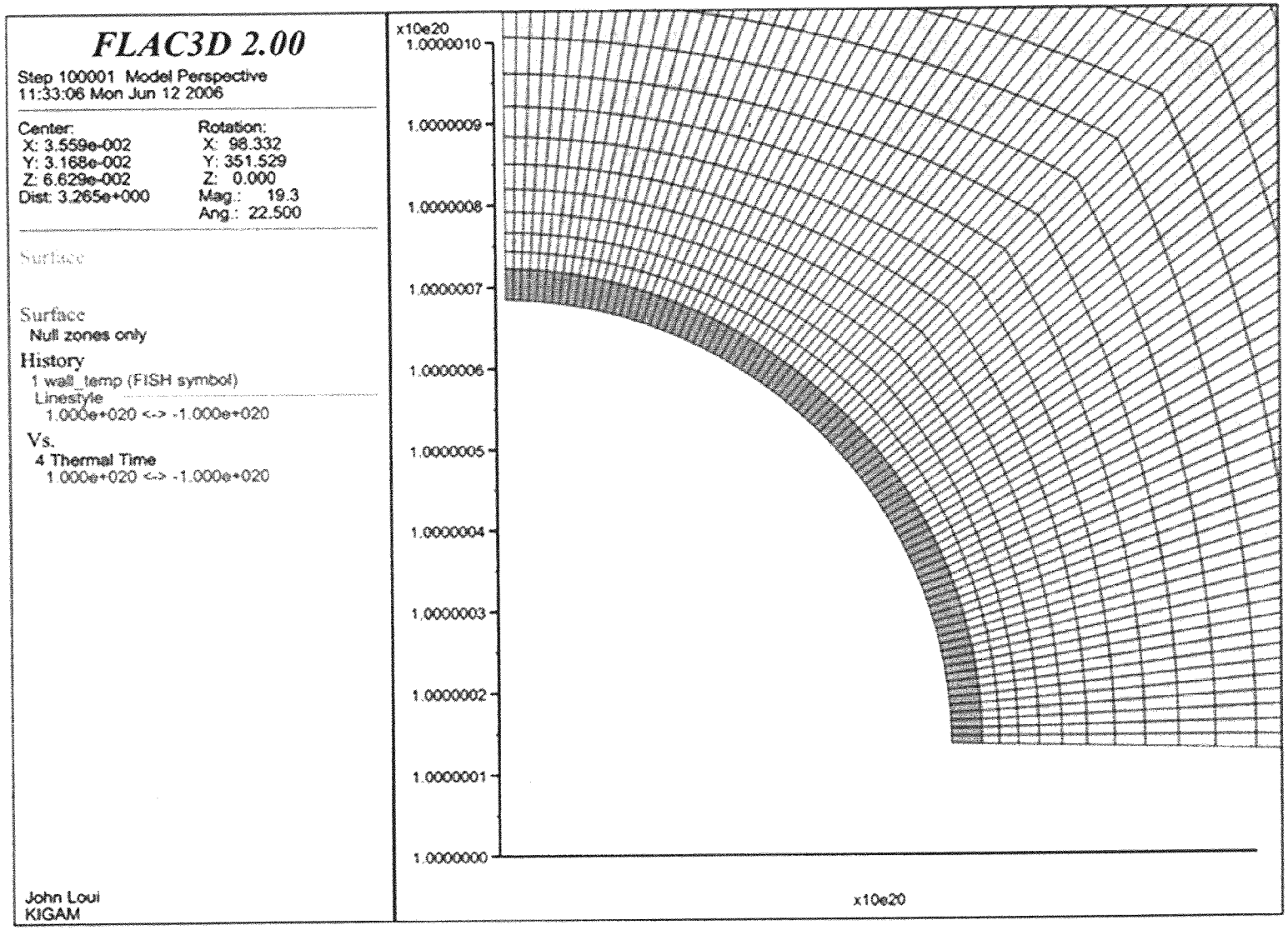

【Figure 10B】
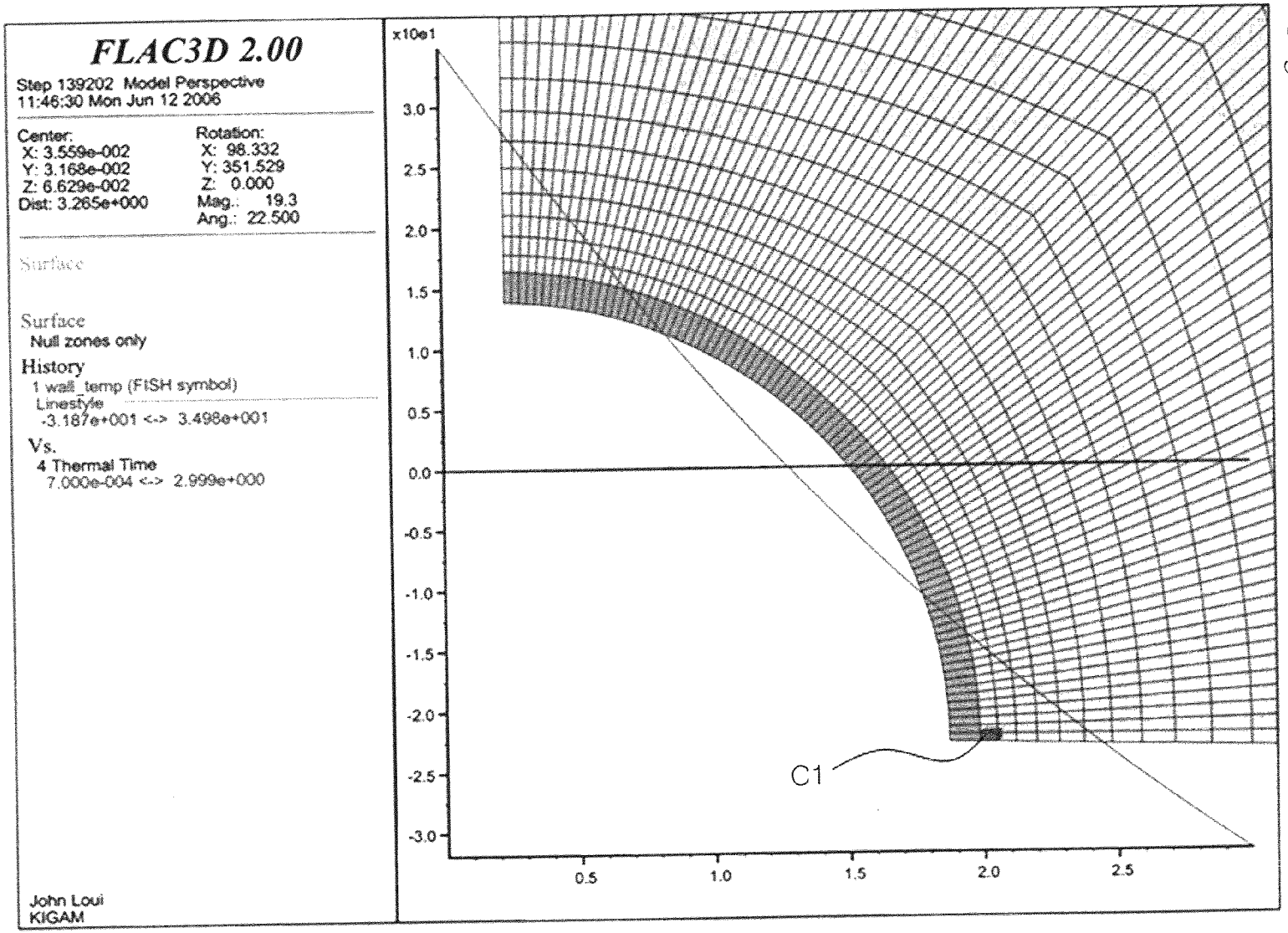

【Figure 10C】
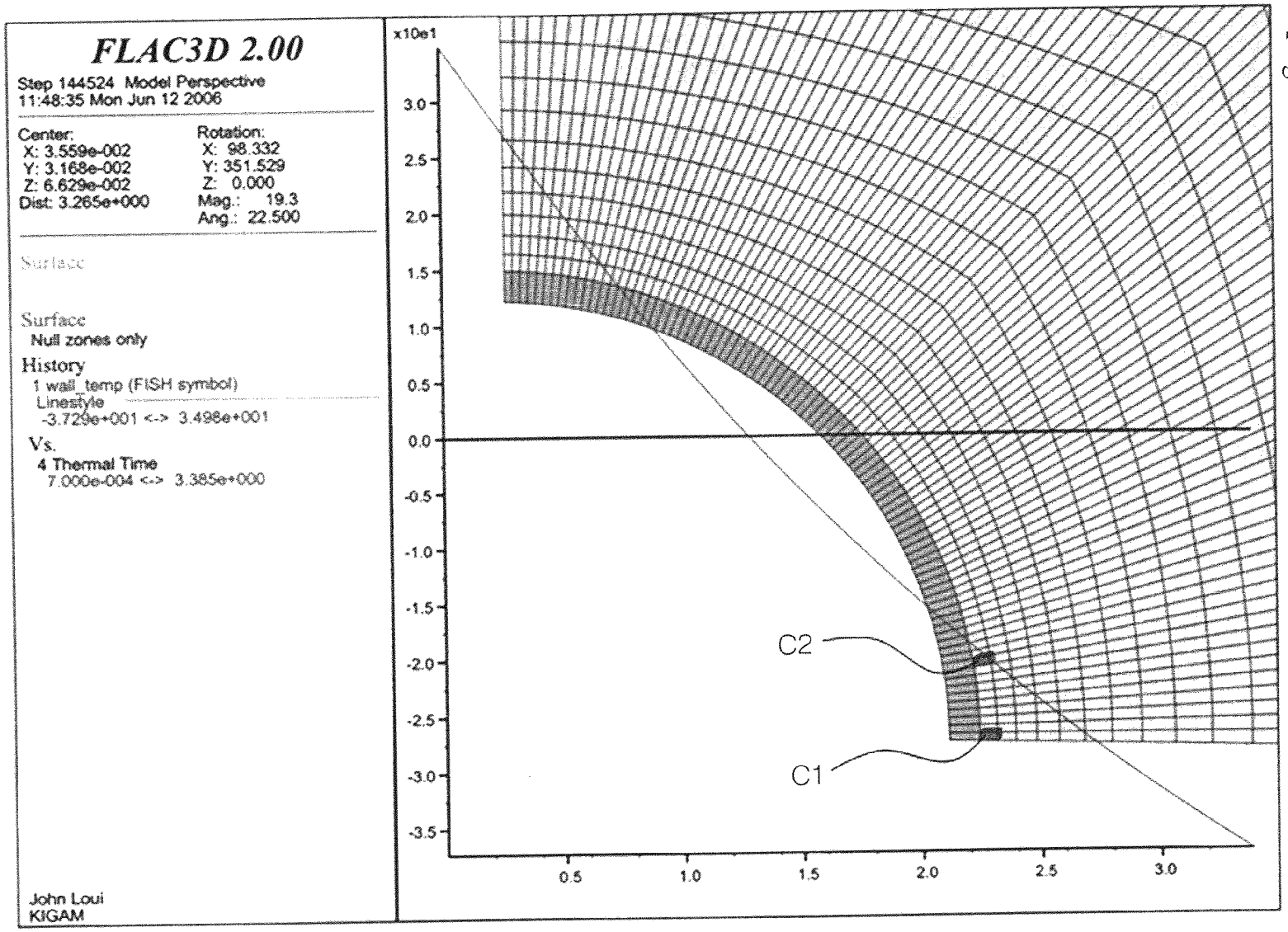

【Figure 10D】
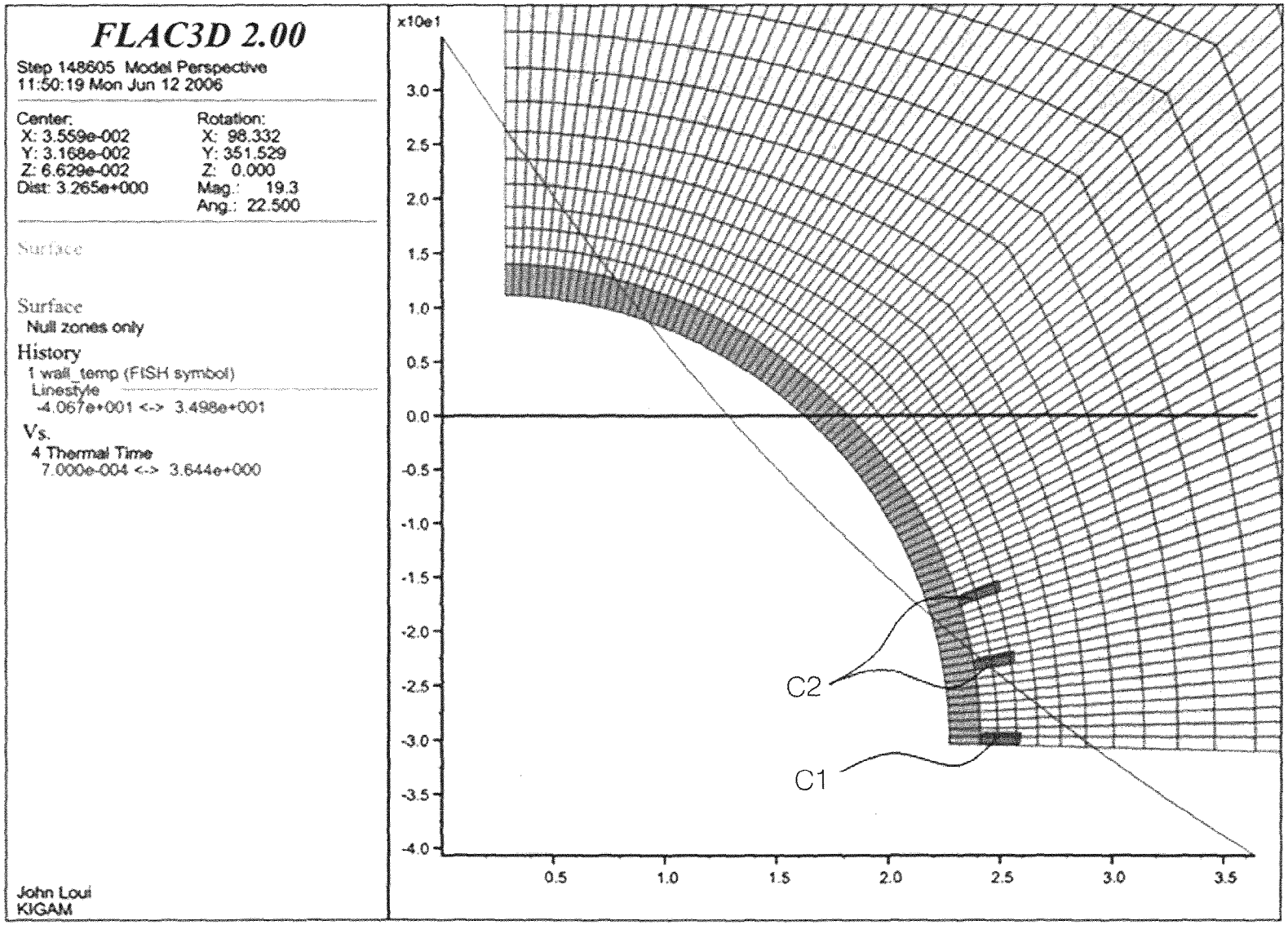

【Figure 10E】
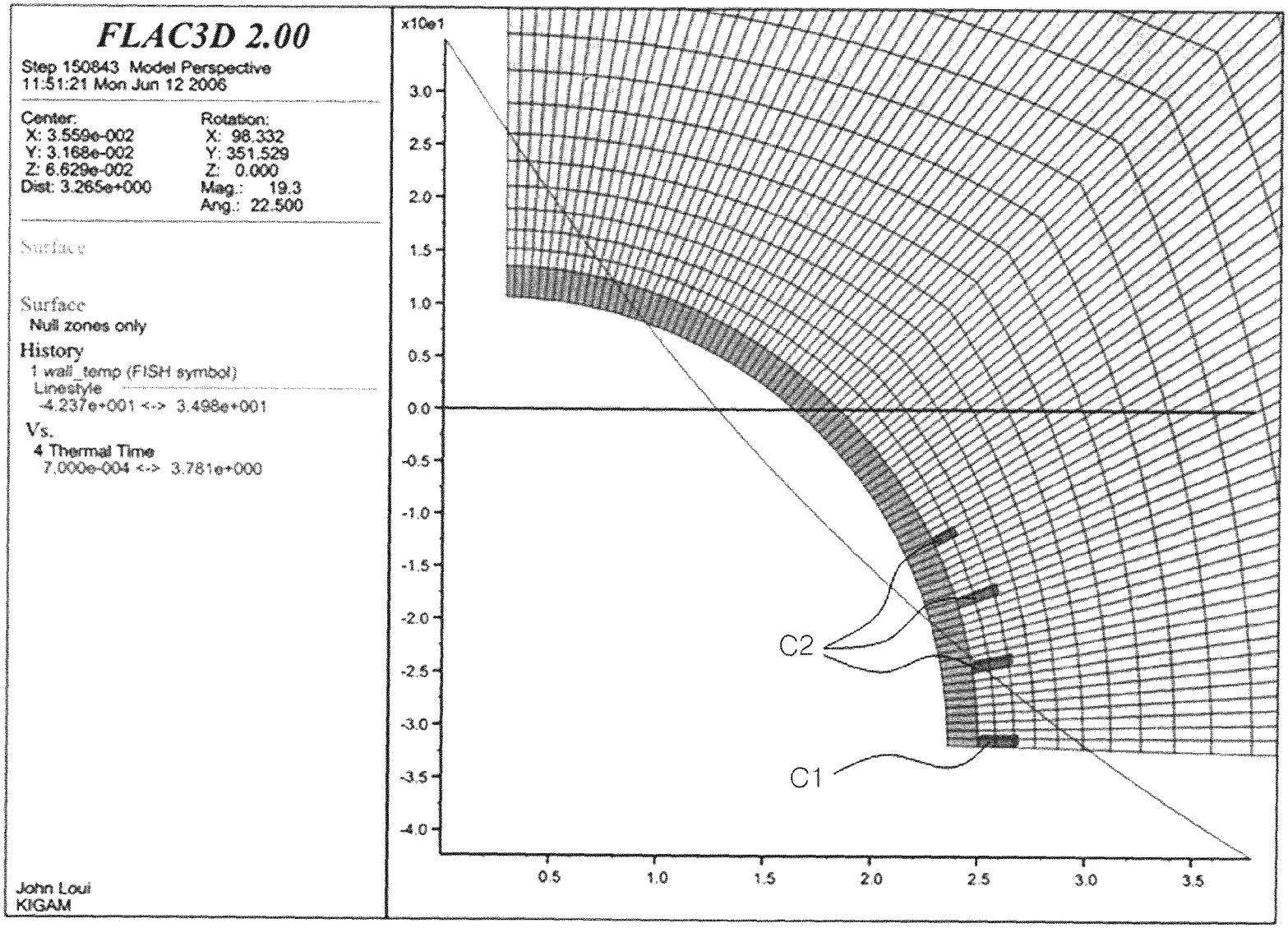

【Figure 10F】
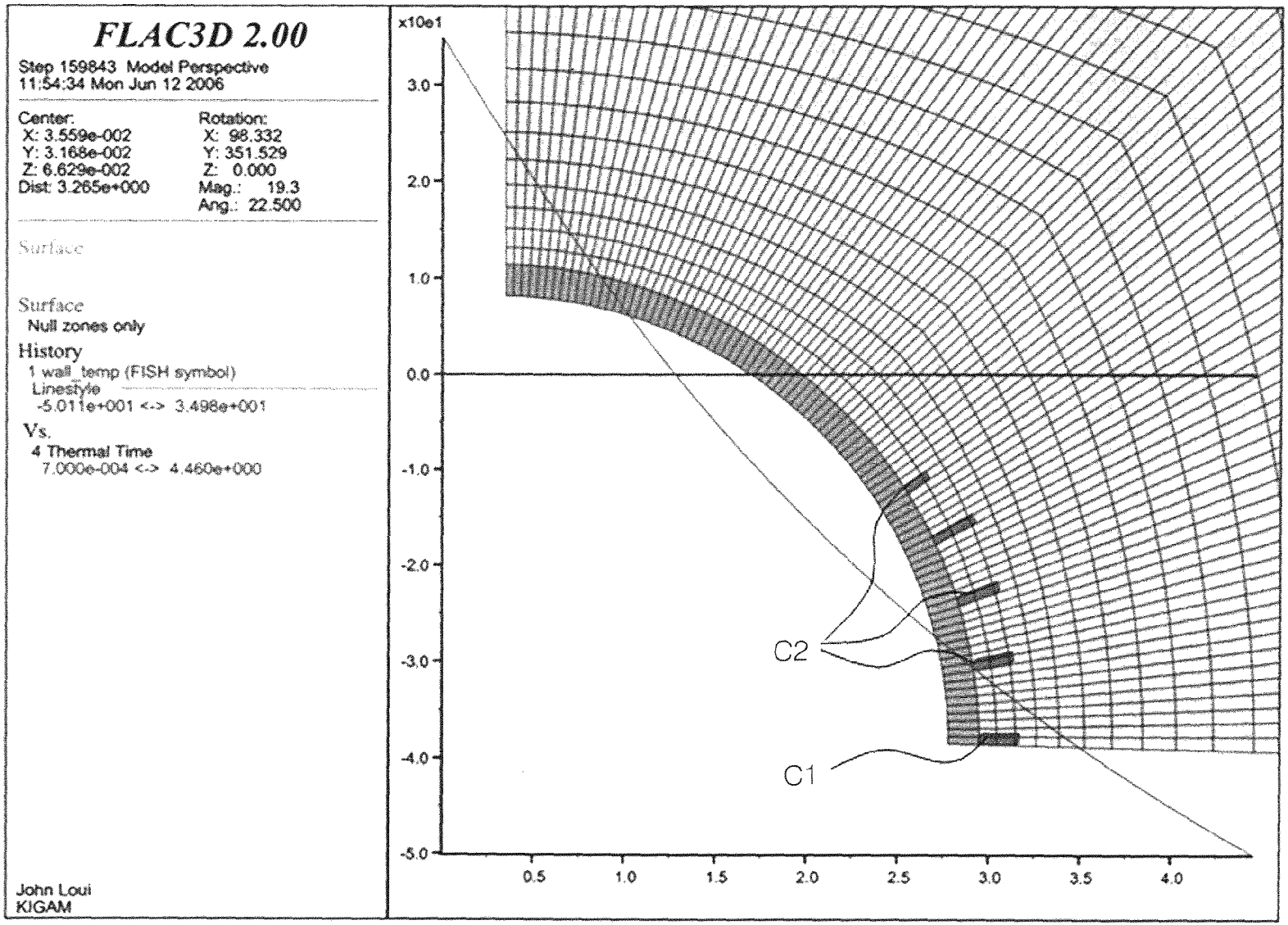

【Figure 10G】
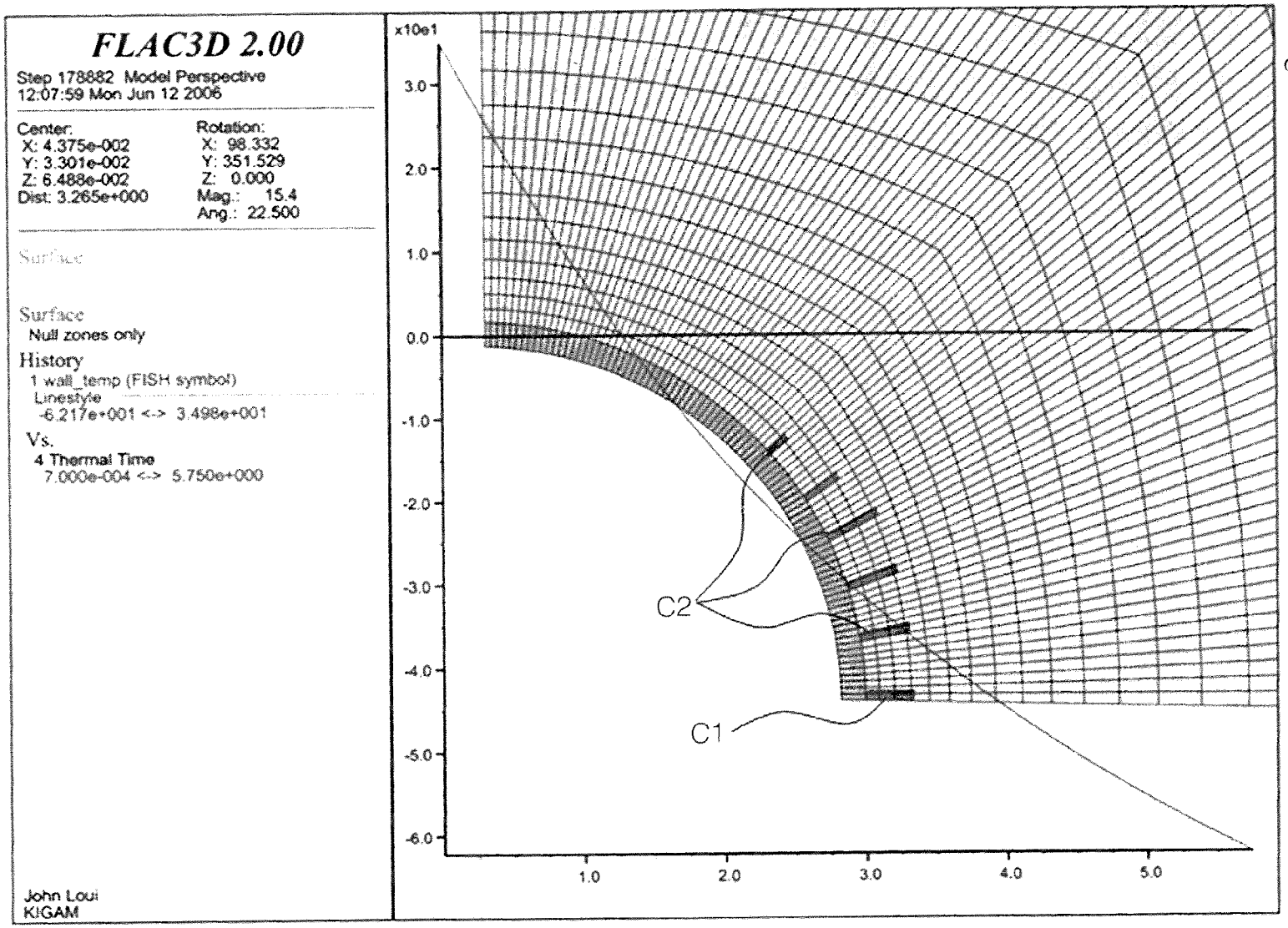

【Figure 10H】
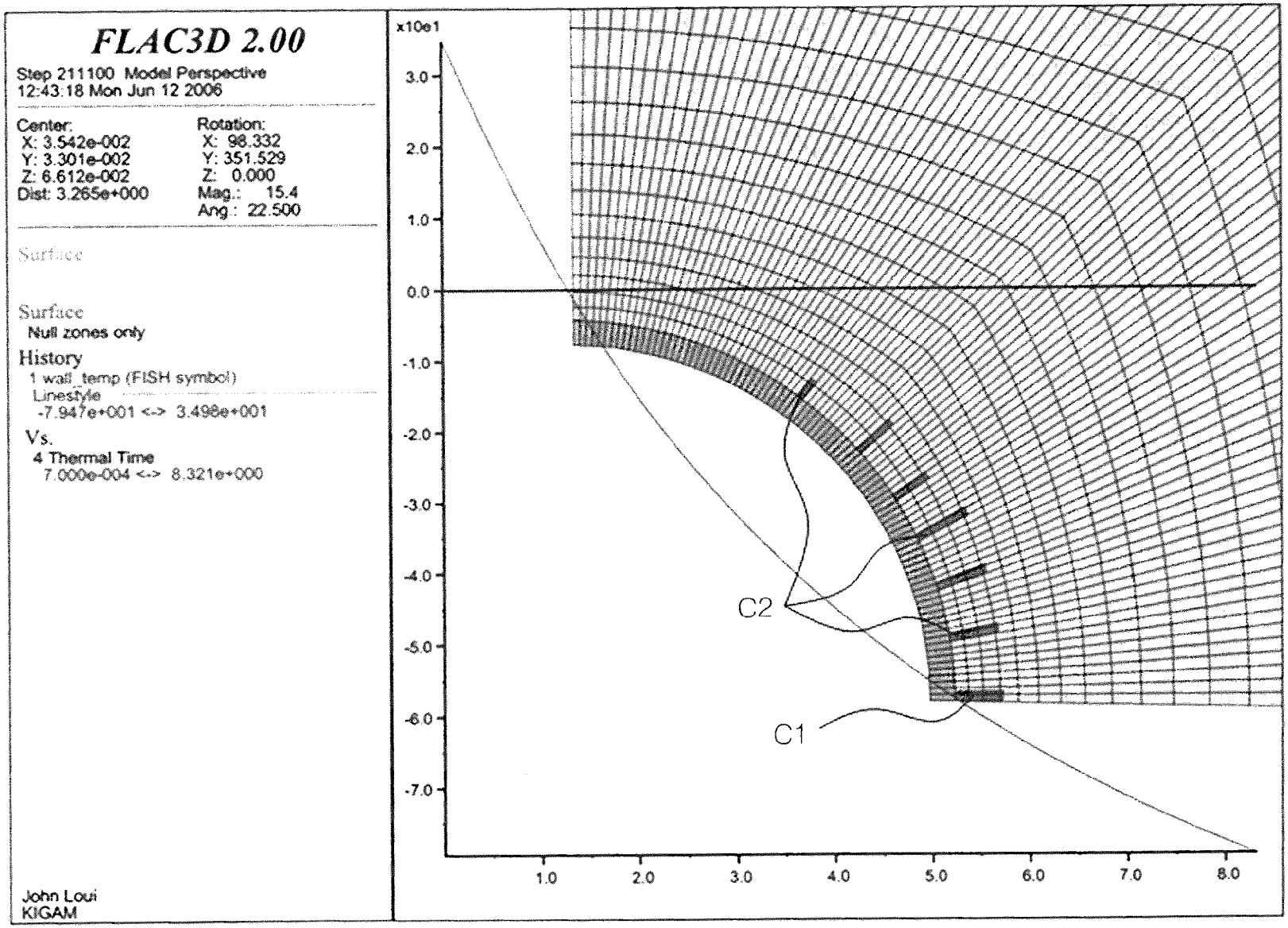

【Figure 11】
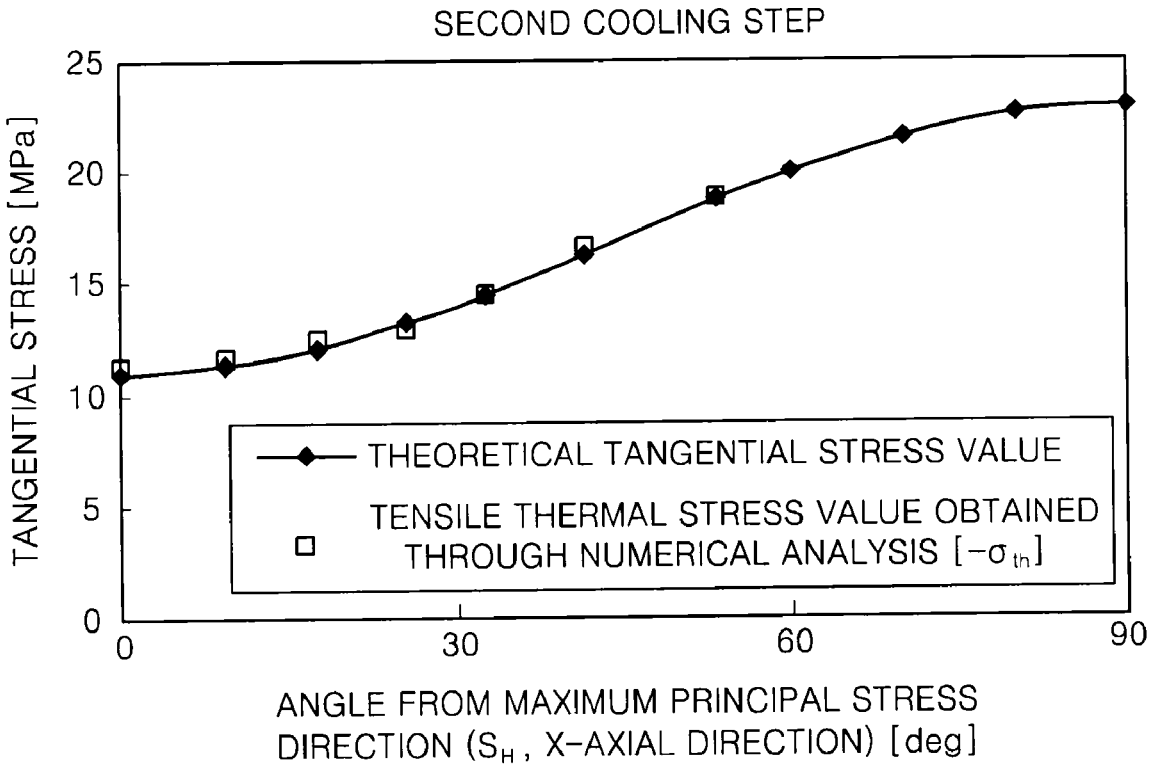

【Figure 12A】
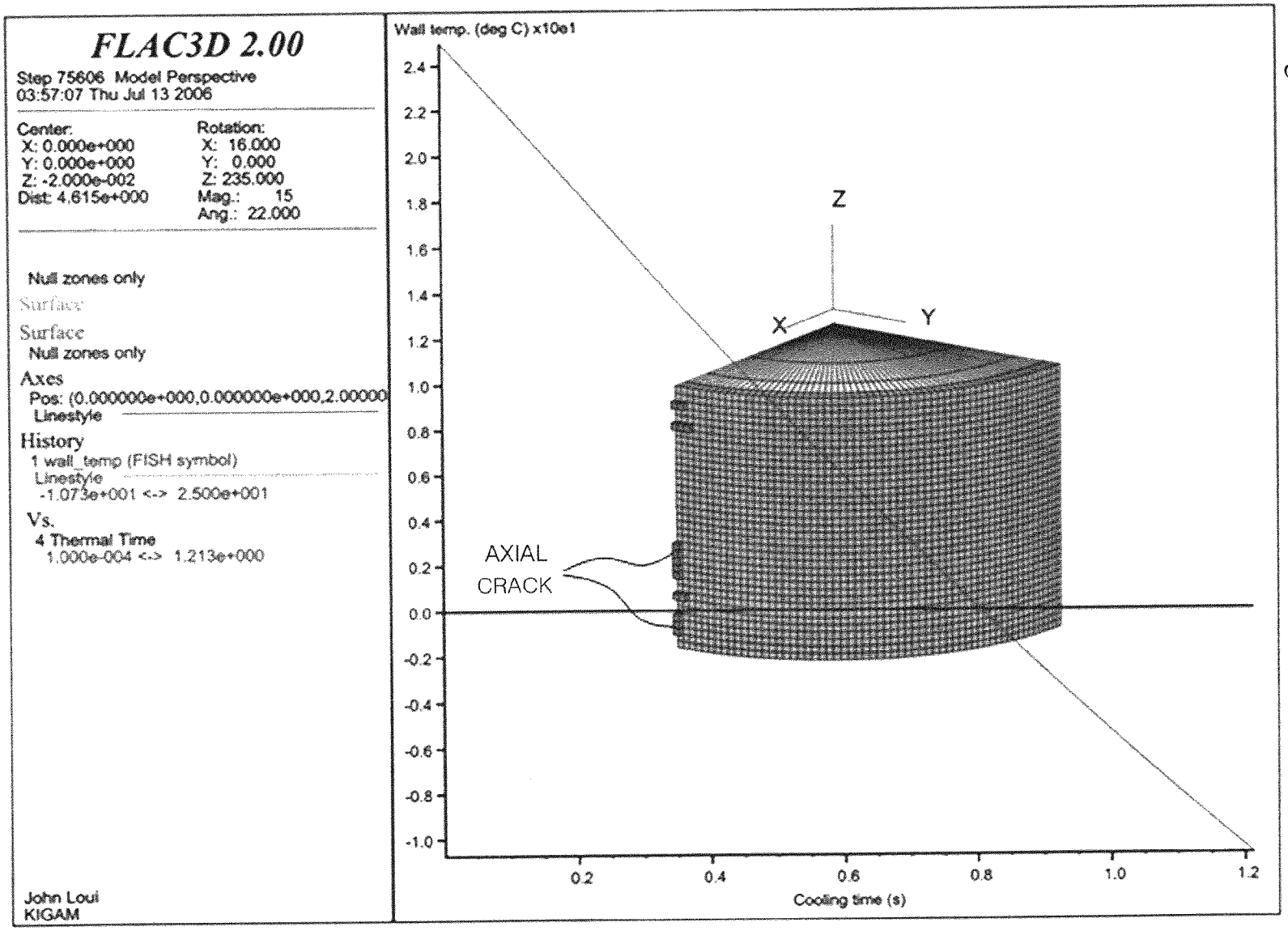

【Figure 12B】
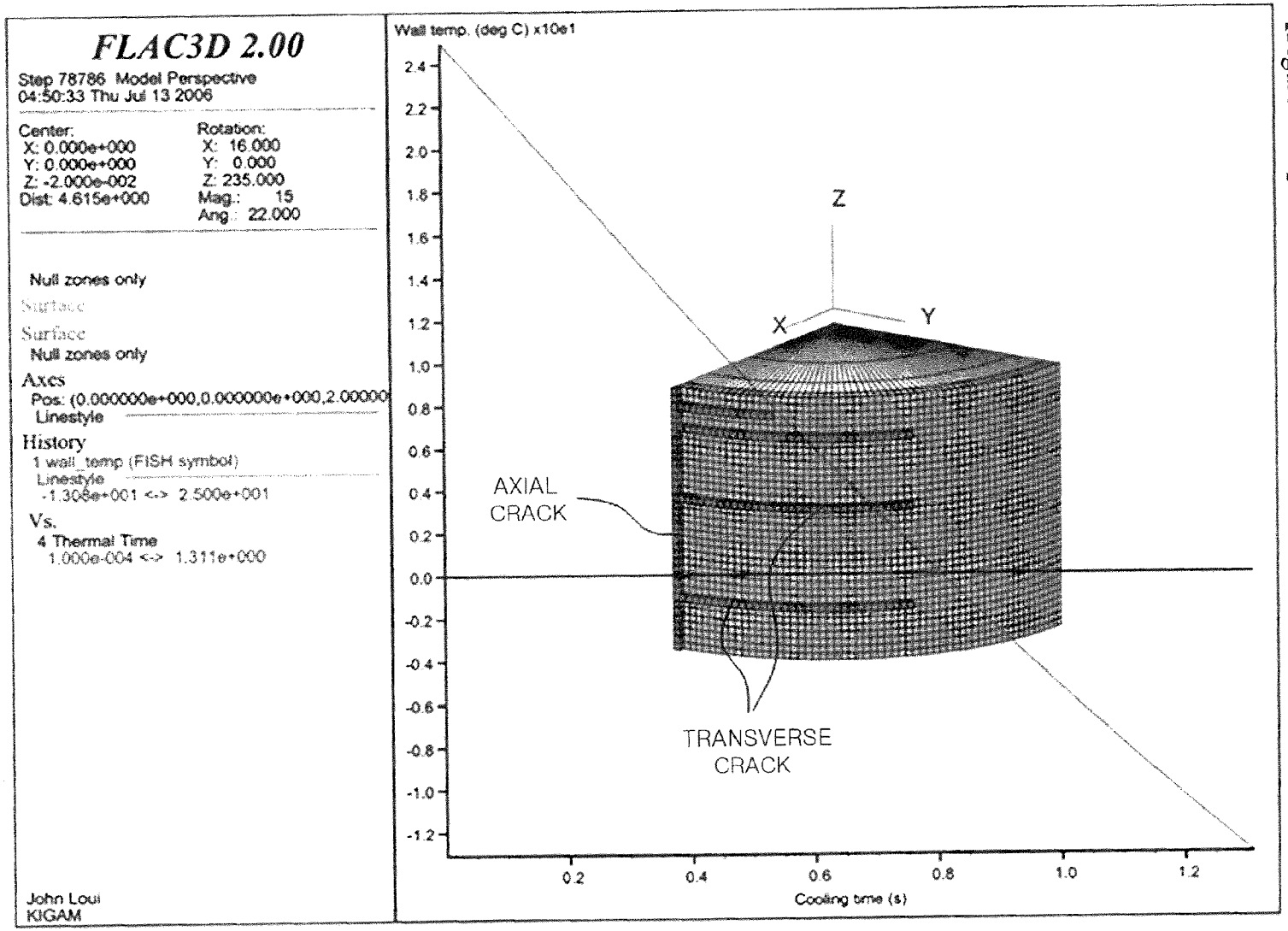

【Figure 12C】
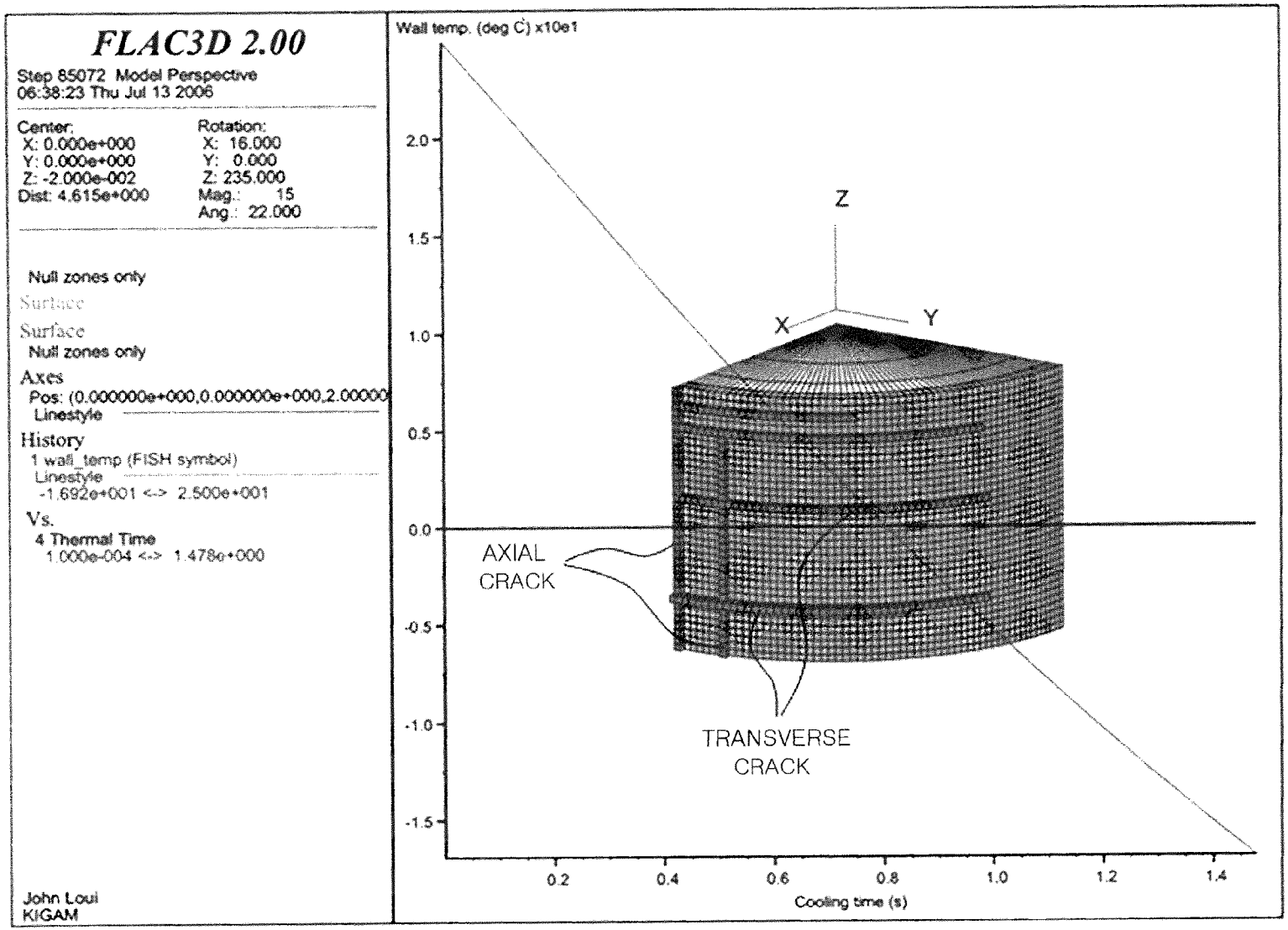

【Figure 12D】
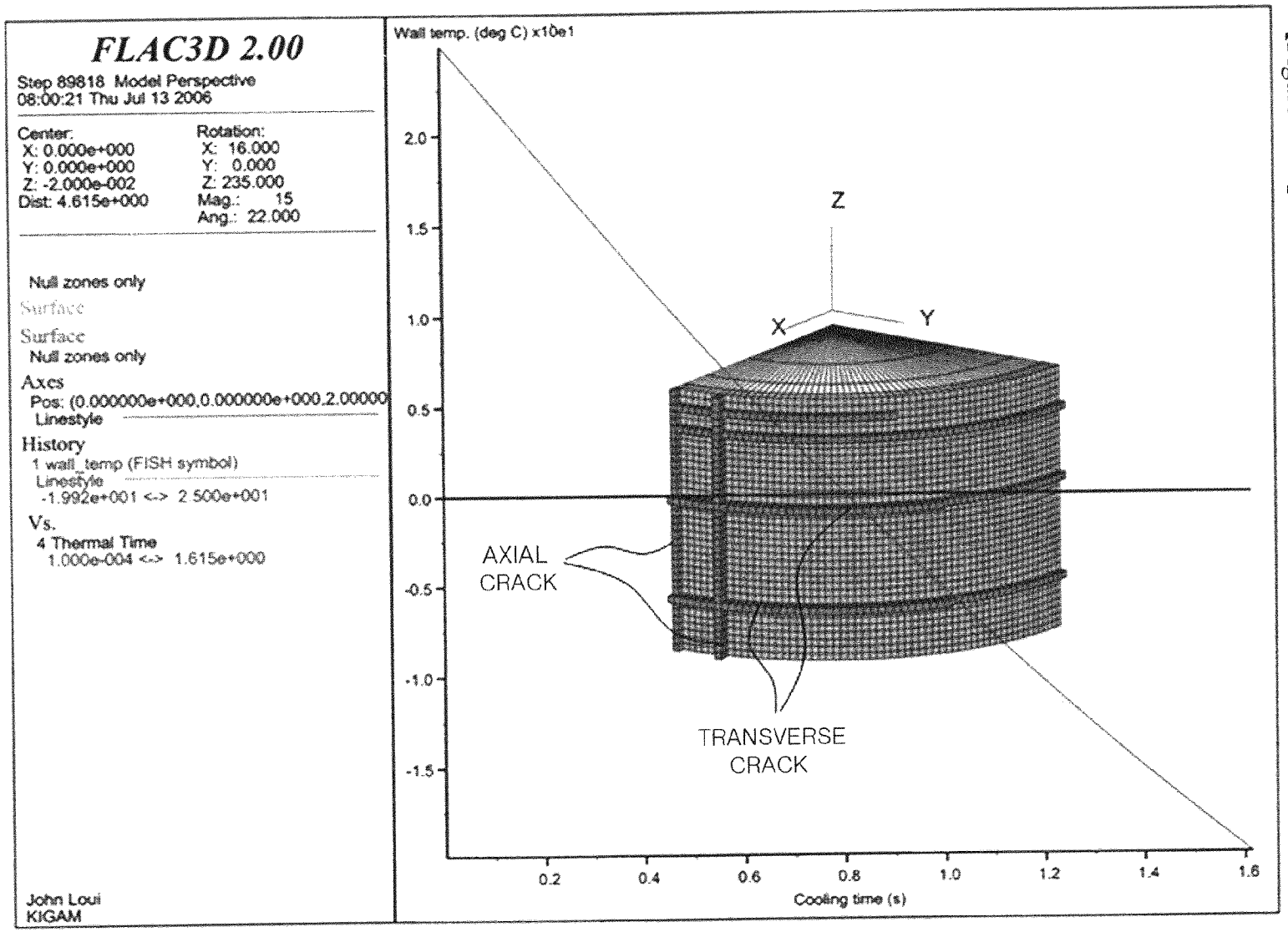

【Figure 12E】
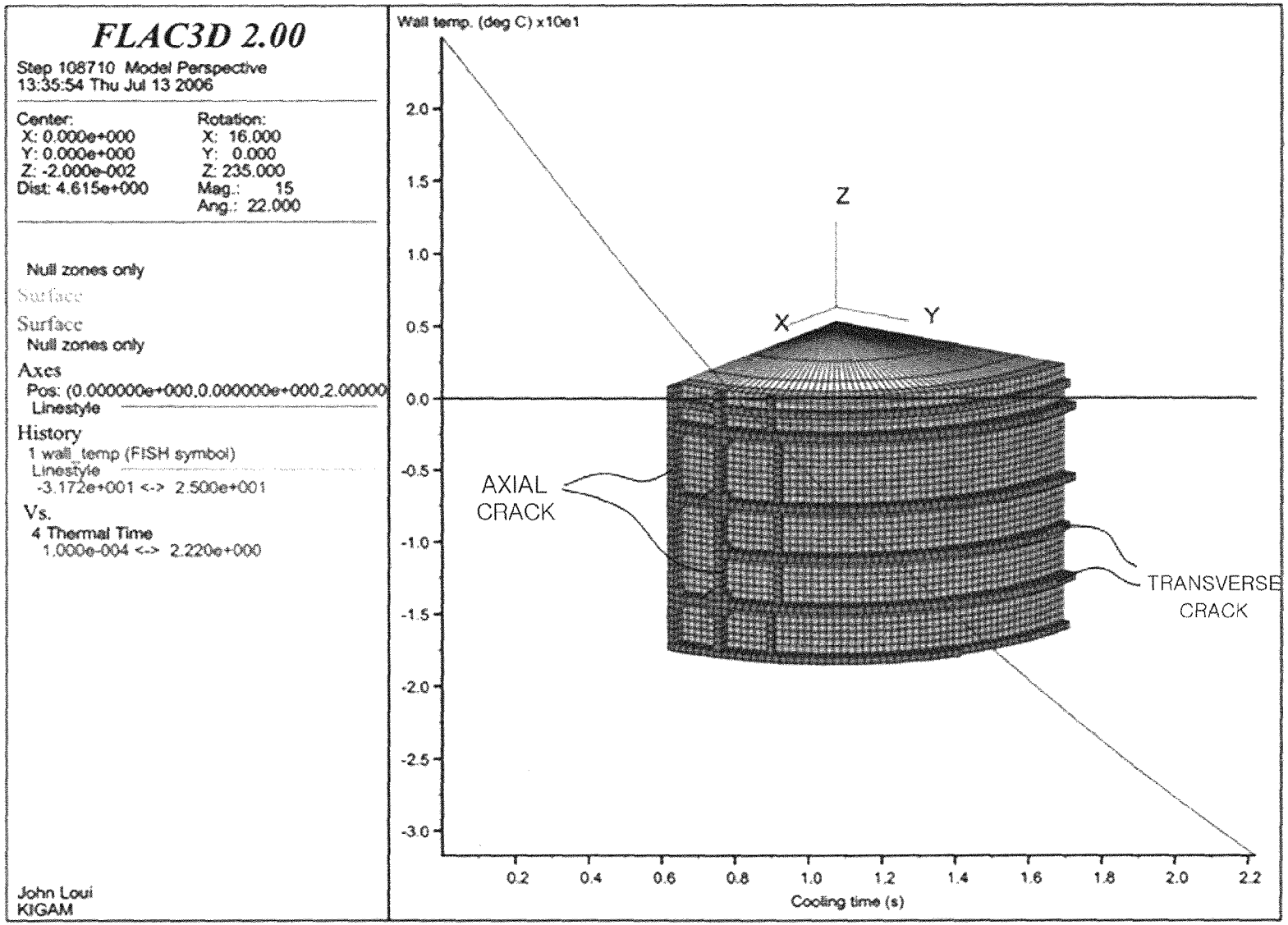

【Figure 12F】
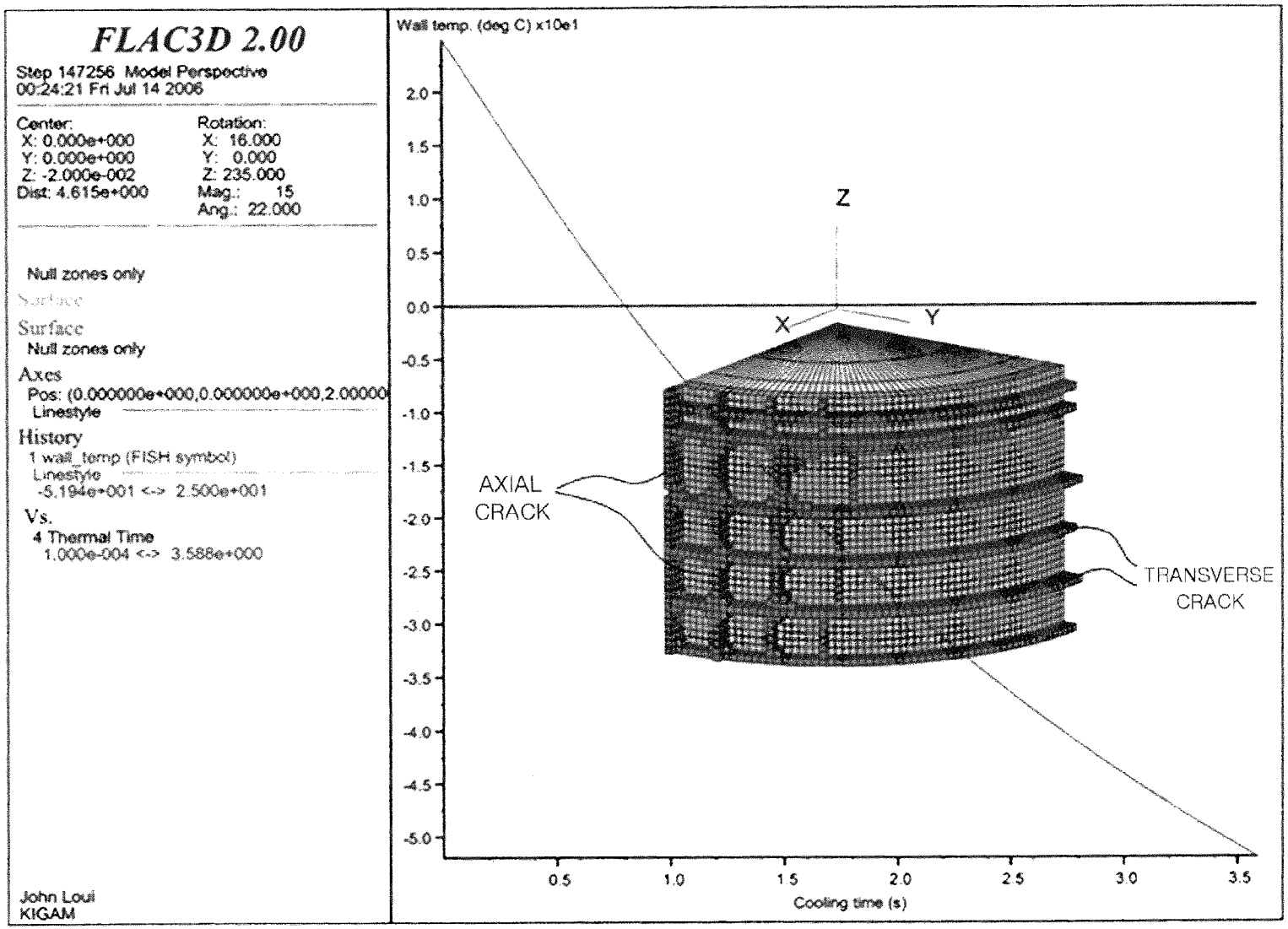

【Figure 12G】
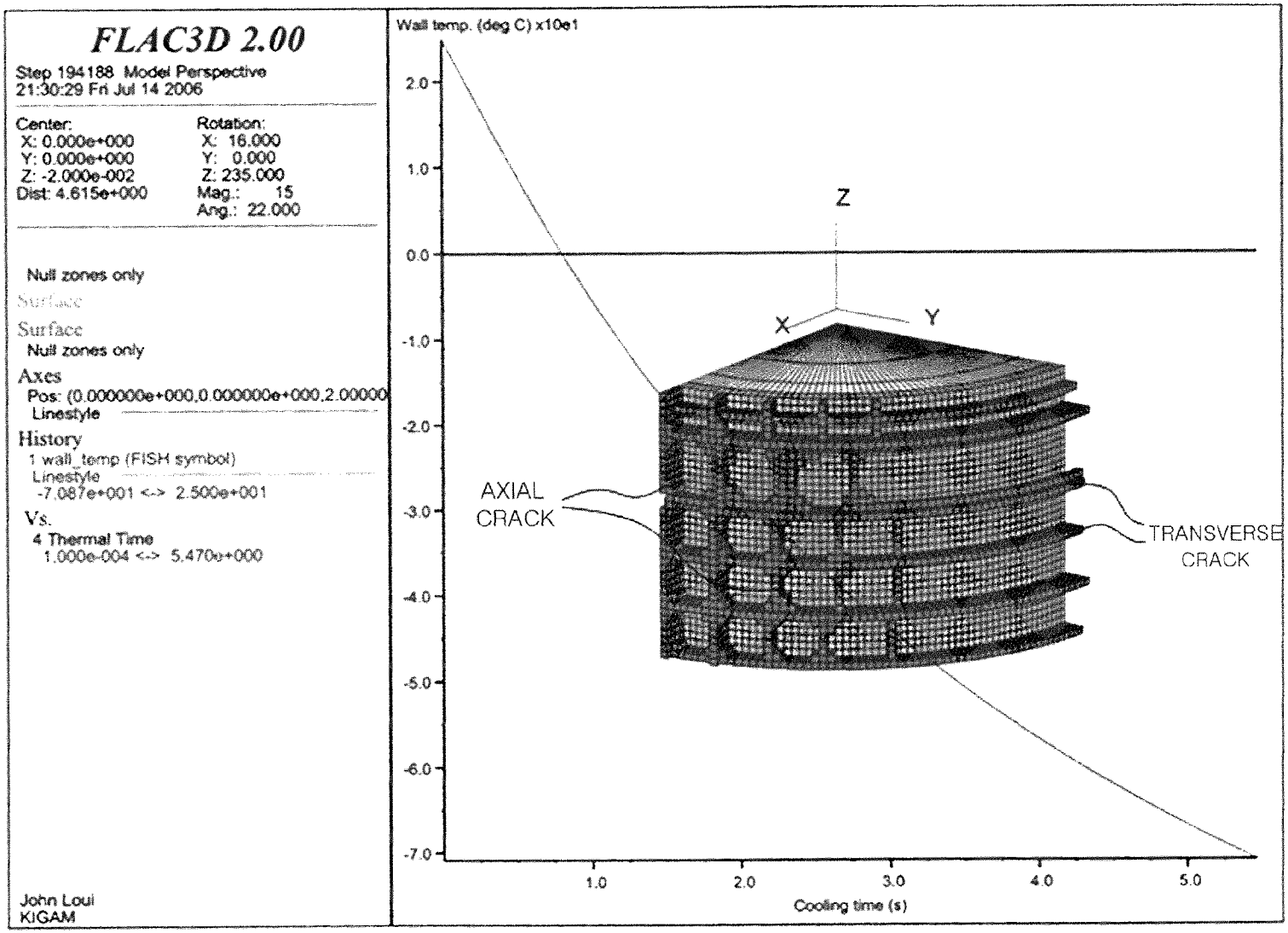

【Figure 12H】
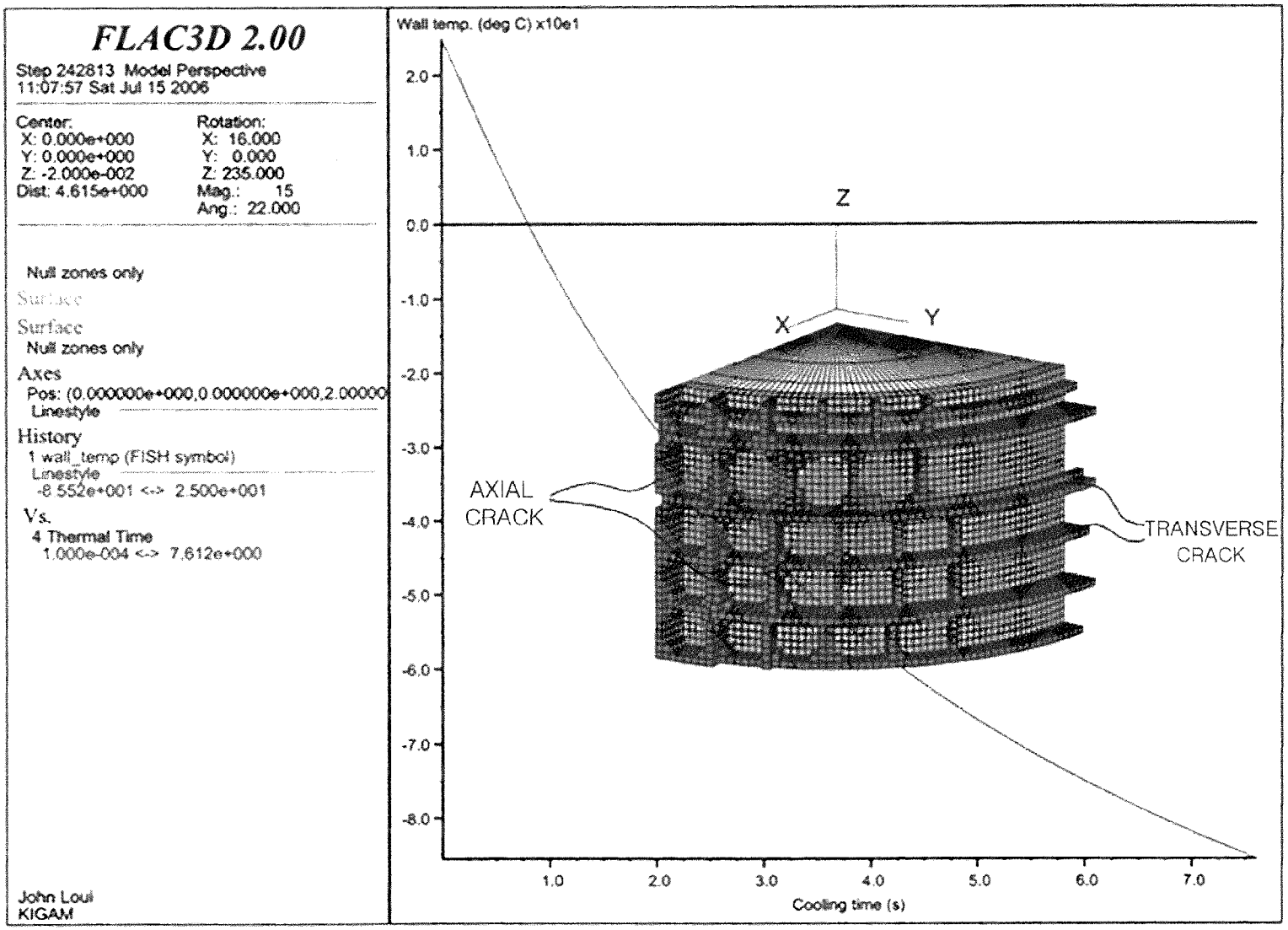

【Figure 13】
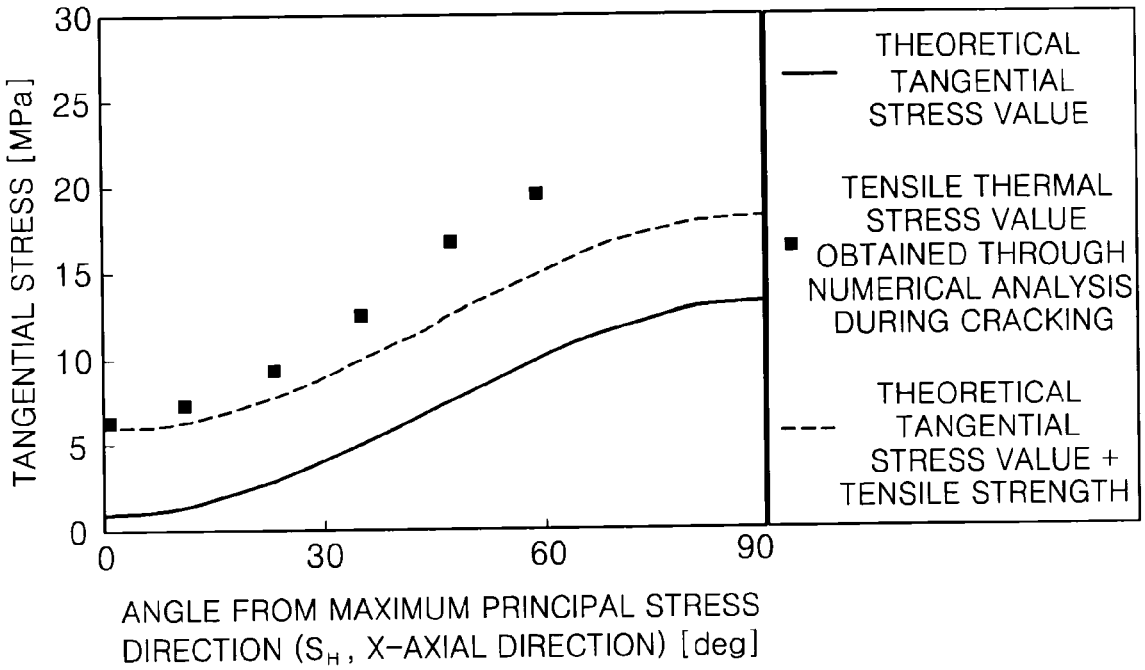

【Figure 14A】
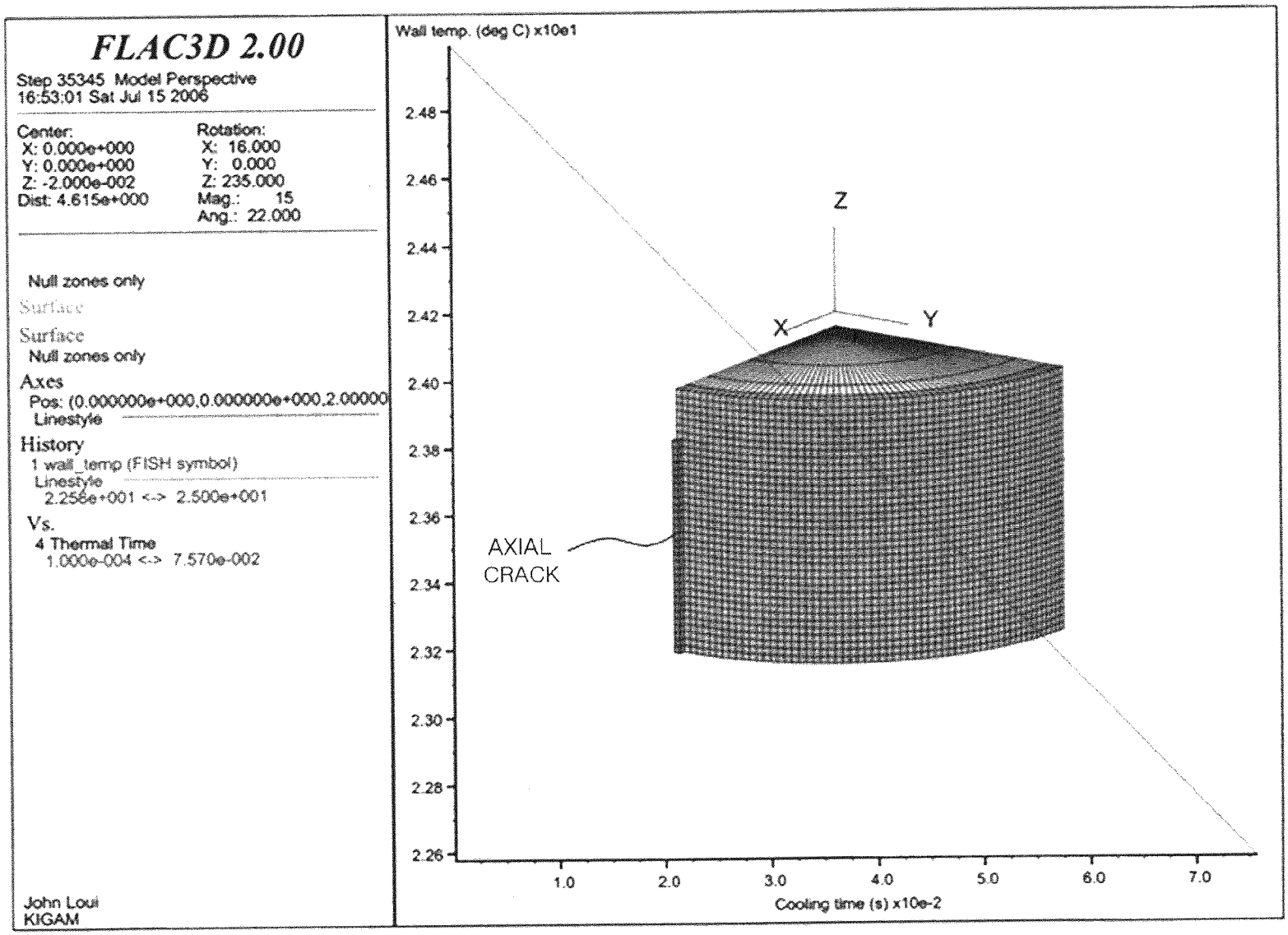

【Figure 14B】
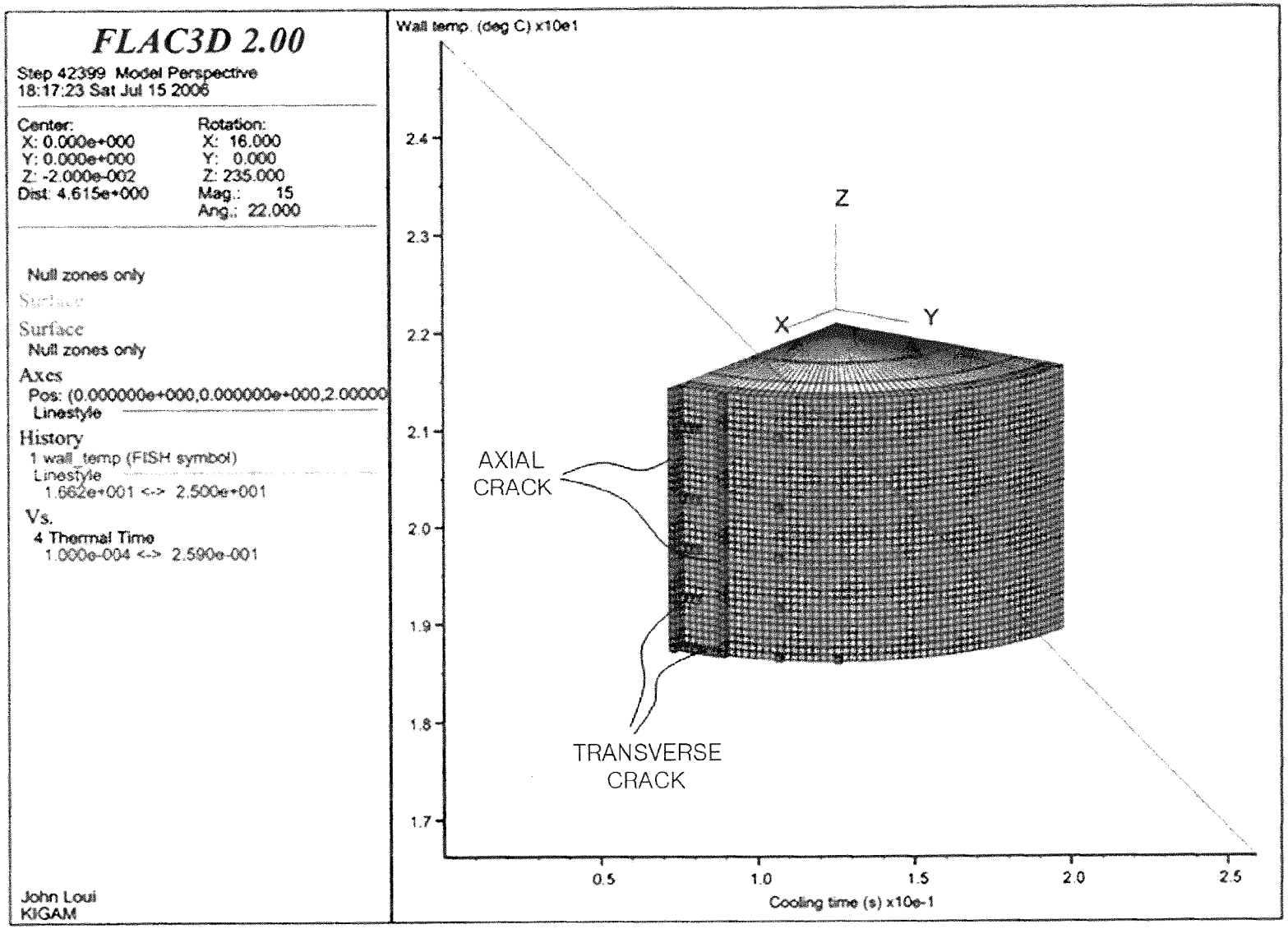

【Figure 14C】
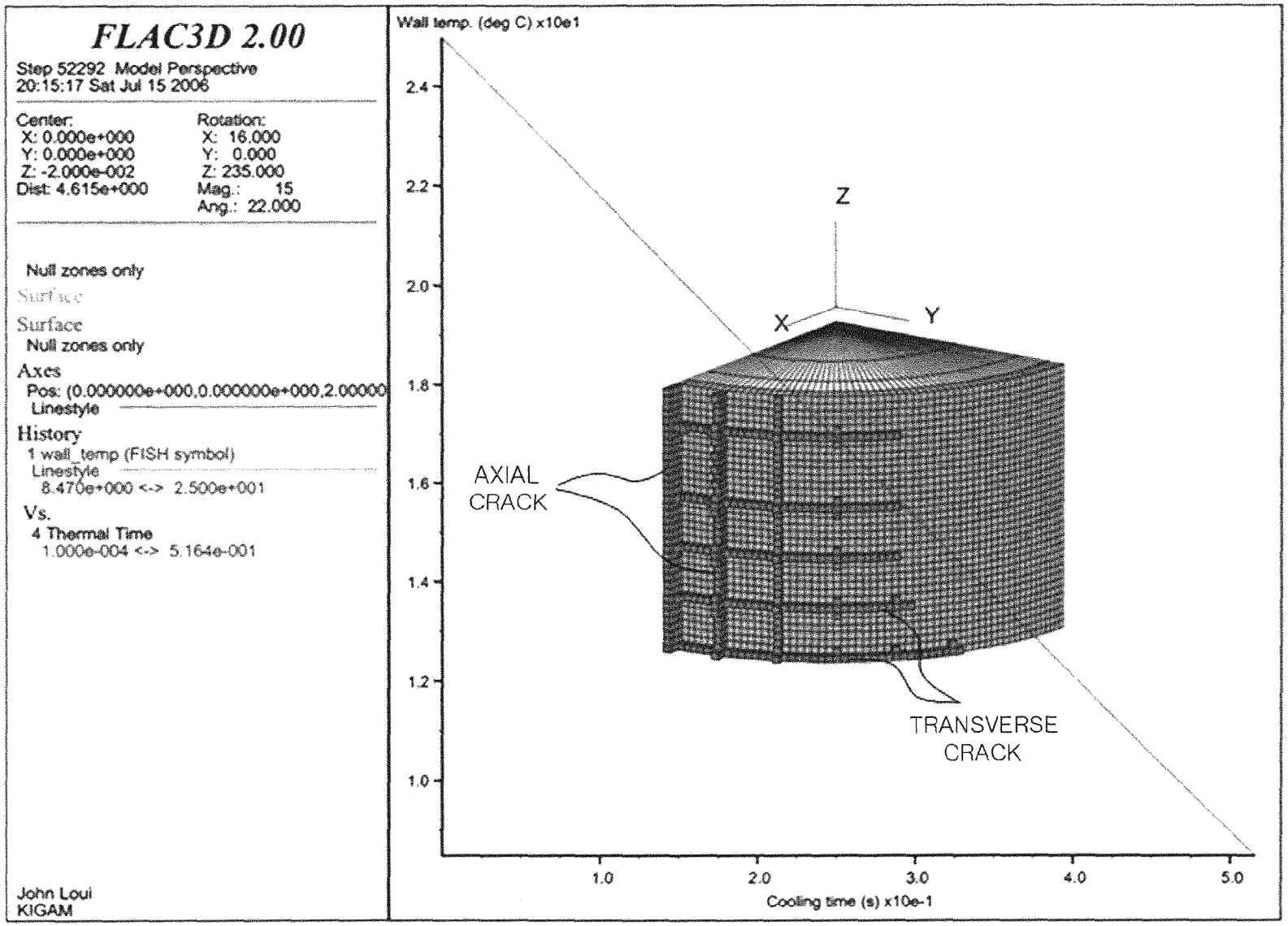

【Figure 14D】
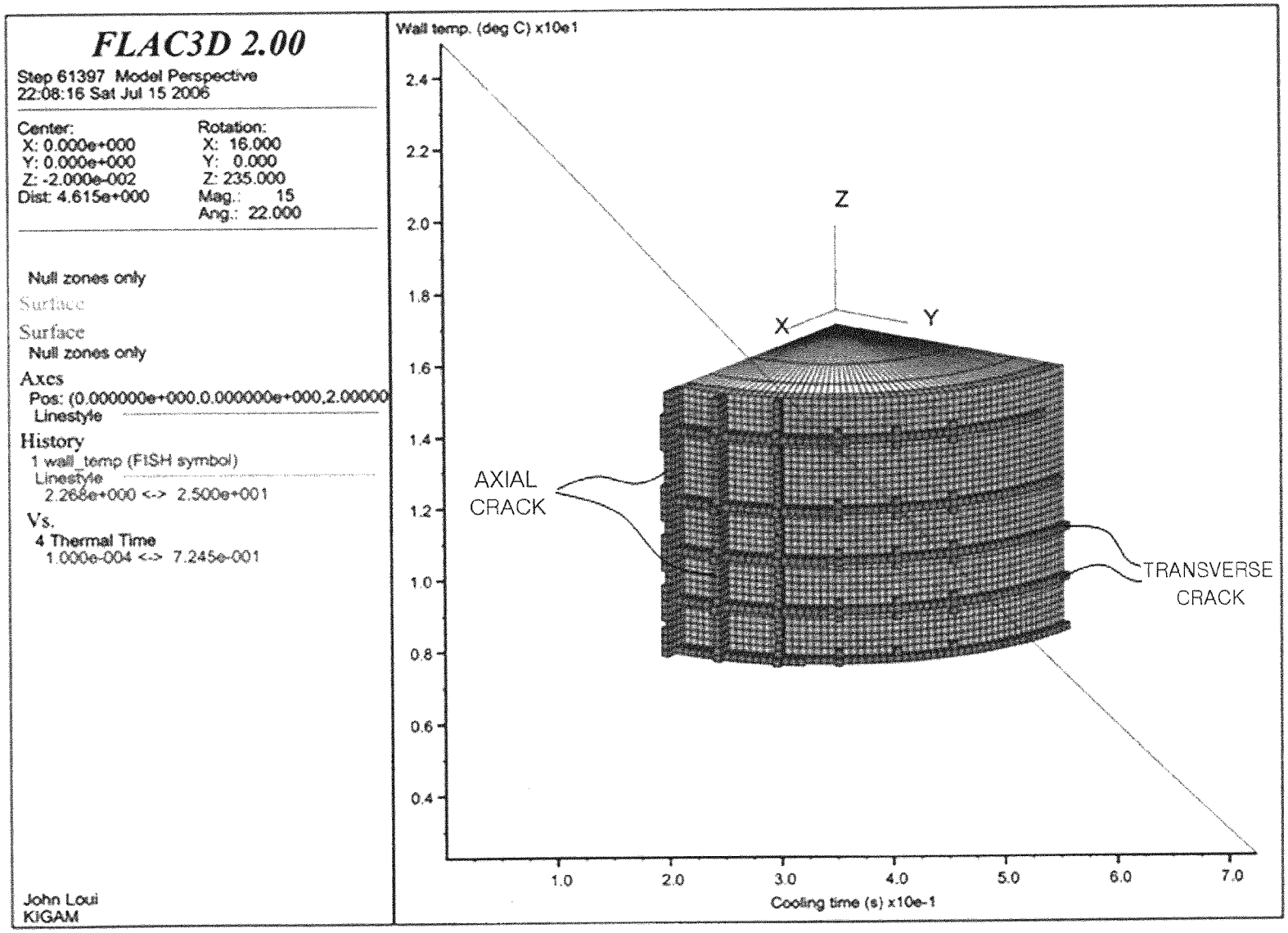

【Figure 14E】
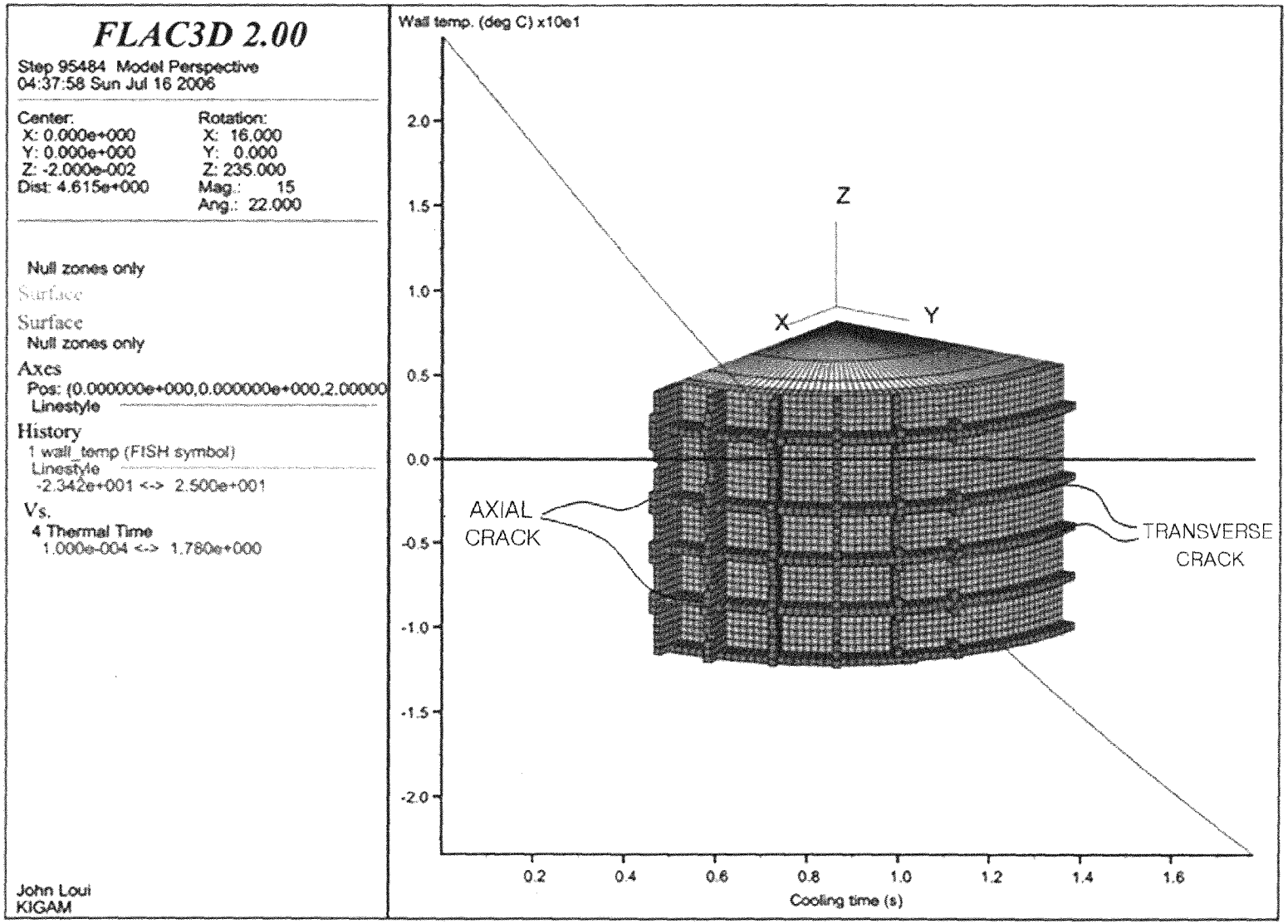

【Figure 14F】
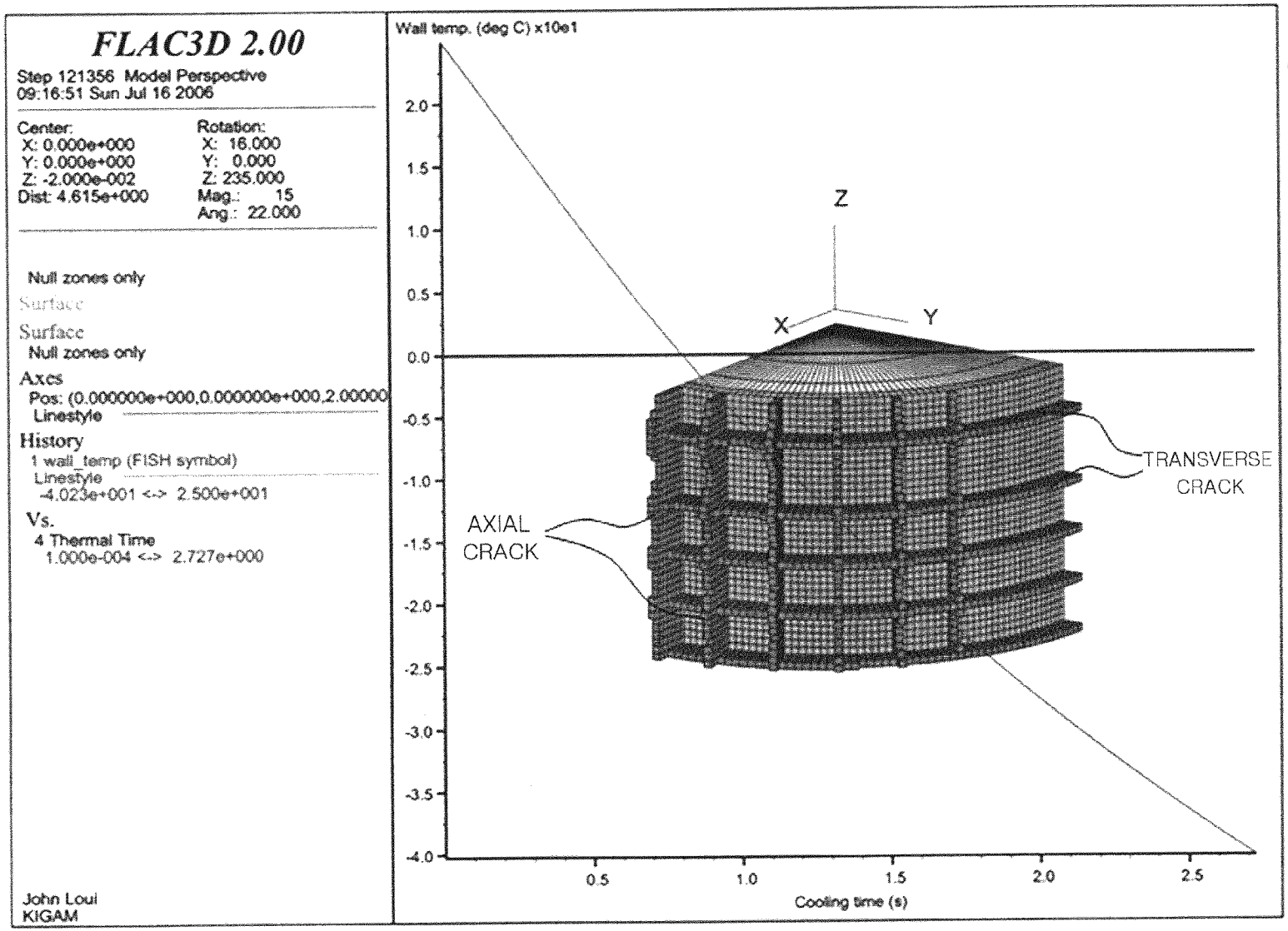

【Figure 15】
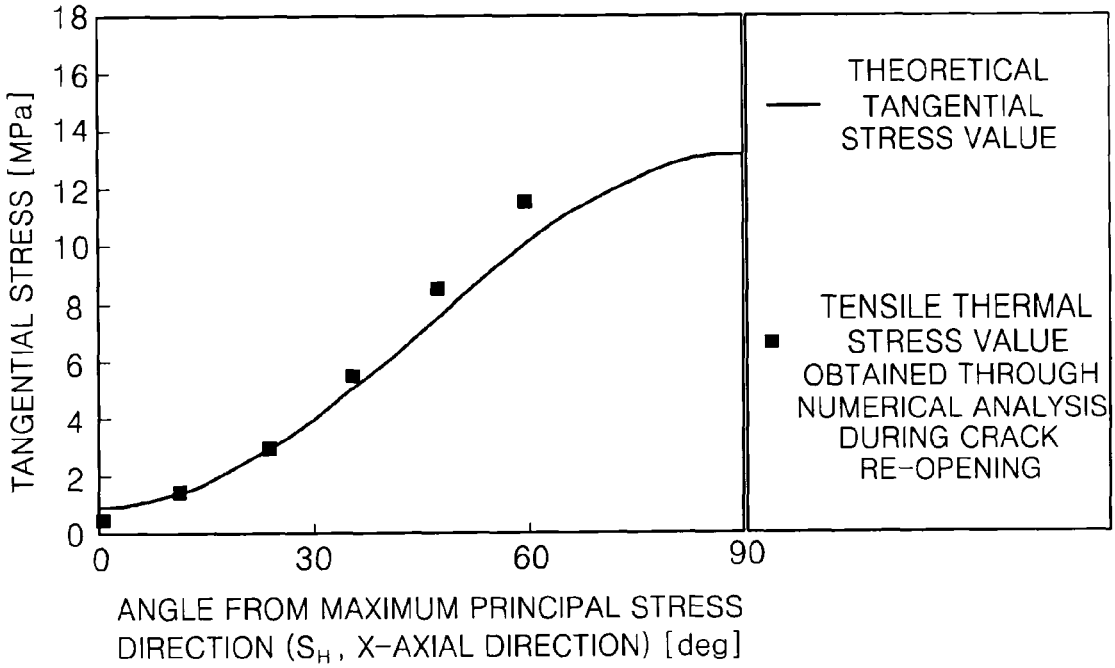

METHOD AND APPARATUS FOR MEASURING IN-SITU STRESS OF ROCK USING THERMAL CRACK

TECHNICAL FIELD

The present invention relates to a method and apparatus for measuring in-situ stress in rock, and more particularly, to a method and apparatus for measuring in-situ stress in rock, in which the in-situ stress in rock is measured by applying heat to the rock using a cryogenic coolant to thereby generate cracks.

BACKGROUND ART

The term "in-situ stress in rock" refers to stress that exist in the interior of rock, including gravitational stress, tectonic stress, and residual stress. Here, gravitational stress indicates stress generated by the rock's own weight. Tectonic stress indicates stress generated by movement of the earth's crust. Residual stress indicates stress remaining after removal of its original cause, such as expansion or heating of the rock or a past surface load since removed by surface erosion.

In the design or safety analysis of a large-scale structure in rock such as a tunnel or an oil storage tank, calculation of in-situ stress in the rock is proving to be very important. This is because no underground structure can be designed and constructed in a stable and economical manner inside rock until the direction and magnitude of stresses acting on the rock have been accurately measured. For example, in tunnel construction, if pressure applied to surrounding rock is isotropic, the tunnel cross section is generally circular. On condition that there is strong transverse pressure on the rock such as by a surface load, though the tunnel cross section is elliptical, the tunnel keep safe from collapse.

For instance, when excavating a tunnel without exactly measuring the in-situ stress in the rock, the rock may become overstressed due to stress concentration on an excavated surface and may collapse or become unstable due to expansion of existing cracks. Thus, in order to install a structure in rock, an accurate measurement of in-situ stress in rock is required.

Methods for measuring in-situ stress in rock include hydraulic fracturing (Fairhurst, 1964), stress opening such as overcoring (Leeman and Hayes, 1966; Merrill, 1967; U.S. Pat. No. 4,491,022), an indirect method such as acoustic emission and so forth.

Among these methods, hydraulic fracturing and overcoring are frequently used. A conventional hydraulic fracturing system is illustrated in FIG. 1. Referring to FIG. 1, a borehole h is formed in the rock in which an underground structure will be constructed, and then packers 1 are installed at upper and lower ends of a test section a, thereby sealing the test section. Afterwards, a high-pressure pump (not shown) applies hydraulic pressure, thereby injecting fluid into test section a through a pipe p. When hydraulic pressure continuously increases to reach 'initial fracturing pressure', cracks are formed in a borehole wall w. When fluid is continuously injected, the cracks are gradually widened and pressure is lowered. When the injection is stopped, the cracks are closed and the pressure reaches 'crack closing pressure'. Here, since the crack closure pressure is equal to or slightly greater than the pressure required to maintain the cracks, it represents the minimum principal stress, which acts in a direction perpendicular to the cracked surface. Further, while the above-mentioned processes are repeated (second cycle), the cracks are re-opened (crack re-opening pressure). Thus, after crack re-opening pressure is measured, the maximum horizontal principal stress can be calculated using the measured pressure.

Among the methods for measuring in-situ stress in rock, hydraulic fracturing has an advantage in that it can be applied to deep underground rock as long as the borehole can be drilled, but has a disadvantage in that it is not easily applied to specific types of rock, for instance, sedimentary rock with a stratified structure. Further, when pressure is applied using packers 1, the borehole may collapse or the packers may jam. This complicates withdrawal of equipment, especially at greater depths. Further, since the size of the equipment must be increased in order to apply high hydraulic pressure, there are difficulties in using the conventional hydraulic fracturing system.

As described above, hydraulic fracturing has a limitation in that only two parts of principal stress can be measured. In other words, hydraulic fracturing has a limitation in that, since the vertical stress is set to the surface load (density*mass*height), the maximum and minimum principal stress can be measured in only a horizontal direction, and thus in-situ stress cannot be accurately measured. Furthermore, many researchers who have extensively studied hydraulic fracturing cast a doubt on the accuracy of crack re-opening pressure as well as the variation in pore hydraulic pressure in cracks (Ito et al., 2001).

Unlike hydraulic fracturing, overcoring has an advantage in that six stress components existing on three dimensions can be provided. However, since overcoring is based on the measurement of strain, it requires elaborate dual coring work. Hence, when applied, overcoring is problematic in that it is highly complex as well as restricted to the depth of the borehole.

DISCLOSURE

Technical Problem

Accordingly, the present invention has been made in an effort to solve the problems occurring in the related art, and an object of the present invention is to provide a method for measuring in-situ stress in rock, which can be applied to rock at a great depth to measure in-situ stress by directly forming cracks in rock by means of heat, thereby enabling precise and easy measurement without elaborate equipment.

Another object of the present invention is to provide an apparatus for measuring in-situ stress in rock, which can be applied to rock at a great depth to measure in-situ stress by directly forming cracks in rock by means of heat, thereby enabling precise and easy measurement without elaborate equipment.

Technical Solution

In order to achieve the above object, according to one aspect of the present invention, there is provided a method for measuring in-situ stress in rock using a thermal crack, which comprises: a borehole forming step of forming a borehole in the target rock for measuring the in-situ stress; a first cooling step of cooling a wall of the borehole, applying tensile thermal stress to the borehole wall, forming and growing the crack in the borehole wall, and measuring a first cracking temperature of the borehole wall when the crack occurs and a cracking point at which the crack is formed; a heating step of heating the borehole wall cooled in the first cooling step and closing the formed crack; a second cooling step of cooling the borehole wall again, applying tensile terminal stress to the borehole wall, re-opening the crack closed in the heating step, and measuring a second cracking temperature of the borehole wall when the crack is re-opened; and a calculating step of calculating the in-situ stress of the rock using the first cracking temperature of the borehole wall and the cracking point measured in the first cooling step, and using the second cracking temperature of the borehole wall measured in the second cooling step.

According to another aspect of the present invention, there is provided an apparatus for measuring in-situ stress in rock using a thermal crack by drilling a borehole into the ground and forming a crack by heating the wall of the borehole. The apparatus comprises: a coolant container, in which an annular containing space where coolant can be contained, and an inlet for the coolant to flow into and out of the containing space are formed; a close-contact means for bringing an outer surface of the coolant container into close contact with the borehole wall; at least one temperature sensor which is installed on an outer surface of the coolant container so as to measure temperature of the borehole wall; and a crack detecting means for detecting cracks formed in the borehole wall by heat transmission between the coolant contained in the coolant container and the borehole wall.

ADVANTAGEOUS EFFECTS

The method for measuring in-situ stress in rock using a thermal crack according to the present invention has an advantage in that the in-situ stress in the rock, i.e., the maximum and minimum horizontal stresses as well as the vertical stress, can be precisely measured, compared to a conventional hydraulic fracturing method.

Further, the method for measuring in-situ stress in rock using a thermal crack according to the present invention has another advantage in that in-situ stress can be easily measured.

In addition, the apparatus for measuring in-situ stress in rock using a thermal crack according to the present invention can measure the in-situ stress in rock at a great depth, and can be easily used due to simple configuration thereof.

DESCRIPTION OF DRAWINGS

The above and other features and advantages of the present invention will become more apparent after a reading of the following detailed description when taken in conjunction with the drawings, in which:

FIG. 1 is a schematic view for explaining an in-situ stress measuring method and apparatus using a conventional hydraulic fracturing method;

FIG. 2 is a flowchart illustrating a method for measuring in-situ stress in rock using a thermal crack according to an exemplary embodiment of the present invention;

FIG. 3 is a schematic view illustrating a borehole for explaining the in-situ stress measuring method of FIG. 2;

FIG. 4 is a schematic view illustrating the configuration of an apparatus for measuring in-situ stress in rock using a thermal crack according to an exemplary embodiment of the present invention, wherein FIG. 4A shows the state in which a coolant container is expanded, and FIG. 4B shows the state in which a coolant container is contracted;

FIG. 5 is a schematic cross-sectional view taken along line V-V of FIG. 4A;

FIG. 6 is an exploded perspective view illustrating the coolant container, the main part of the in-situ stress measuring apparatus illustrated in FIG. 4;

FIG. 7 is a schematic view for explaining the detection of cracks by acoustic emission sensors;

FIG. 8 illustrates a resultant screen in which two-dimensional (plane) modeling is performed on the formation of a thermal crack from a borehole wall in the first cooling step using a numerical analysis program of "FLAC3D", wherein FIGS. 8A through 8J are resultant screens showing a thermal crack growing with the lapse of time;

FIG. 9 is a graph comparing the results of the modeling of FIG. 8 with theoretical values;

FIG. 10 illustrates a resultant screen in which two-dimensional (plane) modeling is performed on the formation of a thermal crack from a borehole wall in the second cooling step using a numerical analysis program of "FLAC3D", wherein FIGS. 10A through 10H are resultant screens showing a thermal crack growing with the lapse of time;

FIG. 11 is a graph comparing the results of the modeling of FIG. 10 with theoretical values;

FIG. 12 illustrates a resultant screen in which three-dimensional modeling is performed on the formation of a thermal crack from a borehole wall in the first cooling step using a numerical analysis program of "FLAC3D", wherein FIGS. 12A through 12H are resultant screens showing a thermal crack growing with the lapse of time;

FIG. 13 is a graph comparing the results of the modeling of FIG. 12 with theoretical values;

FIG. 14 illustrates a resultant screen in which three-dimensional modeling is performed on the formation of a thermal crack from a borehole wall in the second cooling step using a numerical analysis program of "FLAC3D", wherein FIGS. 14A through 14F are resultant screens showing a thermal crack growing with the lapse of time; and FIG. 15 is a graph comparing the results of the modeling of FIG. 14 with theoretical values;

BEST MODE

In order to achieve the above objects, according to one aspect of the present invention, there is provided a method for measuring in-situ stress in rock using a thermal crack. The method comprises: a borehole forming step of forming a borehole in a target rock for measuring in-situ stress; a first cooling step of cooling a wall of the borehole, applying tensile thermal stress to the borehole wall, forming and growing the crack in the borehole wall, and measuring a first cracking temperature of the borehole wall when the crack occurs and a cracking point at which the crack is formed; a heating step of heating the borehole wall cooled in the first cooling step and closing the formed crack; a second cooling step of cooling the borehole wall again, applying tensile terminal stress to the borehole wall, re-opening the crack closed in the heating step, and measuring a second cracking temperature of the borehole wall when the crack is re-opened; and a calculating step of calculating the in-situ stress of the rock using the first cracking temperature of the borehole wall and the cracking point measured in the first cooling step, and using the second cracking temperature of the borehole wall measured in the second cooling step.

According to one aspect of the present invention, in-situ stress includes maximum and minimum horizontal principal stresses, which act in directions perpendicular to each other on a plane perpendicular to an axis of the borehole; and the maximum horizontal principal stress ($\sigma^1$) and the minimum horizontal principal stress ($\sigma_2$) can be obtained using the following first equation.

$$(1-2\cos 2\theta)\sigma_1+(1+2\cos 2\theta)\sigma_2+\sigma_t=C(t_\alpha-t) \quad \text{<First Equation>}$$

where $\sigma_1$ is the maximum horizontal principal stress, $\sigma_2$ is the minimum horizontal principal stress, $\theta$ is the rotating angle measured in a counterclockwise direction from a point, on which the maximum horizontal principal stress acts, to the cracking point centered around a central point of the borehole on the plane perpendicular to the axis of the borehole, $\sigma_t$ is the tensile strength of the rock, $t_\alpha$ is the temperature of the rock before cooling, and t is one of the first and second cracking temperatures, and where C is the bi-axial thermo-elastic constant of the rock in which the borehole wall is formed and is expressed by $C=E\alpha/(1-\nu)$, where E is the elastic coefficient (Young's module) of the rock, $\alpha$ is the linear thermal expansion coefficient of the rock, and $\nu$ is the Poisson's ratio of the rock.

According to one aspect of the present invention, in-situ stress includes a vertical stress, which acts in directions perpendicular to directions of the maximum and minimum horizontal principal stresses; and the vertical stress is obtained using the following second equation.

$$\sigma_3=C(t_\alpha-t_3)-\sigma_t \quad \text{<Second Equation>}$$

where $\sigma_3$ is the vertical stress, and $t_3$ is the temperature of the rock when a transverse crack perpendicular to an axial direction of the borehole is formed.

According to one aspect of the present invention, the tensile strength ($\sigma_t$) of the rock is set to 0 when the first equation is established using the second cracking temperature measured by re-opening the crack in the second cooling step.

According to one aspect of the present invention, $t_3$ is set by averaging the cracking start and end points when a transverse crack is formed in a circular shape along the borehole wall and when the temperatures of the borehole wall are different from each other at the cracking start and end points.

According to one aspect of the present invention, maximum and minimum horizontal principal stresses are decided by: forming a plurality of cracks at different points in the borehole wall, creating a plurality of first equations, and calculating a plurality of solutions of maximum and minimum horizontal principal stresses; and performing a least square method using the plurality of solutions of maximum and minimum horizontal principal stresses.

According to one aspect of the present invention, the heating step comprises of introducing external air into the borehole to heat the borehole.

According to another aspect of the present invention, there is provided an apparatus for measuring in-situ stress in rock using a thermal crack by drilling a borehole into the ground and forming a crack by heating the wall of the borehole. The apparatus comprises: a coolant container, which has an annular containing space where coolant can be contained, and an inlet for coolant to flow into and out of the containing space; a close-contact means for bringing an outer surface of the coolant container into close contact with the borehole wall; at least one temperature sensor which is installed on an outer surface of the coolant container so as to measure temperature of the borehole wall; and a crack detecting means for detecting cracks formed in the borehole wall by heat transmission between the coolant contained in the coolant container and the borehole wall.

According to another aspect of the present invention, the coolant container is provided therein with a filling space, which is surrounded by the inner wall, the upper cover, and the lower cover of the coolant container so as to fill and discharge a fluid; The close-contact means is a pump connected with the filling space so as to fill and discharge the fluid into and from the filling space; and the outer and inner walls of the coolant container are made of an elastic material which can expand and contract as the fluid is filled into and discharged from the filling space.

According to another aspect of the present invention, the apparatus further comprises a coolant injecting means for injecting coolant into the containing space. The coolant injecting means comprises: a cylinder, which is coupled to the coolant container such that a coolant chamber, in which the coolant is contained, is formed between the coolant container and the cylinder; a piston, which has a piston head inserted into the cylinder, and a piston rod having a bar shape and fixed to the piston head, which is installed so as to be able to be reciprocated in the cylinder, and which presses the coolant toward the coolant container; a driver, which reciprocates the piston; a valve, which is installed on the coolant container so as to mutually communicate and shut the coolant chamber and the containing space.

According to another aspect of the present invention, the crack detecting means detects a burst sound which occurs when a crack is formed in the rock with the borehole wall, and includes at least one acoustic emission sensor attached to the outer circumference of the coolant container.

Mode for Invention

Hereinafter, an apparatus for measuring in-situ stress in rock using a thermal crack according to an exemplary embodiment of the present invention will be described with reference to the accompanying drawings, and than a measuring method using the apparatus will be described in greater detail.

FIG. 4 is a schematic view illustrating an apparatus for measuring in-situ stress in rock using a thermal crack according to an exemplary embodiment of the present invention, wherein FIG. 4A shows the state in which a coolant container is expanded, and FIG. 4B shows the state in which a coolant container is contracted. FIG. 5 is a schematic cross-sectional view taken along line V-V of FIG. 4A. FIG. 6 is an exploded perspective view illustrating the coolant container, the main part of the in-situ stress measuring apparatus illustrated in FIG. 4.

Referring to FIGS. 4 through 6, an apparatus 100 for measuring in-situ stress in rock using a thermal crack according to an exemplary embodiment of the present invention bores a borehole h into the ground in which an underground structure such as a tunnel will be installed, and then applies cryogenic heat to a wall w of the borehole so as to generate cracks, thereby measuring the in-situ stress in the rock. The measuring apparatus comprises a coolant container 10, a close-contact means, a temperature sensor 40, a coolant injecting means, and a crack detecting means.

The coolant container 10 is a case that contains coolant r for applying the cryogenic heat to the borehole wall w. In this embodiment, the coolant container 10 has the structure of a double wall, and thus forms an annular containing space 15. To this end, the coolant container 10 includes an inner wall 11, an outer wall 12, an upper cover 13 and a lower cover 14.

The inner wall 11 is formed in an approximately circular shape, and is disposed at a preset height. The outer wall 12 is formed in a circular shape so as to correspond to a shape of borehole h, and is disposed outside the inner wall 11 while spaced apart from an outer circumference of the inner wall 11. The outer wall 12 has a height equal to that of the inner wall 11. The inner wall 11 and the outer wall 12 are made of elastic material, which can be contracted and expanded. Further, the inner wall 11 and the outer wall 12 are made of high heat resistant material so as to be able to withstand when coming into contact with a low-temperature coolant.

The upper cover 13 and the lower cover 14 are coupled to upper and lower sides of the inner wall 11 and the outer wall 12, respectively. In this case, the annular space, i.e., the containing space 15, surrounded by the inner wall 11, the outer wall 12, the upper cover 13, and the lower cover 14 is defined. The containing space 15 is a space in which coolant r is injected and contained. In this embodiment, liquefied nitrogen ($LN_2$) is used as the coolant.

The lower cover 14 is provided with an inlet 18*a* so as to allow coolant r to flow into and out of the containing space 15. To this end, the inlet 18*a* passes through the lower cover 14. The inlet 18*a* allows the containing space 15 to mutually communicate with a coolant chamber c, which will be described below. Further, an inlet valve 18*b* for shutting and opening the inlet 18*a* is installed in the inlet 18*a* Further, the upper cover 13 is provided with an outlet 19*a* for the coolant to flow out of the containing space 15. To this end, the outlet 19*a* passes through the upper cover 13. A pressure decreasing valve 19*b* for shutting and opening the outlet 19*a* is installed in the outlet 19*a*.

Meanwhile, as described above, when the upper cover 13 and the lower cover 14 are coupled to the upper and lower sides of the inner wall 11 and the outer wall 12 respectively, a filling space 16 surrounded by the inside of the coolant container 10, that is, the inner wall 11, the upper cover 13 and the lower cover 14 is defined.

The close-contact means functions to carry out smooth heat transmission between the coolant r and the borehole wall w by bringing the outer wall 12 of the coolant container 10 into close contact with the borehole wall w in the state where the coolant r is contained in the coolant container 10. In this embodiment, as the close-contact means, a pump is used that can bring the inner wall 11 and the outer wall 12 of the coolant container 10, which are made of elastic material, into close contact with the borehole wall w by filling a fluid into the filling space 16. The pump can be varied depending on the fluid being filled into the filling space 16. Since the filling space 16 is filled with gas in this embodiment, a pneumatic pump (not shown) is used. More specifically, the upper cover 13 is provided with a gas injecting hole 17*a*, which is connected with the filling space 16, at the center thereof. A pipe 17*b*, which is connected with the pneumatic pump, is installed through the gas injecting hole 17*a*, so that the pneumatic pump is mutually connected with the filling space 16. The pneumatic pump is operated to be able to fill and discharge the gas into and from the filling space 16. In other words, when the filling space 16 is filled with the gas, the outer wall 12 of the coolant container 10 expands to come into close contact with the borehole wall w. In contrast, when the gas is discharged, the outer wall 12 of the coolant container 10 contracts and separates from the borehole wall w.

The coolant injecting means functions to inject the coolant r into the containing space 15 of the coolant container 10, and comprises a cylinder 21, a piston 24, a driver, and the inlet valve 18*b*.

The cylinder 21 has a cylindrical shape, and is fixed to the lower portion of the coolant container 10, particularly to the lower cover 14. When the cylinder 21 is coupled to the coolant container 10, the coolant chamber c is defined between the lower cover 14 of the coolant container 10 and the cylinder 21. The coolant r is temporally contained in the coolant chamber c before it is injected into the coolant container 10. The piston 24 is installed on the cylinder 21, and includes a piston head 22 and a piston rod 23. In other words, the piston head 22, which has a disc shape and a diameter substantially equal to that of the cylinder 21, is fitted into the cylinder 21. The piston rod 23 having a bar shape is fixed to a lower end of the piston head 22, and is coupled to a driver, i.e., a motor 30, which will be described below. This piston rod 23 is provided with a male thread 23*a* on an outer circumference thereof.

The motor 30 functions to reciprocate the piston 24, makes use of a known reversible motor, and includes a stator (not shown) and a rotor 31. The rotor 31 is a member that is rotated when power is applied like the known motor, is formed in a hollow shape, and is provided with a female thread 32 in an inner circumference thereof. The piston rod 23 is fitted inside the rotor 31 of the motor 30. As described above, because the male thread 23*a* is formed on the outer circumference of the piston rod 23, the male thread 23*a* of the piston rod 23 is screwed together with the female thread 32 of the rotor 31. Thus, when the rotor 31 of the motor 30 is rotated in a forward or reverse direction, the piston rod 23 moves in an upward or downward direction.

When the rotor 31 of the motor is rotated in a forward direction, the piston rod 23 moves in an upward direction, and the piston head 22 pushes the coolant r in the coolant chamber c towards the coolant container 10, and thereby the coolant r is injected into the containing space 15 through the inlet valve 18*b*. In contrast, when the rotor 31 of the motor is rotated in a reverse direction, the piston rod 23 moves in a downward direction, and the coolant r in the containing space 15 is pushed into the coolant chamber c through the inlet valve 18*b*.

Further, the piston rod 23 extends through the piston head 22. In other words, the piston rod 23 extends through the coolant chamber c as well as the filling space 16 and the upper cover 13 of the coolant container 10. Thus, the piston rod 23 protrudes upwards from the coolant container 10 at an upper end thereof, and protrudes downwards from the rotor 31 of the motor 30 at a lower end thereof. Further, the piston rod 23 is provided therein with a plurality of holes 26, 27 and 28 in a longitudinal direction (i.e. in an axial direction of the borehole). At least one of the holes 26, 27 and 28 acts as an air injecting hole 26, which introduces air in a downward direction, passes through a portion between the upper and lower ends of the piston rod 23 and reaches a lower part of the borehole h. The other holes are connecting holes 27 and 28, in which electric cables (not shown) connected with the motor or various sensors, which will be described below, are installed. Air, which is injected through an upper end of the air injecting hole 26 and then is discharged in a downward direction can function to heat the borehole wall w cooled by the coolant r while moving along the borehole h in an upward direction. In the present invention, as will be described below, the process of forming cracks in the rock using the coolant in order to measure in-situ stress in the rock is repeatedly performed. Thus, the borehole wall w cooled by the coolant r must be restored to room-temperature. Here, thawing of the borehole wall w can be accelerated by the air injecting.

The temperature sensor 40 functions to measure temperature of the borehole wall w. As will be described below, in order to measure in-situ stress in rock, temperature of the borehole wall w must be accurately obtained at a point of time when cracks are generated in the borehole wall w due to the cooling of the coolant r. To this end, a plurality of temperature sensors 40 are installed on the outer circumference, for instance, the outer wall 12, of the coolant container 10, and continuously measure the temperature of the borehole wall w at the respective points.

These temperature sensors 40 are electrically connected with the connecting cables (not shown), which are installed between the inner wall 11 and the outer wall 12 of the coolant container 10. The connecting cables are connected with the electric cables installed in the inner connecting holes 27 and 28 of the piston rod 23. Thus, the temperature of the borehole wall w, which is measured by the temperature sensors 40, is transmitted to a calculating unit outside the borehole h through both connecting and electric cables.

The crack detecting means functions to detect whether or not cracks are generated in the borehole wall w, at which position of the borehole wall w the cracks are generated, and in which direction the cracks are widened at the borehole wall w when the borehole wall w is cooled by the coolant r. In this embodiment, the method of crack detection employs a plurality of acoustic emission sensors 51, 52 and 53. The acoustic emission sensors 51, 52 and 53 are known as detectors that detect acoustic emission generated between about 20 kHz and about 2 MHz. Each acoustic emission sensor detects a sound wave emitted when a minute internal crack is formed due to external shock or friction of a structure, converts the detected sound wave into an electrical signal, and transmits the converted electrical signal.

FIG. 7 shows three acoustic emission sensors 51, 52 and 53 attached to the coolant container 10. As illustrated in FIG. 7, cryogenic heat caused by the coolant is applied to the borehole wall, and thereby a crack is formed at a point indicated by a symbol s to a point indicated by a symbol f. In this case, the three acoustic emission sensors 51, 52 and 53 detect a micro burst sound when the crack is formed. More specifically, when the crack is formed at a start point s and thus the burst sound occurs, the acoustic emission sensor 53 located at a distance b1 nearest the start point s detects the burst sound first, and then the acoustic emission sensor 52 located at a near distance e1 next to the distance b1, and the acoustic emission sensor 51 located at a farthest distance d1 sequentially detect the burst sound at an interval of time. Further, the acoustic emission sensors 51, 52 and 53 detect the burst sound at the final point f of the crack depending on distances b2, e2 and d2 from the final point f. The speed of the sound wave traveling at the borehole wall w is constant, so that the position at which the sound wave occurs can be found using a difference of between the times detected by the acoustic emission sensors. Further, when a crack is widened, its widening direction can be found in the same method. Consequently, the three acoustic emission sensors 51, 52 and 53 detect micro burst sounds, so that they can measure whether or not a crack is formed, the position at which the crack is formed in the borehole wall, and the direction(longitudinal direction, transverse direction, etc.) in which the crack is widened at the borehole wall w.

Hereinafter, a method for measuring in-situ stress in rock using a thermal crack according to an exemplary embodiment of the present invention will be described in greater detail with reference to the accompanying drawings.

FIG. 2 is a flowchart illustrating a method for measuring in-situ stress in rock using a thermal crack according to an exemplary embodiment of the present invention.

Referring to FIG. 2, a method M100 for measuring in-situ stress in rock using a thermal crack according to an exemplary embodiment of the present invention comprises a borehole forming step M10, an apparatus installing step M20, a first cooling step M30, a heating step M40, a second cooling step M50, and a calculating step M60.

The borehole forming step M10 is scheduled to construct a structure such as an oil storage tank, and thus forms a borehole h in the rock, which is aimed at measuring in-situ stress, at a preset depth. The borehole h can be formed in an inclined direction, but generally in a vertical direction.

When the borehole h is formed, the apparatus installing step M20 is performed. To this end, the in-situ stress measuring apparatus 100 of the present invention which is illustrated in FIGS. 4 through 6 is inserted into a measuring section i in the borehole h. When the in-situ stress measuring apparatus 100 is inserted, no pneumatic pressure is applied to the filling space 16. Thus, as illustrated in FIG. 4B, the outer circumference (i.e. the outer wall 12) of the coolant container 10 is kept without being in close contact with the borehole wall w. Further, the coolant r is contained in the coolant chamber c of the cylinder 21.

In this state, when the motor 30 is powered on, the rotor 31 of the motor 30 is rotated in one direction. The piston rod 23, which is screwed together with the rotor 31, linearly moves in an upward direction, thereby pushing the coolant r of the coolant chamber c in an upward direction. When the electrically controlled inlet valve 18*b* of the coolant container 10 is opened, the coolant r evaporates while introduced into the containing space 15 of the coolant container 10, and thus is filled in the containing space 15. When a preset amount of coolant r is filled in the containing space 15, the inlet valve 18*b* is shut to stop filling the coolant r. At this time, liquefied nitrogen remains in the coolant chamber c for the purpose of secondary cooling, which will be described below.

In this state, when the pneumatic pump (not shown) is operated to inject air into the filling space 16 through the pipe 17*b*, pneumatic pressure is applied to the filling space 16, the inner wall 11 and the outer wall 12 of the coolant container 10 expands outwards, as illustrated in FIG. 4A. As a result, the outer wall 12 of the coolant container 10 comes into close contact with the borehole wall w.

As described above, when the coolant container 10 is in close contact with the borehole wall w, the first cooling step M30 is initiated. In this closely contacted state, the coolant r (liquefied nitrogen) about −196° C., primarily cools the borehole wall w. As illustrated in FIG. 3, the borehole wall w in the test section i is subjected to tensile stress so that a crack occurs at a point in the borehole wall w where tangential compressive stress is weakest. The crack grows in proportion to cooling time, and similar cracks occur at other places in the borehole wall w. In other words, after a crack is formed, the crack gradually grows from within the rock, and thus the size of the crack, i.e., a gap caused by the crack, gradually increases. Further, when tensile stress is continuously added, cracks occur at other points other than the point of origin. In brief, when rock is cooled, tensile stress caused by heat is increased. And if this stress is greater than the compressive stress at any given point in the borehole wall, a crack will occur.

Each temperature sensor 40 continuously measures the temperature of the borehole wall w, and transmits a temperature signal to an external calculating unit (not shown) through the electric cable installed in the connecting hole 27 in the piston rod 23. Thus, the temperature (first crack temperature) of the point when the crack occurs can be accurately obtained. The acoustic emission sensors 51, 52 and 53 transmit signals detecting micro burst sound to an external calculating unit (not shown) through the electric cable installed in the connecting hole 27. The calculating unit yields the position (cracking point) where the crack is formed and the direction in which the crack is expanded on the basis of the transmitted signals. Thereby, the first cooling step M30 is completed.

When the first cooling step M30 is completed, the heating step M40 of heating the cooled borehole wall w is performed. The pressure decreasing valve 19*b* is opened to discharge the coolant r, which is contained in the coolant container 10, from the container. The pneumatic pressure of the filling space 16 is released to contract the coolant container 10 as illustrated in FIG. 4B. Further, room-temperature air (or heated air) is introduced into the borehole h through the air injecting hole 26, which axially extends through the piston rod 23. The room-temperature air injected into the borehole h heats the cooled borehole wall w while moving along the borehole h in an upward direction. When the borehole wall w is heated at room temperature due to the injection of the air, tensile stress applied to the borehole wall w is released, and thus the crack becomes smaller. In other words, the gap widened by the crack is reduced in size, and thus only an extremely minute gap remains. However, once a crack is formed in the rock, the crack cannot be restored to its original state, and thus the crack is still present. In the conventional hydraulic fracturing, hydraulic pressure is primarily applied to generate cracks, and then is released to make the crack smaller. This concept is equal to that of closing the crack by way of the heating step in the present invention.

When checked from each temperature sensor 40 in the heating step M40 that the borehole wall w and the borehole h are sufficiently restored to room temperature, the second cooling step M50 is performed. More specifically, the coolant r remaining in the coolant chamber c is again filled in the containing space 15 of the coolant container 10 by the same process as the first cooling step M30, and pneumatic pressure is again applied to the filling space 16. Thereby, the outer wall 12 of the coolant container 10 comes into close contact with the borehole wall w. The borehole wall w is re-cooled and subjected to tensile stress. The crack, which is generated and widened in the first cooling step M30 and then is closed in the heating step M40, is re-opened. This means that the crack closed in the heating step M40 is widened again. However, as described above, since the crack itself is still present in the heating step M40, the crack is re-opened but at a relatively higher temperature than in the first cooling step M30. In other words, in order to generate the crack in the first cooling step M30, the tensile stress caused by heat at the original cracking point must be more than both compressive stress and tensile strength of the rock combined. However, because the crack already occurred in the first cooling step M30, the tensile stress required to re-open the crack in the second cooling step M50 (the tensile stress generated by the coolant) has only to be more than the value of the compressive stress at that point. In other words, since the crack still remains, the force corresponding to the tensile strength of the rock is excluded in the second cooling step M50, compared to the first cooling step M30. To be brief, the tensile stress required to re-open the crack in the second cooling step M50 is determined by subtracting the tensile strength of the rock from the tensile stress required to re-open the crack in the first cooling step M30.

When the second cooling step M50 proceeds, the crack generated in the first cooling step M30 is re-opened. More specifically, at the start, the cracks are opened in a direction (longitudinal direction) parallel to the axial direction of the borehole h. These longitudinal cracks are located along the inner circumference of the borehole wall at several points. Further, when cooling is continued, the cracks are also opened in a direction (transverse direction) perpendicular to the axial direction of the borehole h. These transverse cracks are located along the axial direction of the borehole h at several points. While the cracks are opened by cooling, each temperature sensor 40 continuously measures the temperature (second crack temperature) when each crack is re-opened, and the acoustic emission sensors 51, 52 and 53 continuously measure the positions in which the cracks are re-opened and the direction in which the cracks are widened, and then transmit the measurements to an external calculating unit.

In the calculating step M60, in-situ stress of the rock is calculated using the data, for instance, the first crack temperature, the second crack temperature, and the cracking point, which are obtained in the first cooling step M30 and the second cooling step M50. Here, in-situ stress in the test section is calculated using the signals transmitted from the temperature sensors 40 and the signals transmitted from the acoustic emission sensors 51, 52 and 53.

The in-situ stress calculated by the calculating unit includes two stresses, i.e., maximum horizontal principal stress and minimum horizontal principal stress, which act in directions perpendicular to each other on a plane (xy plane of FIG. 3) perpendicular to the axis of the borehole. Further, in the exemplary embodiment of the present invention, the in-situ stress also includes vertical stress. A vertical stress acts in a direction (z-axial direction) perpendicular to each of the maximum horizontal principal stress and the minimum horizontal principal stress.

First, the maximum horizontal principal stress, the minimum horizontal principal stress, and the vertical stress of the borehole wall will be described, and then the calculating step M60 of the in-situ stress measuring method of the present invention will be described.

In the past, the stresses around the borehole h (stresses of the borehole wall w) were studied by many researchers, and can be obtained using the following Equations 1, 2 and 3, which are disclosed in a reference (Jaegar J. C, Cook N. G. W., 1976, Fundamentals of Rock Mechanics, $2^{nd}$ Edn., Chapman and Hall, London). A tangential stress, a radial stress, and a shear stress around the borehole h in a homogeneous medium having an anisotropic in-situ stress on the plane (xy plane) perpendicular to the z-axial direction z of the borehole h are as follows.

$$\sigma_\theta = \frac{(\sigma_1+\sigma_2)}{2}\left(1+\frac{a^2}{r^2}\right) - \frac{(\sigma_1-\sigma_2)}{2}\left(1+\frac{3a^2}{r^2}\right)\cos 2\theta \tag{1}$$

$$\sigma_r = \frac{(\sigma_1+\sigma_2)}{2}\left(1-\frac{a^2}{r^2}\right) - \frac{(\sigma_1-\sigma_2)}{2}\left(1+\frac{4a^2}{r^2}+\frac{3a^2}{r^2}\right)\cos 2\theta \tag{2}$$

$$\tau_{y\theta} = \frac{(\sigma_1-\sigma_2)}{2}\left(1+\frac{2a^2}{r^2}-\frac{3a^2}{r^2}\right)\sin 2\theta \tag{3}$$

where r is the radius of the borehole, $\sigma_1$ and $\sigma_2$ are the maximum and minimum principal stresses on an infinite plane perpendicular to the axial direction of the borehole (in which the maximum and minimum principal stresses are perpendicular to each other), and θ is the angle measured in a counterclockwise direction starting at the maximum principal stress $\sigma_1$. When three-dimensional stress is analyzed, the equations are resultant equations under a condition of plane strain, and are valid on the assumption that a circular opening is oriented in one of principal stress directions.

At the borehole wall, the tangential stresses $\sigma_{\theta=0°}$ and $\sigma_{\theta=90°}$ at θ=0° and θ= 90° are as follows:

$$\sigma_{\theta=0°}=3\sigma_2-\sigma_1 \tag{4}$$

$$\sigma_{\theta=90°}=3\sigma_1-\sigma_2 \tag{5}$$

$\sigma_r=0$, and $\tau_{r\theta}=0$ at the borehole wall r=α. The compressive force in a direction of the principal stress is taken as a positive value. In most of the cases, the tangential stresses are compressive in nature. Therefore, de-stressing of the borehole requires the induction of tensile stresses in the form of thermal stresses by lowering the temperature. As disclosed in a reference (Bruno A. B., Jerome H. W., 1985, Theory of Thermal Stresses, Dover Publications, Minneola, N.Y.), if it is shown through thermal stress analysis that the thermal stress does not cause the shear stress, the stress analysis can be simplified.

Meanwhile, the tangential thermal stress $\sigma_{\theta th}$ at the borehole wall w is given by the following Equation 6, as disclosed in the above-mentioned reference (Bruno A. B., Jerome H. W., 1985, Theory of Thermal Stresses, Dover Publications, Minneola, N.Y.).

$$\sigma_{\theta th} = \frac{E}{(1-\nu)}\alpha\Delta t = C(t - t_\alpha) \tag{6}$$

where E is the elastic coefficient (Young's module) of the rock, ν is the Poisson's ratio of the rock, α is the linear thermal expansion coefficient of the rock, Δt is the temperature change from the temperature $t_\alpha$ before cooling to the cracking temperature t (first cracking temperature or second cracking temperature) of the borehole wall, and C is the bi-axial thermo-elastic constant of the rock and is expressed by $C=E\alpha/(1-\nu)$.

It can be predicted that the first point, at which the crack is formed from the borehole wall w on the plane (xy plane of FIG. 3) perpendicular to the borehole h, is a point (intersection of the x axis and the borehole wall) on which the maximum principal stress $\sigma_1$ (assuming that the direction when θ=0 is the direction of the principal stress) acts. In other words, since the tangential stress (acting in a direction perpendicular to the direction of the maximum horizontal principal stress) at the point on which the maximum horizontal principal stress acts is shown on the borehole wall to the minimum extent, the tangential stress at that point is the first to become equal to the tensile stress caused by the coolant. Thus, when the following condition is met, the crack is formed from the borehole wall w on the plane perpendicular to the axis of the borehole. The following Equation 7 shows the concept that the value of adding the tensile strength $\sigma_t$ of the rock to Equation 4 (value of adding the tangential stress and the tensile strength at the point where θ=0°) is equal to Equation 6 (tensile stress caused by heat). More strictly speaking, when the right side of the equality sign is even slightly greater than the left side, a crack is formed.

$$3\sigma_2-\sigma_1+\sigma_t=C(t_\alpha-t_1) \tag{7}$$

where $\sigma_t$ is the tensile strength of the rock, and $t_1$ is the temperature at which the crack is formed.

Additional cooling of the borehole wall cannot only generate secondary cracks at various angles in a counterclockwise direction on the basis of the direction of the maximum principal stress, but also widen the existing cracks. When the following condition is met, a crack is formed in a direction perpendicular to the maximum principal stress (at a point on which the minimum principal stress acts, or at a point on the y axis). The following Equation 8 shows the concept that the value of adding the tensile strength $\sigma_t$ of the rock to Equation 5 (value of adding the tangential stress and the tensile strength at the point where θ=90°) is equal to Equation 6 (tensile stress caused by heat). More strictly speaking, when the right side of the equality sign is even slightly greater than the left side, a crack is formed.

$$3\sigma_1-\sigma_2+\sigma_t=C(t_\alpha-t_2) \tag{8}$$

where $t_2$ is the temperature of the borehole wall while the crack is formed in the direction of the minimum principal stress. However, it can be predicted that a crack is not easily generated at the point on which the minimum principal stress acts. This is because the tangential stress (acting in a direction perpendicular to the minimum principal stress) at the point on which the minimum principal stress acts is shown on the borehole wall to the maximum extent. In the case of actual cooling, a crack does not often occur at the point on which the minimum principal stress acts.

Meanwhile, a crack (transverse crack) perpendicular to the axial direction of the borehole can be generated on the following condition.

$$\sigma_3+\sigma_t=C(t_\alpha-t_3) \tag{9}$$

where $t_3$ is the temperature where the crack is formed in a direction perpendicular to the axial direction of the borehole, and $\sigma_3$ is the vertical stress and acts in the axial direction of the borehole.

Solving Equations 7, 8 and 9, the principal stresses can be decided as follows.

$$\sigma_1 = \frac{C}{8}[3(t_\alpha - t_2) + (t_\alpha - t_1)] - \frac{\sigma_t}{2} \tag{10}$$

$$\sigma_2 = \frac{C}{8}[3(t_\alpha - t_1) + (t_\alpha - t_2)] - \frac{\sigma_t}{2} \tag{11}$$

$$\sigma_3 = C(t_\alpha - t_3) - \sigma_t \tag{12}$$

When the material constants E, ν, α and $\sigma_t$ are given, the maximum horizontal principal stress $\sigma_1$, the minimum horizontal principal stress $\sigma_2$, and the vertical stress $\sigma_3$ can be decided. These physical properties (the material constants) of rock are evaluated by testing core samples obtained at a test position.

Meanwhile, when an equation is made using data obtained from the crack re-opening test (second cooling step), the tensile strength $\sigma_t$ can be removed from Equations 10, 11 and 12. This is because the crack that has already been generated is re-opened in the second cooling step and thus the tensile strength of the rock is removed.

The thermo-elastic constant C can be obtained through a separate test instead of deciding the material constants E, ν and α.

The temperature (or surrounding temperature) $t_\alpha$ before cooling can be measured, and the temperatures $t_1$, $t_2$ and $t_3$ at which various cracks are generated are values measured using the in-situ stress measuring apparatus 100. When only the tensile strength $\sigma_t$ and the thermo-elastic constant C of the rock which are the unknowns are found, the three principal stresses $\sigma_1$, $\sigma_2$ and $\sigma_3$ can be decided. Since the tensile strength at and the thermo-elastic constant C of the rock are physical property values of the rock which can be measured at a laboratory, the three principal stresses can be theoretically calculated using Equations 10, 11 and 12.

In order to obtain in-situ stress using Equations 10, 11 and 12, a crack must be generated at the point on which the minimum horizontal principal stress acts. However, as described above, because a crack is rarely generated at the point on which the minimum horizontal principal stress acts, in-situ stress cannot be obtained using Equations 10, 11 and 12 if a crack is not generated at that point. Further, although it is predicted in the first cooling step M30 and the second cooling step M50 that a crack will be formed first at the point on which the maximum horizontal principal stress acts and generated last at the point on which the minimum horizontal principal stress acts, the results may vary under real circumstances. For this reason, in the present invention, in-situ stress is obtained using a more generalized equation, which will be described below in detail.

Meanwhile, the vertical borehole will be theoretically described.

From the worldwide stress measurement data, it can be said that $$\sigma_v=\gamma H$$

where $\gamma$ is the unit weight, H is the depth (Brown E. T., Hoek E., 1978, *Trends in Relationships between Measured In Situ Stresses and Depth*, Int. J. Rock Mech. Min. Sci. & Geomech. Abst. 15, 211-215; Amadei B, Stephansson O, 1997, Rock Stress and Its Measurement 1st Edn. Chapman and Hall, London). Thus, in the case of the vertical borehole, since it can be assumed that the axis of the borehole is parallel to the vertical stress $\sigma_3$, $\sigma_3$ can be considered as the already known value. Arranging the thermo-elastic constant C by substituting the above equation into $\sigma_3$ of Equation 9, the thermo-elastic constant C is as in the following Equation 13.

$$C = \frac{\sigma_3 + \sigma_t}{t_\alpha - t_3} = \frac{\gamma H + \sigma_t}{t_\alpha - t_3} \tag{13}$$

Substituting Equation 13 into Equations 7 and 8, the following results are obtained.

$$3\sigma_2 - \sigma_1 + \sigma_t = \frac{(\gamma H + \sigma_t)}{(t_\alpha - t_3)}(t_\alpha - t_1) \tag{14}$$

$$3\sigma_1 - \sigma_2 + \sigma_t = \frac{(\gamma H + \sigma_t)}{(t_\alpha - t_3)}(t_\alpha - t_2) \tag{15}$$

The components $S_H(\sigma_1)$ and $S_h(\sigma_2)$ of the horizontal principal stress can be obtained from Equations 14 and 15 as follows.

$$S_H = \frac{(\gamma H + \sigma_t)}{8(t_\alpha - t_3)}[3(t_\alpha - t_2) + (t_\alpha - t_1)] - \frac{\sigma_t}{2} \tag{16}$$

$$S_h = \frac{(\gamma H + \sigma_t)}{8(t_\alpha - t_3)}[3(t_\alpha - t_1) + (t_\alpha - t_2)] - \frac{\sigma_t}{2} \tag{17}$$

Thus, in the first cooling step in the vertical borehole, only the value of the tensile strength, which can be obtained from the laboratory test, is required.

Accordingly, the in-situ stress in the vertical borehole can be obtained when only the tensile strength of the rock is found. Moreover, as described above, the re-opening of the crack (second cooling step) is performed on the vertical borehole, the constant $\sigma_t$ becomes 0, and thus the laboratory test can be omitted. In other words, in the second cooling step, Equations 16 and 17 can be simplified as follows.

$$S_H = \frac{\gamma H}{8(t_\alpha - t_3)}[3(t_\alpha - t_2) + (t_\alpha - t_1)] \tag{18}$$

$$S_h = \frac{\gamma H}{8(t_\alpha - t_3)}[3(t_\alpha - t_1) + (t_\alpha - t_2)] \tag{19}$$

With respect to the vertical borehole, the value of in-situ stress can be decided in the above-mentioned method.

However, since Equations 18 and 19 are also made using Equations 10, 11 and 12, it is assumed that a crack is formed at the point on which the minimum horizontal principal stress acts, as described above. Hence, it is necessary to use the generalized equation that can obtain in-situ stress although the crack is not generated at the point on which the minimum horizontal principal stress acts. Further, in order to obtain in-situ stress using Equations 10, 11 and 12 or Equations 18 and 19, the tensile strength and the thermo-elastic constant of the rock must be found. The tensile strength at and the thermo-elastic constant C are the physical property values of the rock, and thus can be obtained by testing the samples taken on the spot. However, a slight deviation may exist between the values obtained at the laboratory and the real environment. As such, it is necessary to reduce any errors resulting from this deviation by obtaining as much data as possible.

Hereinafter, the calculating process performed in the calculating step M60 of the present invention will be described in detail.

In order to minimize the range of error of in-situ stress measured and calculated according to the present invention, the following Equation 20, i.e., first equation, is used as the general equation in which the maximum and minimum principal stresses $\sigma_1$ and $\sigma_2$, the crack position $\theta$, the temperature t, the thermo-elastic constant C, the tensile strength $\sigma_t$ etc., are included as variables. In the first equation, the term of the right side of the equality sign is the thermal stress (tensile stress) expressed in Equation 6, and the term of the left side is the tangential stress (compressive stress) at an arbitrary angle $\theta$.

In the first equation, the variables are equal to those described in the above equations. The maximum horizontal principal stress $\sigma_1$ and the minimum horizontal principal stress $\sigma_2$ can be obtained with respect to the borehole wall on the plane perpendicular to the axis of the borehole using the following first equation.

<First Equation>

$$(1-2\cos 2\theta)\sigma_1+(1+2\cos 2\theta)\sigma_2+\sigma_t=C(t_\alpha-t) \tag{20}$$

In Equation 20, the maximum horizontal principal stress $\sigma_1$ and the minimum horizontal principal stress $\sigma_2$, which are to be measured, are the unknowns. The tensile strength $\sigma_t$ and the thermo-elastic constant C of the rock are the physical property values of the rock, and thus can be obtained by testing at a laboratory, but may be treated as unknowns. The crack position $\theta$, the temperatures t and $t_\alpha$ are the values measured by the in-situ stress measuring apparatus 100. In the case in which the tensile strength and the thermo-elastic constant of the rock are treated as the unknowns, a total of four unknowns are included in the first equation. Thus, a crack is formed at four or more points in the borehole wall by cooling, and then four or more first equations are made and solved simultaneously. Thereby, the maximum horizontal principal stress and the minimum horizontal principal stress can be obtained.

However, in the case in which the tensile strength $\sigma_t$ and the thermo-elastic constant C of the rock are separately measured at a laboratory by taking rock samples, only two unknowns are included in the first equation. Thus, a crack is formed at two or more points in the borehole wall, and then two or more first equations are made and solved simultaneously. Thereby, the maximum horizontal principal stress and the minimum horizontal principal stress can be obtained.

Similarly, when only one of the tensile strength $\sigma_t$ and the thermo-elastic constant C of the rock is obtained at a laboratory, three unknowns remain in the first equation. Thus, a crack is formed at three or more points in the borehole wall, and then three or more first equations are made and solved simultaneously. Thereby, the maximum horizontal principal stress and the minimum horizontal principal stress can be calculated.

However, in order to reduce the errors of the values of the maximum and minimum horizontal principal stresses calculated by the first equations, as much data must be secured by applying the first equations to the cracks generated at several points in the borehole wall. When a least square method is performed on a plurality of solutions of the maximum and minimum horizontal principal stresses obtained by the plurality of first equations secured from the several points where the cracks are generated, least square solutions are calculated with respect to the maximum and minimum horizontal principal stresses. Thereby, the error range can be minimized.

The first equation can be made using the cracks generated in the first cooling step M30 or the cracks re-opened in the second cooling step M50. When the equation is established in the first cooling step, θ will be the point at which the crack occurs, and t will be the temperature at which the crack occurs. When the equation is established in the second cooling step, θ will be the point at which the crack is re-opened, and t will be the temperature at which the crack is re-opened. The re-opened crack in the second cooling step is one that has already been generated in the first cooling step, so θ is the same as in the first cooling step. Further, in the case in which the first equation is established using the re-opened crack in the second cooling step, the tensile strength $\sigma_t$ of the rock is set to 0 in the first equation, because the crack has already been generated in the first cooling step M30, and thus tensile strength of the rock is removed when the crack is re-opened in the second cooling step M50. As described above, the first equation can be established in the first cooling step M30 and the second cooling step M50. The plurality of first equations is preferably formed by using the data, i.e., the point and temperature at which the crack is re-opened. This is because, in the first cooling step M30, a release of stress can occur around the crack, which is generated in the initial stage of the first cooling step M30, and which has an influence on stress concentration required to subsequently generate cracks. If so, the accurate value cannot be calculated, and thus errors can occur.

Meanwhile, the vertical stress $\sigma_3$ acting in a vertical direction is independent not of $\sigma_1$ and $\sigma_2$ but of the thermo-elastic constant C and the tensile strength $\sigma_t$. The vertical stress $\sigma_3$ must be obtained by deciding the thermo-elastic constant C and the tensile strength $\sigma_t$ using the equations based on the first equation (Equation 20), on a condition that the transverse crack is generated.

$$\sigma_3=C(t_\alpha-t_3)-\sigma_t \qquad \text{<Second Equation>}$$

In general, transverse cracks can be initiated on the plane perpendicular to the axis of the borehole in directions of 0° and 180° with respect to the direction of the maximum principal stress. These cracks will gradually be propagated while forming complete circular cracks along the circumference of the borehole wall. In this case, unlike the case where the longitudinal cracks are generated, a great difference may exist between the temperature $t_{3i}$ at which each crack is initiated and the temperature $t_{3e}$ at which each crack is completed. Thus, the temperature $t_3$ at which the transverse crack is formed has only to be calculated by a simple average of the temperature $t_{3i}$ at which each crack is initiated and the temperature $t_{3e}$ at which each crack is completed, as in the following equation.

$$t_3=(t_{3i}+t_3e)/2$$

Meanwhile, when the equations based on Equation 13 are obtained, preferably they are obtained only when the initial crack is formed in the first cooling step, i.e., only the point at which the crack position θ is 0°, and the equations for the subsequent cracks are obtained in the second cooling step M50. The reason why the equations for the subsequent cracks are not obtained in the first cooling step is because stress release occurs around the initial crack in the first cooling step and because the initial crack has a serious influence on the stress concentration required to generate the subsequent cracks, and thus because the accurate values cannot be calculated.

As described above, the borehole wall w is subjected to primary and secondary cooling using the apparatus according to the present invention, and thereby many cracks are generated. The equation is established for each crack using Equation 13, and thereby many solutions (maximum and minimum horizontal principal stresses, and thermo-elastic constant) can be obtained. The least square method is applied to these solutions, and thus the least square solution is calculated. Thereby, the solution minimizing the error range can be obtained. The vertical stress also can be obtained by minimizing the error range in the above-mentioned method.

Numerical modeling studies are conducted using so-called 'FLAC3D' program with thermal option (FLAC3D manual, 1997) to check the validity of the above-mentioned method. The crack development is modeled by making the elements as null zones when the tensile stresses exceed the tensile strength of the rock. Though several other methods were also suggested by various researchers in the past for the modeling of generation and propagation of cracks in brittle materials, this method is simple and easy to use. This technique has also been used in the past with finite element method for predicting the fragment formation while blasting (Saharan M. R., 2004, Dynamic Modeling of Rock Fracturing by Destress Blasting, Ph. D. Thesis, University of McGill, Canada). When the direction of generation and propagation of cracks is not known prior to the modeling, this is a very effective method for crack simulation, provided the finite element/difference mesh is fine enough. Large element size near the borehole wall can result in significant mechanical stress unbalance while cracking, and therefore should be avoided.

In order to simulate the size of a so-called NX borehole, a borehole having a diameter of 74 mm is made in a plane strain state using a single strip model. Only one quadrant is created using a condition of rotation symmetry. In order to simulate conditions of the vertical borehole, the direction of the borehole is set to the z-axial direction. The maximum horizontal principal stress $S_H$ and the minimum horizontal principal stress $S_h$ are considered parallel to the x axis and the y axis, respectively.

At the inside of the borehole, the coolant container (made of low stiffness material) is modeled, which would hold the cryogenic fluid ($LN_2$) at a temperature of −196° C. Transient heat flow analysis is performed while heat conducts through the coolant container to the borehole wall and into the rock. Coupled thermal and mechanical stepping is performed until the tensile stresses in the rock (borehole wall) exceed the tensile strength of the rock. A so-called 'FISH' program checks the stress level of each element in the mesh during every calculation cycle.

For any element, when the tensile stress exceeds the tensile strength of the rock, the element is changed to a "null element". This will result in significant unbalance of forces. Therefore, the thermal cycling is stopped and the model is brought to mechanical equilibrium by performing only the mechanical cycles. Coupled thermal-mechanical cycles are resumed thereafter. In other words, when one process is completed in this way, the thermodynamics interaction analysis is re-started. This process is continued until fractures (cracks) develop through out the periphery of the borehole wall. The temperature of the borehole wall at the time of the first appearance of crack (usually along the $S_H$ direction) is taken as $t_1$ and the appearance of subsequent fractures at angles, $\theta_2$, $\theta_3$, $\theta_4$ with respect to the $S_H$ direction is taken as $t_2$, $t_3$, $t_4$, respectively.

The examples (Example 1) performed here have the following general input data: Thermal and mechanical properties for the surrounding rock are as follows:

Linear thermal expansion coefficient $\alpha$=6.64 e−6/° C.; Thermal conductivity k=2.63 W/m/° C.; Specific heat at constant pressure $C_p$=710 J/kg/° C.; Density $\rho$=2500 kg/m$^3$; $\sigma_t$=5 MPa; E=20 GPa; $\nu$=0.25

Thermal and mechanical properties for the coolant container are as follows;

Linear thermal expansion coefficient $\alpha$=2.0 e−7/° C.; Thermal conductivity k=3.0 W/m/° C.; $C_p$=500 J/kg/° C.; Density=1000 kg/m$^3$; E=0.02 GPa; $\nu$=0.25

A plane strain condition is created using a single strip model of a borehole of diameter 74 mm (corresponding to NX size). Only a quarter of the borehole and the surrounding rock is created by using planes of symmetry passing through the borehole axis and along x and y axes. The borehole is oriented in the z axis direction to simulate the condition of a vertical borehole. The maximum horizontal principal stress ($S_H$) is considered parallel to the x axis and the minimum horizontal principal stress ($S_h$) parallel to they axis.

Initial stress level taken for this study is as follows:

$$\sigma_{xx}=10\text{ MPa},\ \sigma_{yy}=7\text{ MPa},\ \sigma_{zz}=20\text{ MPa},\ \sigma_{xy}=0\text{ MPa},\ \sigma_{yz}=0\text{ MPa},\ \sigma_{zx}=0\text{ MPa}$$

FIG. 8 shows various stages of the thermo-mechanical modeling of the borehole cooling and fracturing (cracking). The sequence of fracturing (cracking) during the initial cooling cycle can be visualized from FIG. 8A-8J). As expected, the cracks c1 initiate at the borehole periphery and in the direction of x axis, which is the maximum horizontal principal stress ($S_H$) direction. Subsequently, second and third cracks c2 initiate at 9.5° and 17.5° respectively with the $S_H$ direction. This can be seen from FIGS. 8B and 8C, respectively. All this above fractures can be treated as radial fractures parallel to the borehole axis. In general, it is seen from the numerical modeling that the cracks initiate at intervals of 7~10°. As new cracks are generated, it is also observed that the earlier cracks deepen to 2~3 elements' depth (FIG. 8D-8I). Seven cracks are observed at angles 0, 9.5, 17.5, 25.5, 32.5, 41.5 and 53.5°. During the numerical modeling analysis, the wall temperature was also monitored in tandem with the fracture monitoring. The above seven crack initiations are found at wall temperatures −56.85, −66.12, −73.6, −85.16, −89.76, −102.9 and −113.6° C., respectively.

In this particular study, the out-off-plane stress $\sigma_{zz}$ is 20 MPa, which is less than the tangential stress at $\theta$=90° (23 MPa), therefore the crack perpendicular to the $S_H$ direction could not be studied, as cracks (transverse cracks) perpendicular to the borehole axis initiated prior to the fracture along y axis. It requires a more elaborate three-dimensional modelling to study fracturing in all the three directions.

In order to analyze the results of numerical modeling for potentials and verification of a new method for measuring in-situ stress, the theoretical stress values at the borehole periphery is compared with the numerical estimates of thermal stresses during the cracking process at various angles.

FIG. 9 shows the theoretical tangential stresses existing through out the borehole periphery at various angles with the x axis. These theoretical values are calculated using equation (1) for $\alpha$=r. The numerical estimates for the seven crack angles are calculated from the wall temperature at the time of crack initiation using equation (6) and plotted in FIG. 9 after subtracting the tensile strength factor. From FIG. 9 the numerically estimated tensile thermal stress value ($-\sigma_{th}$) required for fracturing at $\theta$=0, i.e. for the first crack c1, matches well with the theoretical tangential stress value. However, for the subsequent cracks c2, the numerical estimates are found over predicting the existing stress levels. This discrepancy is caused due to the stress release near the earlier cracks, which significantly affects the stress concentration needed for the subsequent crack initiations. Therefore, with the first cycle of cooling(first cooling step), only one equation, viz. equation (7) can be obtained accurately. It is further speculated that when the tensile strength of the rock is lower compared to the ambient stress levels, this discrepancy may reduce. The depth of these fractures are in the order of a few millimeters, which is much lower compared to the hole diameter, and therefore in real testing these cracks may not significantly alter the stress picture of the surrounding rock.

To simulate the second cycle of cooling (second cooling step) and crack reopening, it is necessary to thaw the borehole and bring it back to its original temperature state. This can be practically done by withdrawing the cryogenic fluid from the coolant container and blowing the borehole periphery with ambient temperature air for a few minutes and at the same time monitoring the temperature, until it is stabilized. This will allow the earlier cracks to close and the compressive stresses to act across them. Further re-cooling of the borehole generates tensile stresses, which will cause the earlier cracks to reopen at earlier angles at specific wall temperatures. Since the cracks are tension free surfaces, the tensile strength factor automatically disappear from the stress equation (equation (20)). This enables to obtain the solution of the remaining two unknown principal stresses using any two equations or to obtain a best-fit using multi-linear regression employing least square analysis.

The crack reopening, second-cycle cooling test is simulated using the following procedure.

a) Mapping of the cracks caused by the first-cycle cooling test.

b) Changing the crack elements back to "elastic" and flagging them as "no-tension" material.

c) Stabilizing the temperature back to the ambient and thus nullifying all the thermal stresses in the medium.

d) Re-application of −196° C. at the coolant container periphery and start of the second-cycle cooling.

e) Monitoring the wall temperature as well as crack reopening using a FISH program.

Since the crack elements are declared "no-tension" materials, the cracking is expected to initiate for those elements as the pre-existing compressive stresses are nullified by the tensile thermal stresses. The sequence of crack reopening during the second cycle of cooling is given in FIG. 10. The first crack c1 reopening can be seen in FIG. 10B along the x axis. The wall temperature of reopening is −30.5° C., which is lower compared to the first-cycle cooling test. Subsequent failure and crack extension can be seen at the angles, 9.5, 17.5, 25.5, 32.5, 41.5 and 53.5°, as shown in FIG. 10C-10H. The wall temperatures during the crack reopening along the above angles are observed from the history plots as −32.97, −37.6, −41.1, −50.1, −62.17 and −75.3° C., respectively.

The numerical estimates of thermal stresses at crack reopening are plotted in FIG. 11 along with the pre-existing theoretical tangential stresses. One point to be noted is that for crack reopening, the tensile strength is taken as zero. From FIG. 11 it can be seen that the numerical estimates are very close to the theoretical values.

Therefore, the crack reopening temperatures at any two angles can be used to resolve the two principal stresses, $S_H$ and $S_h$. However, the solution gives the principal stresses in terms of the thermo-elastic constant C. As stated earlier, for a vertical borehole, C can be estimated as $C=\gamma H/(t_\alpha-t_{3r})$, where $t_{3r}$ is the wall temperature of reopening of a horizontal crack perpendicular to the borehole axis. But for all other conditions, it has to be estimated in the laboratory. In a two-dimensional analysis, the crack generation perpendicular to the borehole axis cannot be studied; this requires a three-dimensional analysis.

If we know the value of C, which is equal to 0.1771 MPa/° C. in this particular case, the principal stresses can be estimated.

Best fit solutions are obtained by least square analysis for the principal stresses by considering considering 7 crack angles, which gives $\sigma_1$=10.17 MPa and $\sigma_2$=7.06 MPa with and $R^2$=0.99. These values are very close to the applied stress values of $\sigma_{xx}$ and $\sigma_{yy}$ in the numerical model.

The first example, being a two dimensional analysis, was unable to model the thermal cracks in planes perpendicular to the borehole axis. Therefore, a three-dimensional model is constructed in FLAC3D by taking a considerable length of the borehole section, where the low temperature is to be applied. The procedure adopted for the 3D modelling is otherwise similar to that described in Example 1.

The initial stress levels taken for this example are: $\sigma_{xx}$=5 MPa, $\sigma_{yy}$=2 MPa, $\sigma_{zz}$=3 MPa, $\sigma_{xy}$=0 MPa, $\sigma_{yz}$=0 MPa, $\sigma_{zx}$=0 MPa.

No shear stresses are applied in the Cartesian planes, which imply that the principal stresses are aligned along the axes, and the borehole is aligned along one of the principal stress direction viz., the z axis.

During the initial cooling test run, the tensile cracks initiated through out the modeled section of the borehole, in a plane parallel to the borehole axis and at zero degrees to the x axis, which is the maximum horizontal principal stress direction. This initial crack formation is shown in FIG. 12A. Similar cracks in planes parallel to the borehole axis and at various angles to the x-axis can be seen in the subsequent FIGS. 12B-12H.

At the same time, cracks perpendicular to the borehole are also found to originate from the direction of x axis (maximum principal stress direction) and propagate angularly along the borehole wall until it reaches the direction of y axis, depicting a full-circle perpendicular crack. This crack formation can be seen from FIG. 12B-12H. Such perpendicular cracks are found to occur at intervals of 5~8 mm along the length of the borehole. To attribute an average wall temperature for the crack formation, a simple average of the temperature of crack initiation and crack completion is taken as, $$t_3=(t_{3i}+t_{3e})/2 \tag{21}$$

If the principal stresses in the other directions viz., $\sigma_1$ and $\sigma_2$ are not widely different, it is expected that these cracks occur within a brief span of time and wall temperature. In this particular case, the average temperature of perpendicular crack formation is −15.3° C. The corresponding stress value for the perpendicular crack formation, computed using equation (12) is 2.14 MPa.

$\sigma_t$ Equation (12) and (20) can be eliminated from multiple crack re-opening tests. This makes it possible it decide the principal stresses using only the thermo-elastic constant C.

From FIG. 12, six crack angles can be observed starting from 0° to 59.25° with the x axis. The wall temperatures corresponding to crack initiations at 0, 11.25, 23.25, 35.25, 47.25 and 59.25° are −10.7, −16.07, −27.8, −45.96, −69.63 and −85.03° C., respectively. FIG. 13 shows the comparison between the theoretical tangential stress values and the predicted numerical estimates. For the initial crack formation, as in the case of example 1, the numerical prediction agrees well with theoretical values, but for the subsequent angles, the numerical values seem to over predict the tangential stress levels. A multi-linear regression analysis of the numerically predicted data gives $\sigma_1$=6.8 MPa, $\sigma_2$=2.3 MPa and $\sigma_t$=6.47 MPa. These values are within 15-35% error.

A second-cycle cooling(second cooling step) for crack reopening modeling is conducted using similar procedure followed for the previous example. The cracks recorded during the first cycle are mapped, with some approximations. FIGS. 14A-14F shows the different stages of crack reopening. Referring to FIG. 14, the temperatures corresponding to the radial cracks reopening at angles 0, 11.25, 23.25, 35.25, 47.25 and 59.25° are 22.57, 17.1, 8.75, −5.5, −23.0, −39.5° C., respectively. The perpendicular cracks reopening initiated at an approximate wall temperature of 17° C. (FIG. 14B), which completed a full circle at about 2.4° C., averaging about 9.7° C. The $\sigma_{zz}$ level corresponding to this average temperature is 2.7 MPa, which is within 15% error. FIG. 15 shows a comparison of the theoretical pre-existing tangential stress levels through out the borehole periphery and the numerically predicted values with respect to the crack reopening thermal stresses. As in the case of example 1, the numerical predictions are in good agreement with the theoretical values for the reopening test. A multi-linear regression using least square analysis gives the best-fit values for $\sigma_{xx}$ and $\sigma_{yy}$ as 5.78 and 2.13 MPa, respectively. These predictions estimated the principal stresses within 15% error.

The preliminary theoretical and numerical analysis conducted to validate the novel concept shows that the method is capable of accurate estimation of the in-situ stresses by monitoring tensile crack formation at borehole wall and the wall temperature at the time of crack initiation. The time taken for cooling the borehole periphery for the test will only be a few seconds. The method can be applied to boreholes of any directions. Moreover, all three principal stresses can be obtained by monitoring crack formation at various angles along the borehole axis as well as across the borehole axis. The errors obtained in determination may be those associated with the numerical modeling procedure. With better and more sophisticated crack modeling procedures, it is expected that the error levels may come down.

The invention claimed is:

1. A computerized method for measuring in-situ stress in rock using a thermal crack, the method comprising:

a borehole forming step of forming a borehole in the target rock for measuring in-situ stress;

a first cooling step of cooling a wall of the borehole, applying tensile thermal stress to the borehole wall, forming and growing the crack in the borehole wall, and measuring a first cracking temperature of the borehole wall when the crack is formed and a cracking point at which the crack is formed;

a heating step of heating the borehole wall cooled in the first cooling step and closing the crack;

a second cooling step of cooling the borehole wall again, applying tensile terminal stress to the borehole wall, re-opening the crack closed in the heating step, and measuring a second cracking temperature of the borehole wall when the crack is re-opened; and a calculating step of calculating by a processor the in-situ stress of the rock using the first cracking temperature of the borehole wall and the cracking point, which are measured in the first cooling step, and using the second cracking temperature of the borehole wall, which is measured in the second cooling step.

2. The method according to claim 1, wherein:

in-situ stress comprises maximum and minimum horizontal principal stresses, which act in directions perpendicular to each other on a plane perpendicular to an axis of the borehole; and the maximum horizontal principal stress ($\sigma_1$) and the minimum horizontal principal stress ($\sigma_2$) can be obtained using a following first equation, $$(1-2\cos 2\theta)\sigma_1+(1+2\cos 2\theta)\sigma_2+\sigma_t=C(t_\alpha-t) \quad \text{<First Equation>}$$

where $\sigma_1$ is the maximum horizontal principal stress, $\sigma_2$ is the minimum horizontal principal stress, $\theta$ is the rotating angle measured in a counterclockwise direction from a point, on which the maximum horizontal principal stress acts, to the cracking point centered around a central point of the borehole on the plane perpendicular to the axis of the borehole, $\sigma_t$ is the tensile strength of the rock, $t_\alpha$ is the temperature of the rock before the cooling, and t is one of the first and second cracking temperatures, and where C is the bi-axial thermo-elastic constant of the rock in which the borehole wall is formed and is expressed by $C=E\alpha./(1-v)$, E is the elastic coefficient (Young's module) of the rock, $\alpha$ is the linear thermal expansion coefficient of the rock, and v is the Poisson's ratio of the rock.

3. The method according to claim 2, wherein:

in-situ stress comprises a vertical stress, which acts in directions perpendicular to directions of the maximum and minimum horizontal principal stresses; and the vertical stress is obtained using a following second equation, $$\sigma_3=C(t_\alpha=t_3)-\sigma_t \quad \text{<Second Equation>}$$

where $\sigma_3$ is the vertical stress, and $t_3$ is the temperature of the rock when a transverse crack perpendicular to an axial direction of the borehole is formed.

4. The method according to claim 3, wherein $t_3$ is set by averaging the cracking start and end points when a transverse crack is formed in a circular shape along the borehole wall and when the temperatures of the borehole wall are different from each other at the cracking start and end points.

5. The method according to claim 2, wherein the tensile strength ($\sigma_t$) of the rock is set to 0 when the first equation is established using the second cracking temperature measured by re-opening the crack in the second cooling step.

6. The method according to claim 2, wherein the maximum and minimum horizontal principal stresses are calculated by forming a crack at four or more points in the borehole wall and by creating and simultaneously solving a plurality of first equations.

7. The method according to claim 2, wherein the maximum and minimum horizontal principal stresses are calculated by:

treating the thermal-elastic constant and the tensile strength of the rock, which are physical property values, as constants; and forming cracks at two or more points in the borehole wall, and creating and simultaneously solving a plurality of first equations.

8. The method according to claim 2, wherein the maximum and minimum horizontal principal stresses are calculated by:

treating one of the thermal-elastic constant and the tensile strength of the rock as a constant; and forming cracks at three or more points in the borehole wall, and creating and simultaneously solving a plurality of first equations.

9. The method according to claim 2, wherein the maximum and minimum horizontal principal stresses are decided by:

forming a plurality of cracks at different points in the borehole wall, creating a plurality of first equations, and calculating a plurality of solutions of the maximum and minimum horizontal principal stresses; and performing a least square method using the plurality of solutions of the maximum and minimum horizontal principal stresses.

10. The method according to claim 1, wherein the heating step comprises introducing external air into the borehole to heat the borehole.

11. An apparatus for measuring in-situ stress in rock using a thermal crack by drilling a borehole into the ground, and by forming a crack caused by heat in a wall of the borehole, the apparatus comprises:

a coolant container, in which an annular containing space where a coolant can be contained, and an inlet for the coolant to flow into and out of the containing space are formed;

at least one temperature sensor, which is installed on an outer surface of the coolant container so as to measure temperature of the borehole wall;

a crack detecting means for detecting cracks formed in the borehole wall by heat transmission between the coolant contained in the coolant container and the borehole wall;

a coolant injecting means for injecting the coolant into the containing space, wherein the coolant injecting means comprises:

a cylinder, which is coupled to the coolant container such that a coolant chamber, in which the coolant is contained, is formed between the coolant container and the cylinder;

a piston, which has a piston head inserted into the cylinder, and a piston rod having a bar shape and fixed to the piston head, which is installed so as to be able to be reciprocated in the cylinder, and'which pushes the coolant towards the coolant container;

a driver, which reciprocates the piston; and a valve, which is installed on the coolant container so as to mutually communicate and shut the coolant chamber and the containing space.

12. The apparatus according to claim 11, further comprising a close-contact means for bringing an outer surface of the coolant container into close contact with the borehole wall.

13. The apparatus according to claim 12, wherein:

the coolant container comprises an inner wall, an outer wall disposed outside the inner wall while spaced apart from an outer circumference of the inner wall, an upper cover coupled to the upper sides of the inner and outer walls, and a lower cover coupled to the lower sides of the inner and outer walls; and the annular containing space is surrounded and defined by the inner and outer walls and the upper and lower covers.

14. The apparatus according to claim 13, wherein:

the coolant container is provided therein with a filling space, which is surrounded by the inner wall, the upper cover, and the lower cover of the coolant container so as to fill and discharge a fluid;

the close-contact means uses a pump connected to the filling space so as to fill and discharge the fluid into and from the filling space; and the outer and inner walls of the coolant container are made of an elastic material, which expand and contract as the fluid is filled into and discharged from the filling space.

15. The apparatus according to claim 11, wherein the coolant contained in the coolant container is liquefied nitrogen.

16. The apparatus according to claim 11, wherein:

the driver comprises a reversible motor, which includes a rotor having a hollow shape and a female thread on an inner circumference thereof; and the piston rod has a male thread on an outer circumference thereof, is screwed into the rotor, and is linearly reciprocated when the rotor is rotated in forward and reverse directions.

17. The apparatus according to claim 16, wherein:

the piston rod extends through the piston head, the coolant chamber of the cylinder and the coolant container, and protrudes from the coolant container at one end thereof and from the motor at the other end thereof; and an air injection hole passes through the opposite ends of the piston rod in a longitudinal direction of the piston rod.

18. The apparatus according to claim 11, further comprising a pressure decreasing valve, which is installed on the coolant container in order to open and shut the containing space of the coolant container and to discharge the coolant of the containing space.

19. The apparatus according to claim 11, wherein the crack detecting means detects a burst sound occurring when a crack is formed from the rock with the borehole wall, and comprises a plurality of acoustic emission sensors attached to an outer circumference of the coolant container.

* * * * *